US012226876B2

(12) United States Patent
Jayaram et al.

(10) Patent No.: US 12,226,876 B2
(45) Date of Patent: Feb. 18, 2025

(54) ABRASIVE ARTICLE, ABRASIVE SYSTEM AND METHOD FOR USING AND FORMING SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Robin Chandras Jayaram, Thiruvananthapuram (IN); Arunvel Thangamani, Chennai (IN)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 900 days.

(21) Appl. No.: 16/840,312

(22) Filed: Apr. 3, 2020

(65) Prior Publication Data

US 2020/0316754 A1 Oct. 8, 2020

(30) Foreign Application Priority Data

Apr. 3, 2019 (IN) ..... 201941013460

(51) Int. Cl.
*B24D 11/00* (2006.01)
*B24B 49/10* (2006.01)
(Continued)

(52) U.S. Cl.
CPC ..... *B24D 11/001* (2013.01); *B24B 49/10* (2013.01); *B24D 3/00* (2013.01); *B24D 3/10* (2013.01); *B24D 3/346* (2013.01)

(58) Field of Classification Search
CPC ..... B24D 3/10; B24D 3/346; B24D 11/001; B24D 3/00; B24D 2205/00; B24D 11/00;
(Continued)

(56) References Cited

U.S. PATENT DOCUMENTS 3,167,891 A 2/1965 Coes, Jr. et al.
3,499,318 A 3/1970 Bogdanov et al.
(Continued)

FOREIGN PATENT DOCUMENTS

BE 1018794 A3 9/2011
CA 2461391 A1 9/2005
(Continued)

OTHER PUBLICATIONS

International Search Report & Written Opinion for PCT/US2020/026754, dated Jul. 27, 2020.
(Continued)

*Primary Examiner* — Bryan D. Ripa
*Assistant Examiner* — Marites A Guino-o Uzzle
(74) *Attorney, Agent, or Firm* — Abel Schillinger, LLP; Arpan Ghosh

(57) ABSTRACT

An abrasive article includes a body and an electronic assembly coupled to the body, the electronic assembly including an electronic device, and a first portion between the body and the communication device, the first portion having a material of an average relative magnetic permeability of not greater than 15.

20 Claims, 29 Drawing Sheets

(51) Int. Cl.
*B24D 3/00* (2006.01)
*B24D 3/10* (2006.01)
*B24D 3/34* (2006.01)

(58) Field of Classification Search
CPC ..... B24D 3/34; B24B 49/10; H01L 23/28; H01L 23/31; H01L 23/3157; H01L 23/3192; H01L 23/32
See application file for complete search history.

(56) References Cited

U.S. PATENT DOCUMENTS 3,604,271 A 9/1971 Matson
3,691,698 A 9/1972 Schaller
3,724,138 A 4/1973 Ishikawa
4,295,301 A 10/1981 Barth et al.
4,505,074 A 3/1985 Kogure
4,535,571 A 8/1985 Smith
4,570,389 A 2/1986 Leitch et al.
4,590,573 A 5/1986 Hahn
4,674,235 A 6/1987 Inoue
4,916,679 A 4/1990 Agnello
5,044,125 A 9/1991 Lambert, Jr. et al.
5,070,655 A 12/1991 Aggarwal
5,125,188 A 6/1992 Ogawa et al.
5,201,916 A 4/1993 Berg et al.
5,202,680 A 4/1993 Savage
5,377,455 A 1/1995 Lanzer
5,477,268 A 12/1995 Shimbara et al.
5,486,129 A 1/1996 Sandhu et al.
5,509,848 A 4/1996 Shimbara
5,560,753 A 10/1996 Schnabel et al.
5,609,718 A 3/1997 Meikle
5,620,489 A 4/1997 Tselesin
5,637,794 A 6/1997 Hanisko
5,692,950 A 12/1997 Rutherford et al.
5,718,617 A 2/1998 Priestley et al.
5,725,413 A 3/1998 Malshe et al.
5,733,178 A 3/1998 Ohishi
5,738,574 A 4/1998 Tolles et al.
5,827,111 A 10/1998 Ball
5,833,519 A 11/1998 Moore
5,871,391 A 2/1999 Pryor
5,885,131 A 3/1999 Azarian et al.
5,938,503 A 8/1999 Cook et al.
5,975,994 A 11/1999 Sandhu et al.
6,000,997 A 12/1999 Kao et al.
6,123,612 A 9/2000 Goers
6,171,174 B1 1/2001 Campbell et al.
6,208,128 B1 3/2001 Braconnier et al.
6,213,634 B1 4/2001 Harrington et al.
6,244,937 B1 6/2001 Jaskowiak et al.
6,264,533 B1 7/2001 Kummeth et al.
6,294,993 B1 9/2001 Calaman
6,319,108 B1 11/2001 Adefris et al.
6,320,654 B1 11/2001 Alders et al.
6,322,422 B1 11/2001 Satou
6,322,427 B1 11/2001 Li et al.
6,325,696 B1 12/2001 Boggs et al.
6,330,971 B1 12/2001 Mabry et al.
6,387,289 B1 5/2002 Wright
6,421,013 B1 7/2002 Chung
6,458,014 B1 10/2002 Ihsikawa et al.
6,490,929 B1 12/2002 Russell et al.
6,520,834 B1 2/2003 Marshall
6,558,229 B2 5/2003 Kimura et al.
6,558,239 B2 5/2003 Kunisawa et al.
6,602,109 B1 8/2003 Malkin et al.
6,602,724 B2 8/2003 Redeker et al.
6,739,945 B2 5/2004 Halley et al.
6,752,693 B1 6/2004 Kistler
D492,607 S 7/2004 Curkovic et al.
6,764,381 B2 7/2004 Kimura et al.
6,905,571 B2 6/2005 Sakuma et al.
6,910,947 B2 6/2005 Paik
6,984,164 B2 1/2006 Kimura et al.
6,985,791 B2 1/2006 Malkin et al.
7,036,703 B2 5/2006 Grazioli et al.
7,066,028 B2 6/2006 Dondi
7,078,894 B2 7/2006 Tada et al.
7,104,342 B2 9/2006 Berg
7,115,018 B1 10/2006 Syverson
7,124,753 B2 10/2006 Sung
7,152,011 B2 12/2006 Benjamin et al.
7,153,190 B2 12/2006 Mavro-Michaelis
7,170,076 B2 1/2007 Butler et al.
7,204,320 B2 4/2007 Berg
7,259,678 B2 8/2007 Brown et al.
D557,624 S 12/2007 Coster et al.
D564,367 S 3/2008 Molyneux
7,357,031 B2 4/2008 Trionfetti et al.
D569,282 S 5/2008 Daniel
7,489,856 B2 2/2009 Haller
7,552,781 B2 6/2009 Zhang et al.
D596,508 S 7/2009 Warren
7,561,052 B2 7/2009 Arai et al.
7,728,734 B2 6/2010 Arai et al.
7,740,425 B2 6/2010 Zeiler et al.
7,800,285 B2 9/2010 Andle et al.
7,817,098 B2 10/2010 Gertz et al.
7,818,141 B2 10/2010 Roth et al.
7,831,327 B2 11/2010 Stocker
7,840,305 B2 11/2010 Behr et al.
7,963,823 B2 6/2011 Fischer
8,049,636 B2 11/2011 Buckingham et al.
8,133,092 B2 3/2012 Arcona et al.
8,337,276 B2 12/2012 Rossignol et al.
8,421,600 B2 4/2013 Erickson et al.
8,496,511 B2 7/2013 Laraia et al.
8,544,559 B2 10/2013 Friberg et al.
D692,784 S 11/2013 Anderssen et al.
D696,712 S 12/2013 Armstrong et al.
8,622,787 B2 1/2014 Sung
8,660,684 B2 2/2014 Mundt et al.
D709,392 S 7/2014 Wang et al.
D711,269 S 8/2014 Esposito et al.
8,801,497 B2 8/2014 Schwappach et al.
8,808,064 B2 8/2014 Schwappach et al.
8,840,447 B2 9/2014 Schwappach et al.
D721,981 S 2/2015 Choi et al.
D729,647 S 5/2015 Phillips et al.
D729,655 S 5/2015 Bauer et al.
D730,225 S 5/2015 Behar
9,028,294 B2 5/2015 Moon et al.
D730,761 S 6/2015 Spaeth et al.
D731,906 S 6/2015 Troutman et al.
D733,888 S 7/2015 Tuhkanen
9,183,738 B1 11/2015 Allen, Sr. et al.
9,218,244 B1 12/2015 Hayes et al.
9,242,330 B1 1/2016 Layton, Jr. et al.
D749,005 S 2/2016 Bruce et al.
9,254,545 B2 2/2016 Park
9,256,988 B2 2/2016 Wenger et al.
9,272,386 B2 3/2016 Suen et al.
9,460,170 B2 10/2016 Boensch et al.
D773,057 S 11/2016 Vandiver
9,530,092 B2 12/2016 Chatterjee et al.
9,594,404 B2 3/2017 Yoon et al.
9,600,759 B2 3/2017 Ronneberger et al.
9,635,888 B2 3/2017 Yoon et al.
D787,299 S 5/2017 Liu
9,659,832 B2 * 5/2017 Giorgini ..... H01L 23/3121
9,669,508 B2 6/2017 Layton, Jr. et al.
9,715,011 B2 7/2017 Krapf et al.
D794,013 S 8/2017 Heck et al.
D796,356 S 9/2017 Bayley et al.
9,751,185 B2 9/2017 Wolf et al.
D800,313 S 10/2017 Chang
D812,499 S 3/2018 Kuh et al.
D818,855 S 5/2018 Tooze
9,962,807 B2 5/2018 Klee et al.
9,987,720 B2 6/2018 Suen et al.
10,021,236 B2 7/2018 Esenwein et al.
D825,356 S 8/2018 Yu

(56) References Cited

U.S. PATENT DOCUMENTS 10,046,429 B2 8/2018 Stock et al.
10,104,923 B2 10/2018 Howland et al.
D836,472 S 12/2018 Zhiyuan
10,168,254 B2 1/2019 Cloake
10,180,667 B2 1/2019 Sawada et al.
10,200,524 B2 2/2019 Stock et al.
10,209,702 B2 2/2019 Cheng et al.
10,295,986 B2 5/2019 Saitou et al.
10,300,574 B2 5/2019 Layton, Jr. et al.
D852,649 S 7/2019 Burns et al.
10,434,626 B2 10/2019 Huber et al.
10,449,654 B2 10/2019 Campolo et al.
10,449,655 B2 10/2019 Shibuya et al.
D866,367 S 11/2019 Yu et al.
10,471,567 B2 11/2019 Doering et al.
10,509,397 B2 12/2019 Tong et al.
10,525,563 B2 1/2020 Yamamoto
D878,982 S 3/2020 Gil Vera
10,593,574 B2 * 3/2020 Fung ..... H01L 21/67075
D890,346 S 7/2020 Lam et al.
10,706,640 B2 7/2020 Wenger et al.
10,823,749 B2 11/2020 Hayzen et al.
10,921,789 B2 2/2021 Kadokura
10,928,243 B2 2/2021 McLaughlin et al.
D915,229 S 4/2021 King et al.
D933,597 S 10/2021 Natsume et al.
11,147,512 B2 10/2021 Fujita
D935,113 S 11/2021 Bocknek et al.
11,229,987 B2 1/2022 Eckel et al.
D945,417 S 3/2022 Wang
11,289,197 B1 3/2022 Park et al.
D960,015 S 8/2022 McManigal et al.
11,440,174 B2 9/2022 Trick et al.
11,628,541 B2 4/2023 Eckel et al.
D1,003,745 S 11/2023 Jose
2002/0142706 A1 10/2002 Glashauser et al.
2002/0192966 A1 12/2002 Shanmugasundram et al.
2003/0022598 A1 1/2003 Muilenburg et al.
2003/0027424 A1 2/2003 Paik
2003/0139836 A1 7/2003 Matthews et al.
2003/0194946 A1 * 10/2003 Malkin ..... G05B 19/042 451/8
2004/0000998 A1 1/2004 Karp
2004/0048557 A1 3/2004 Nabeya
2004/0072499 A1 4/2004 Wakabayashi
2004/0110381 A1 6/2004 Yoshida
2004/0162010 A1 8/2004 Ohno et al.
2006/0014475 A1 1/2006 Sekiya
2006/0035565 A1 2/2006 Mavro-Michaelis
2006/0178775 A1 8/2006 Zhang et al.
2007/0163325 A1 7/2007 Radzisewski et al.
2007/0197229 A1 * 8/2007 Kalliola ..... G01S 3/46 455/456.1
2007/0226992 A1 10/2007 Kaneko et al.
2007/0235133 A1 10/2007 Benassi
2008/0004743 A1 1/2008 Goers et al.
2008/0032601 A1 2/2008 Arcona et al.
2008/0216414 A1 9/2008 Braunschweig et al.
2008/0227367 A1 9/2008 Birang et al.
2008/0304929 A1 12/2008 Fischer
2009/0040061 A1 2/2009 Golunski et al.
2009/0175694 A1 7/2009 Craig et al.
2009/0191791 A1 7/2009 Fukushima et al.
2009/0306485 A1 12/2009 Bell
2010/0156723 A1 6/2010 Luch
2010/0279586 A1 11/2010 Schwappach
2011/0035186 A1 2/2011 Liu et al.
2011/0136408 A1 6/2011 Frazee et al.
2011/0161562 A1 6/2011 Chang et al.
2011/0301742 A1 12/2011 Mundt et al.
2012/0007748 A1 1/2012 Forgues et al.
2012/0059978 A1 3/2012 Rosenbrand et al.
2012/0175938 A1 7/2012 Arcona et al.
2013/0059506 A1 3/2013 Qian et al.
2013/0189901 A1 7/2013 Klee et al.
2013/0268106 A1 10/2013 Mitani
2014/0070924 A1 3/2014 Wenger et al.
2014/0120724 A1 5/2014 Sung
2014/0143064 A1 5/2014 Tran
2014/0166323 A1 6/2014 Cooper
2014/0206977 A1 7/2014 Bahney et al.
2014/0208007 A1 7/2014 Cohen et al.
2014/0216735 A1 8/2014 Bell et al.
2014/0308883 A1 10/2014 Sung et al.
2015/0000944 A1 1/2015 Duesselberg et al.
2015/0097241 A1 4/2015 Rideau et al.
2015/0111477 A1 4/2015 Suen et al.
2015/0148937 A1 5/2015 Wolf
2015/0239094 A1 8/2015 Huber et al.
2015/0258654 A1 9/2015 Shinozaki
2015/0263592 A1 9/2015 Kawakami et al.
2015/0291867 A1 10/2015 Breder et al.
2015/0351648 A1 * 12/2015 Harvey ..... A61B 5/076 600/561
2016/0091965 A1 3/2016 Wang et al.
2016/0097241 A1 4/2016 Vaughn et al.
2016/0114450 A1 4/2016 Layton, Jr. et al.
2016/0114454 A1 4/2016 Layton, Jr. et al.
2016/0153244 A1 6/2016 Humphrey et al.
2016/0176007 A1 6/2016 Wolf et al.
2016/0192716 A1 7/2016 Lee
2016/0214198 A1 7/2016 Hsu
2016/0271748 A1 9/2016 Gerold et al.
2016/0314623 A1 10/2016 Coleman et al.
2016/0342142 A1 11/2016 Boeck
2016/0375570 A1 12/2016 Boeck et al.
2017/0008159 A1 1/2017 Boeck et al.
2017/0014984 A1 1/2017 Rola et al.
2017/0036315 A1 2/2017 Wimitzer et al.
2017/0057051 A1 3/2017 Nakamura
2017/0076564 A1 3/2017 Cruz-Hernandez et al.
2017/0113321 A1 4/2017 Chou et al.
2017/0132801 A1 5/2017 Trenholm et al.
2017/0138019 A1 5/2017 Nicoson et al.
2017/0274489 A1 9/2017 Baratta
2017/0368661 A1 12/2017 Nakamura
2018/0011474 A1 1/2018 Brinkhaus
2018/0068214 A1 3/2018 Jesme et al.
2018/0071889 A1 3/2018 Huang et al.
2018/0108241 A1 4/2018 Wong et al.
2018/0113427 A1 4/2018 Marcato
2018/0164781 A1 6/2018 Kubo et al.
2018/0180522 A1 6/2018 Kalhori et al.
2018/0236628 A1 8/2018 Eriksen
2018/0285888 A1 10/2018 Staebler et al.
2018/0345454 A1 12/2018 Chen et al.
2019/0022820 A1 1/2019 Kimba et al.
2019/0025114 A1 1/2019 Mclaughlin et al.
2019/0027382 A1 1/2019 Watanabe et al.
2019/0047117 A1 2/2019 Watanabe et al.
2019/0099859 A1 4/2019 Jayaram et al.
2019/0108747 A1 4/2019 Stenning et al.
2019/0118331 A1 4/2019 Takahashi et al.
2019/0118332 A1 4/2019 Sugiyama et al.
2019/0118333 A1 4/2019 Yagi et al.
2019/0121350 A1 4/2019 Cella et al.
2019/0131150 A1 5/2019 Suzuki et al.
2019/0134774 A1 5/2019 Yagi et al.
2019/0168355 A1 6/2019 Suzuki et al.
2019/0176316 A1 6/2019 Numata
2019/0193242 A1 6/2019 Takahashi et al.
2019/0200201 A1 6/2019 Schadow et al.
2019/0217438 A1 7/2019 Harada et al.
2019/0227528 A1 7/2019 Abbot et al.
2019/0230903 A1 8/2019 Mcshea
2019/0240799 A1 8/2019 Takeda et al.
2019/0243333 A1 8/2019 Yoon et al.
2019/0351526 A1 11/2019 Umemoto et al.
2020/0016722 A1 1/2020 Nakamura
2020/0023487 A1 1/2020 Namiki et al.
2020/0030936 A1 1/2020 Knudson et al.
2020/0030938 A1 1/2020 Knudson et al.
2020/0033842 A1 1/2020 Masuda et al.
2020/0039027 A1 2/2020 Goulet et al.

(56) References Cited

U.S. PATENT DOCUMENTS

| | | | |
|---|---|---|---|
| 2020/0041989 | A1 | 2/2020 | Zhang et al. |
| 2020/0147747 | A1 | 5/2020 | Takahashi et al. |
| 2020/0156210 | A1 | 5/2020 | Sullivan et al. |
| 2020/0206868 | A1 | 7/2020 | Owada et al. |
| 2020/0246939 | A1 | 8/2020 | Kashiwagi et al. |
| 2020/0262027 | A1 | 8/2020 | Nakamura |
| 2020/0269385 | A1 | 8/2020 | Kobata et al. |
| 2020/0282512 | A1 | 9/2020 | Kimba |
| 2020/0306927 | A1 | 10/2020 | Tanikella et al. |
| 2020/0368874 | A1 | 11/2020 | Kato et al. |
| 2020/0406422 | A1 | 12/2020 | Watanabe |
| 2021/0001447 | A1 | 1/2021 | Abe et al. |
| 2021/0013071 | A1 | 1/2021 | Yamaguchi et al. |
| 2021/0023675 | A1 | 1/2021 | Mandl |
| 2021/0101250 | A1 | 4/2021 | Watanabe et al. |
| 2021/0108959 | A1 | 4/2021 | Feraru et al. |
| 2021/0178554 | A1 | 6/2021 | Eckel et al. |
| 2021/0205976 | A1 | 7/2021 | Matei |
| 2021/0308825 | A1 | 10/2021 | Gabriel et al. |
| 2023/0157601 | A1 | 5/2023 | Schadow et al. |
| 2023/0339074 | A1 | 10/2023 | Jayaram et al. |
| 2024/0028129 | A1 | 1/2024 | Whitmire et al. |
| 2024/0103466 | A1 | 3/2024 | Givot et al. |

FOREIGN PATENT DOCUMENTS

| | | | |
|---|---|---|---|
| CN | 1055652 | C | 8/2000 |
| CN | 1322374 | A | 11/2001 |
| CN | 1489509 | A | 4/2004 |
| CN | 101048260 | A | 10/2007 |
| CN | 101180532 | A | 5/2008 |
| CN | 101626869 | A | 1/2010 |
| CN | 101898319 | B | 12/2011 |
| CN | 102892553 | A | 1/2013 |
| CN | 104732275 | A | 6/2015 |
| CN | 103395001 | B | 9/2015 |
| CN | 204748262 | U | 11/2015 |
| CN | 204807959 | U | 11/2015 |
| CN | 105215852 | A | 1/2016 |
| CN | 205696112 | U | 11/2016 |
| CN | 106607799 | A | 5/2017 |
| CN | 206182955 | U | 5/2017 |
| CN | 105415191 | B | 6/2018 |
| CN | 108573310 | A | 9/2018 |
| CN | 109249300 | A | 1/2019 |
| CN | 109410208 | A | 3/2019 |
| CN | 308196788 | | 8/2023 |
| CN | 308237646 | | 9/2023 |
| DE | 1997122121 | A1 | 12/1998 |
| DE | 10105781 | A1 | 8/2001 |
| DE | 10344602 | A1 | 5/2005 |
| DE | 102004053848 | A1 | 5/2006 |
| DE | 102007011880 | A1 | 9/2008 |
| DE | 102007031299 | A1 | 1/2009 |
| DE | 102010027981 | A1 | 10/2011 |
| DE | 102013108355 | A1 | 2/2015 |
| DE | 102013016068 | A1 | 4/2015 |
| EP | 0029280 | A1 | 5/1981 |
| EP | 0921906 | A1 | 6/1999 |
| EP | 1173308 | A1 | 1/2002 |
| EP | 0901881 | B1 | 10/2003 |
| EP | 1975985 | A1 | 10/2008 |
| EP | 2313233 | A2 | 4/2011 |
| EP | 1809130 | B1 | 8/2011 |
| EP | 1604782 | B1 | 1/2012 |
| EP | 2793132 | B1 | 10/2014 |
| EP | 3141350 | A1 | 3/2017 |
| EP | 2900423 | B1 | 11/2017 |
| EP | 3258327 | A1 | 12/2017 |
| EP | 3482876 | A1 | 5/2019 |
| EP | 3112089 | B1 | 1/2020 |
| EP | 3608059 | A1 | 2/2020 |
| EP | 3600782 | B1 | 5/2021 |
| EP | 3843908 | A1 | 7/2021 |
| GB | 2062511 | A | 5/1981 |
| GB | 2420087 | A | 5/2006 |
| IN | 374370-001 | | 3/2024 |
| JP | S5645373 | A | 4/1981 |
| JP | H01284413 | A | 11/1989 |
| JP | H04109550 | U | 9/1992 |
| JP | H11010535 | A | 1/1999 |
| JP | H11033909 | A | 2/1999 |
| JP | H11316106 | A | 11/1999 |
| JP | 2000079565 | A | 3/2000 |
| JP | 2000252246 | A | 9/2000 |
| JP | 2000292175 | A | 10/2000 |
| JP | 2002178257 | A | 6/2002 |
| JP | 2003192769 | A | 7/2003 |
| JP | 2004142083 | A | 5/2004 |
| JP | 2004186493 | A | 7/2004 |
| JP | 2004230548 | A | 8/2004 |
| JP | 2005291999 | A | 10/2005 |
| JP | 2005316580 | A | 11/2005 |
| JP | 2006055944 | A | 3/2006 |
| JP | 2006093296 | A | 4/2006 |
| JP | 2008221460 | A | 9/2008 |
| JP | 2009542449 | A | 12/2009 |
| JP | 2011218487 | A | 11/2011 |
| JP | 2013082051 | A | 5/2013 |
| JP | 2013088173 | A | 5/2013 |
| JP | 2013176828 | A | 9/2013 |
| JP | 2016525458 | A | 8/2016 |
| JP | 2016534891 | A | 11/2016 |
| JP | 2017509493 | A | 4/2017 |
| JP | 2017518887 | A | 7/2017 |
| JP | 2018118372 | A | 8/2018 |
| JP | 2018520890 | A | 8/2018 |
| JP | 2018144207 | A | 9/2018 |
| KR | 20030075790 | A | 9/2003 |
| KR | 101383600 | B1 | 4/2014 |
| KR | 20160145098 | A | 12/2016 |
| KR | 301249786.0000 | | 2/2024 |
| KR | 301249787.0000 | | 2/2024 |
| SE | 532224 | C2 | 11/2009 |
| SU | 1262344 | A1 | 10/1986 |
| WO | 9806541 | A1 | 2/1998 |
| WO | 0036543 | A1 | 6/2000 |
| WO | 2006003455 | A1 | 1/2006 |
| WO | 2006066259 | A2 | 6/2006 |
| WO | 2007085070 | A1 | 8/2007 |
| WO | 2008002735 | A2 | 1/2008 |
| WO | 2013073436 | A1 | 5/2013 |
| WO | 2013083943 | A2 | 6/2013 |
| WO | 2015011489 | A1 | 1/2015 |
| WO | 2015110245 | A1 | 7/2015 |
| WO | 2015160857 | A1 | 10/2015 |
| WO | 2017016752 | A1 | 2/2017 |
| WO | 2017039544 | A1 | 3/2017 |
| WO | 2017058769 | A1 | 4/2017 |
| WO | 2017078933 | A1 | 5/2017 |
| WO | 2017083120 | A1 | 5/2017 |
| WO | 2017095027 | A1 | 6/2017 |
| WO | 2017121671 | A1 | 7/2017 |
| WO | 2017123834 | A1 | 7/2017 |
| WO | 2017207550 | A1 | 12/2017 |
| WO | 2018044178 | A1 | 3/2018 |
| WO | 2018147011 | A1 | 8/2018 |
| WO | 2018160658 | A2 | 9/2018 |
| WO | WO-2018160663 | A2 * | 9/2018 ..... B24B 23/02 |
| WO | 2019071053 | A1 | 4/2019 |
| WO | 2019191443 | A1 | 10/2019 |
| WO | 2020028855 | A9 | 2/2020 |
| WO | 2020039170 | A1 | 2/2020 |
| WO | 2020039175 | A1 | 2/2020 |
| WO | 2020044157 | A1 | 3/2020 |
| WO | 2020044158 | A1 | 3/2020 |
| WO | 2020044178 | A1 | 3/2020 |
| WO | 2020106959 | A1 | 5/2020 |
| WO | 2020106959 | A8 | 5/2020 |
| WO | 2020205674 | A1 | 10/2020 |
| WO | 2022013766 | A1 | 1/2022 |
| WO | 2023100104 | A1 | 6/2023 |

(56) References Cited

FOREIGN PATENT DOCUMENTS

| | | | |
|---|---|---|---|
| WO | 2023225314 | A1 | 11/2023 |
| WO | 2024003838 | A4 | 1/2024 |

OTHER PUBLICATIONS

Extended European Search Report for EP20782051.5, dated Nov. 8, 2022, 10 pages.
"Wang Heng, Jia Minping, Chen Zuoliang, ""Fill-level measuring and control system based on multi-sensor information fusion for ball mill,"" Electric Power Automation Equipment, Sep. 10, 2012, Issue 32, vol. 9".
"A. Arun, et al., ""Monitoring Of Cylindrical Grinding Process Using Acoustic Emission Sensor,"" Materials Today: Proceedings, Jun. 12, 2018, Issue 2, vol. 5".
Extended European Search Report for EP19888093.2, completed Jul. 14, 2022, 10 pages.
Extended European Search Report for EP20784381.4, dated Jun. 13, 2023, 8 pages.
International Search Report and Written Opinion for PCT/US2018/054474, mailed Jan. 28, 2019, 20 pages.
International Search Report, from PCT application No. PCT/US2019/024602, dated Jul. 5, 2019, 3 pages.
International Search Report and Written Opinion, for International Application No. PCT/US2019/044920, dated Oct. 7, 2019, 9 pages.
International Search Report and Written Opinion for PCT/US2019/044978, dated Nov. 12, 2019, 11 pages.
International Searching Authority, International Search Report and Written Opinion, mailed on Mar. 9, 2020, issued in connection with International Patent Application No. PCT/US2019/062617, filed on Nov. 21, 2019, 12 pages.
International Search Report for PCT/US2020/025583, mailed Jul. 17, 2020, 11 pages.
International Search Report for PCT/US2022/072678, mailed Sep. 20, 2022, 14 pages.
International Search Report for PCT/US2023/022929, mailed Sep. 18, 2023, 9 pages.
Aiello et al., "Real time assessment of hand-arm vibration system based on capacitive MEMS accelerometers", Computers and Electronics in Agriculture 85 (2012), 45-52, 8 pages.
Asanghanwa, "Using RFID Technology to Stop Counterfeiting," ATMEL, 2007, 9 pages.
Armstrong, "Pinc Solutions Drives Supply Chain Efficiencies for Daimler Trucks," 2015, 3 pages, Armstrong & Associates, Inc.
The Beginner's Guide to RFID Systems, Atlas RFID Store Ebooks, 2017, 16 pages, https://www.atlasrfidstore.com/.
Belfiore, "Solving NASA's Water Problem," RFID Journal, 2015, 4 pages.
Brown, "Finding Value in the Industrial Internet of Things," 2016, outline of webinar from Lux Research, Inc., full webinar at https://web.luxresearchinc.com/download-iiot-2_16.
English translation of an Office Action for Chinese Application No. 2018800723863, dated Dec. 10, 2201, 13 pages.
EPC Compliant Class-1 Generation-2 UHF RFID Devices Conformance Requirements, GS1, 2015, 96 pages.
Fasl, "Using NI WSN and NI LabVIEW to Wirelessly Monitor Fatigue Damage on Highway Bridges," National Instrucments, 2013, 1 pages, https://sine.ni.com/cs/app/doc/p/id/cs-15206.
Holdowsky et al., "Inside the Internet of Things," Deloitte University Press, 2015, 54 pages.
How Does Rain RFID Technology Work, Impinj, available via the Internet at: https://www.impinj.com/about-rfid/ (last visited Apr. 27, 2020).
"Intermec RFID Tags & Media," Honeywell International Inc., 2013, 7 pages.
Liang, Piezoelectric Pressure Sensors Based on Flexible PZT Thick-Film Composite Device, University of Pittsburgh, 2014, https://d-scholarship.pitt.edu/23716/liangrj_etdPitt2014.pdf, 97 pages.
Loy et al., "ISM-Band and Short Range Device Regulatory Compliance Overview," Texas Instruments, 2005, 17 pages.
Malkin et al., Development of an "Intelligent Grinding Wheel" for In-Process Monitoring of Ceramic Grinding. Semi-annual report #3, published Mar. 26, 1998, DOI: 10.2172/584958, 16 pages.
Malkin et al., Grinding Wheel System, published Jan. 2003, abstract only.
Manyika et al., "The Internet of Things: Mapping the Value Beyond the Hype," 2015, 144 pages, McKinsey Global Institute, McKinsey & Company.
Mernaripour et al., "Atomic In-Place Updates for Non-Volatile Main Memories with Kamino-Tx," EuroSys '17, Apr. 23-26, 2017, pp. 499-512.
Morgan, Michael N. et al. "Design and implementation of an intelligent grinding assistant system," International Journal of Abrasive Technology (IJAT), vol. 1, No. 1, 2007, pp. 106-135.
"PINC Solutions Drives Supply Chain Efficiencies for Daimler Trucks," 2015, 3 pgs, Armstrong & Associates, Inc, avaiable via the Internet at: https://www.3plogistics.com/3pl-case-studies/pinc-solutions-drives-supply-chain-efficiencies-for-daimler-trucks/ (last visited Apr. 27, 2020).
Radio Frequency Identification, Winter Superabrasives brochure, 2009, 1 page.
Regulatory Status for using RFID in the EPC Gen2 (860 to 860 MHZ) band of the UHF spectrum, GS1, 2018, 18 pages.
"RFID for Brand Protection," NXP Semiconductors, 2013, 10 pages, https://nxp-rfid.com/applications/brand-protection-rfid/.
RFID Selection Guide, EBV Elektronik, 2010, 24 pages, https://cdn-shop.adafruit.com/datasheets/rfid+guide.pdf.
Sattlegger et al., "Navigating your way through the RFID jungle," Texas Instruments, 2014, 11 pages.
Standard Catalogue, Precision Grinding Solutions Winter Brochure, 2009, 160 pages.
Stoney et al., Dynamic wireless passive strain measurement in CNC turning using surface acoustic wave sensors, The International Journal of Advanced Manufacturing Technology, published Jun. 20, 2013, 69 (5-8), p. 1421-1430, 10 pages.
Varghese et al., Development of a Sensor-Integrated "Intelligent" Grinding Wheel for In-Process Monitoring, published Jul. 2013, CIRP Annals 49(1): 231-234, DOI: 10. 1016/S0007-8506(07)62935-7, abstract only.
Varghese et al., In-process monitoring of truing using a sensor integrated diamond grinding wheel, published Jan. 2002, abstract only.
"What is a Wireless Sensor Network?" National Instruments, 2016, 2 pages, https://www.ni.com/white-paper/7142/en/.
"Wireless Technologies Overview," Phase IV, 2014, 3 pages, https://www.phaseivengrcom/wireless-technologies/wireless-technologies-overview/.
Zuo Dun-Wen, "Modern Processing Technology," Beihang University Press, 2005, 9 pages.

* cited by examiner

ABRASIVE ARTICLE, ABRASIVE SYSTEM AND METHOD FOR USING AND FORMING SAME

CROSS-REFERENCE TO RELATED APPLICATION(S)

This application claims priority to Indian Patent Application No. 201941013460, entitled "ABRASIVE ARTICLES, ABRASIVE SYSTEMS, AND METHODS OF FORMING AND USING SAME," by Robin Chandras JAYARAM et al., filed Apr. 3, 2019, which is assigned to the current assignee hereof and incorporated herein by reference in its entirety.

FIELD OF THE DISCLOSURE

The present disclosure relates to abrasive articles and abrasive systems, and more particularly, abrasive articles and/or abrasive systems including an electronic assembly.

BACKGROUND

Abrasive articles can include abrasive particles attached to a matrix material and be used to remove material from an object. Various types of abrasive articles can be formed, including but not limited to, coated abrasive articles, bonded abrasive articles, convoluted abrasive articles, abrasive brushes, and the like. Coated abrasive articles generally include one or more layers of abrasive material overlying a substrate. The abrasive particles can be affixed to the substrate using one or more adhesive layers. A bonded abrasive article can include a three dimensional matrix of bond material and abrasive particles contained within the matrix of bond material. Bonded abrasive articles may include some content of porosity within the body.

The manufacturing and use of abrasive articles can vary widely and the industry continues to demand improved abrasive articles.

BRIEF DESCRIPTION OF THE DRAWINGS

Embodiments are illustrated by way of example and are not limited to the accompanying figures.

Skilled artisans appreciate that elements in the figures are illustrated for simplicity and clarity and have not necessarily been drawn to scale.

DETAILED DESCRIPTION

The following discussion will focus on specific implementations and embodiments of the teachings. The detailed description is provided to assist in describing certain embodiments and should not be interpreted as a limitation on the scope or applicability of the disclosure or teachings. It will be appreciated that other embodiments can be used based on the disclosure and teachings as provided herein.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

The abrasive articles of the embodiments herein can have various structures, grades and architectures and can be used in a variety of material removal operations. In an embodiment, the abrasive articles can include a fixed abrasive article. In a particular embodiment, the abrasive article can include bonded abrasive articles, coated abrasive articles and the like.

Figure 1A:
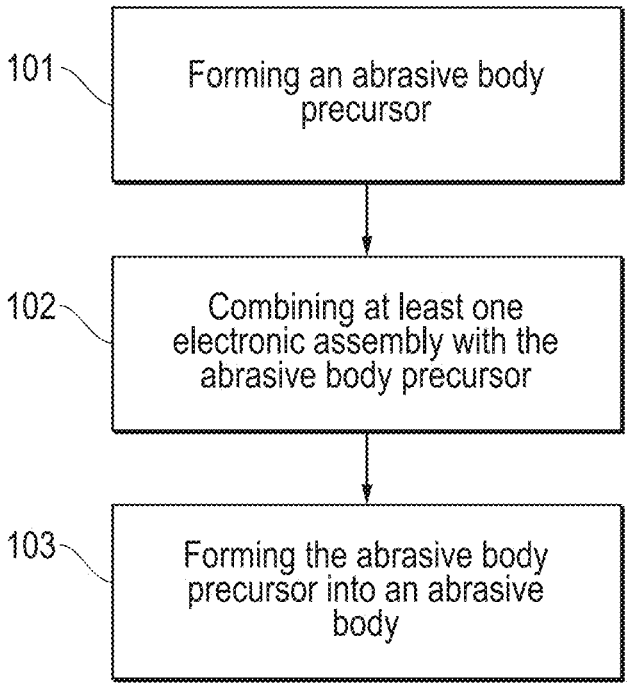
FIG. 1A includes a flow chart for forming an abrasive article according to an embodiment.

FIG. 1A includes a flow chart providing steps for forming an abrasive article according to an embodiment. As illustrated, the process begins at step 101 with forming of abrasive body precursor. An abrasive body precursor can be a green body or unfinished abrasive article, wherein at least one more process is needed to transform the abrasive body precursor into a finally-formed abrasive body. Such processes can include, but are not limited to curing, heating, sintering, cooling, drying, pressing, molding, casting, punching, or any combination thereof.

According to one embodiment, the abrasive body precursor can be a liquid material, such as a liquid mixture. The liquid mixture can include some or all of the components configured to form the finally-formed abrasive article. For example, the liquid mixture can include the abrasive particles and a bond precursor material.

In still another embodiment, the abrasive body precursor can be a solid green body. Reference herein to a green body, is an object that is formed into a solid three-dimensional body, but will undergo a final treatment, such as curing or a heat treatment to further solidify and/or densify the body. In particular, a green body includes a precursor bond material that is solid, but will undergo further treatment to transform the precursor bond material into a finally-formed bond material in the finally-formed abrasive article.

As noted herein, the abrasive body precursor may include a bond precursor material. A bond precursor material can include one or more components that can undergo a process to transform from the bond precursor material into the finally-formed bond material. Some suitable bond precursor materials can include an organic or inorganic material. For example, the bond precursor material can include a resin, an epoxy, a polyamide, a metal, a metal alloy, a vitreous material (e.g., a frit), a ceramic, or any combination thereof.

The abrasive body precursor may also include abrasive particles. The abrasive particles may include one or more various types, including for example, a mix of different types of abrasive particles. The abrasive particles can include any type of abrasive particle used and known by those of skill in the art. For example, the abrasive particles can include an inorganic material, including but not limited to, an oxide, a carbide, a nitride, a boride, a carbon-based materials (e.g., diamond), an oxycarbides, an oxynitride, an oxyboride, a superabrasive material, or any combination thereof. The abrasive particles can include shaped abrasive particles, crushed abrasive particles, exploded abrasive particles, agglomerated particles, unagglomerated particles, monocrystalline particles, polycrystalline particles, or any combination thereof. The abrasive particles can include a material selected from the group of silicon dioxide, silicon carbide, alumina, zirconia, flint, garnet, emery, rare earth oxides, rare earth-containing materials, cerium oxide, sol-gel derived particles, gypsum, iron oxide, glass-containing particles, brown fused alumina (57A), seeded gel abrasive, sintered alumina with additives, shaped and sintered aluminum oxide, pink alumina, ruby alumina (e.g., 25A and 86A), electrofused monocrystalline alumina 32A, MA88, alumina zirconia abrasives (NZ, NV,ZF), extruded bauxite, cubic boron nitride, diamond, aluminum oxy-nitride, extruded alumina (e.g., SR1, TG, and TGII), or any combination thereof. In certain instances, the abrasive particles can be particularly hard, having for example, a Mohs hardness of at least 6, such as at least 6.5, at least 7, at least 8, at least 8.5, at least 9. The finally-formed abrasive article can include any of the types of abrasive particles included in the precursor abrasive body.

The abrasive particles can have an average particle size (D50) of at least 0.1 microns, such as at least 1 micron, at least 5 microns, at least 10 microns, at least 20 microns, at least 30 microns, at least 40 microns or at least 50 microns or at least 100 microns or at least 200 microns or at least 500 microns or at least 1000 microns. Still, in another non-limiting embodiment, the abrasive particles can have an average particle size (D50) of not greater than 5000 microns, such as not greater than 4000 microns or not greater than 3000 microns or not greater than 2000 microns or not greater than 1000 microns or not greater than 500 microns or not greater than 200 microns or not greater than 100 microns or not greater than 80 microns or not greater than 60 microns or not greater than 30 microns or not greater than 10 microns or not greater than 1 micron. It will be appreciated that the abrasive particles can have an average particle size within a range including any of the minimum and maximum values noted above. Moreover, it will be appreciated that the finally-formed abrasive article can have abrasive particles having an average particles size within a range including any of the minimum and maximum percentages noted above.

The abrasive particles can include blends of different particles, which may differ from each other based on one or more abrasive characteristics, such as hardness, average particle size, average grain (i.e., crystallite size), toughness, two-dimensional shape, three-dimensional shape, composition, or any combination thereof. The blends of abrasive particles can include a primary and a secondary abrasive particle. The primary and secondary abrasive particles can include any of the compositions of abrasive particles described herein.

The abrasive body precursor can include a content of abrasive particles suitable for use as an abrasive article. For example, the abrasive body precursor can include at least 0.5 vol % abrasive particles for a total volume of the abrasive body precursor. In still other embodiments, the abrasive body precursor can include at least 1 vol % abrasive particles, such as at least 5 vol % or at least 10 vol % or at least 15 vol % or at least 20 vol % or at least 30 vol % or at least 40 vol % or at least 50 vol % or at least 60 vol % or at least 70 vol % or at least 80 vol % abrasive particles for a total volume of the abrasive body precursor. In yet another non-limiting embodiment, the abrasive body precursor can have not greater than 90 vol % abrasive particles for the total volume of the abrasive body precursor, such as not greater than 80 vol % or not greater than 70 vol % or not greater than 60 vol % or not greater than 50 vol % or not greater than 40 vol % or not greater than 30 vol % or not greater than 20 vol % or not greater than 10 vol % or not greater than 5 vol % abrasive particles. It will be appreciated that the abrasive body precursor can have a content of abrasive particles within a range including any of the minimum and maximum percentages noted above. Moreover, it will be appreciated that the finally-formed abrasive article can have a content of abrasive particles within a range including any of the minimum and maximum percentages noted above.

The abrasive body precursor may further include one or more types of fillers as known by those of skill in the art. The filler can be distinct from the abrasive particles and may have a hardness less than a hardness of the abrasive particles. The filler may provide improved mechanical properties and facilitate formation of the abrasive article. In at least one embodiment, the filler can include various materials, such as fibers, woven materials, non-woven materials, particles, minerals, nuts, shells, oxides, alumina, carbide, nitrides, borides, organic materials, polymeric materials, naturally occurring materials, pore-formers (solid or hollow), and a combination thereof. In particular instances, the filler can include a material such as wollastonite, mullite, steel, iron, copper, brass, bronze, tin, aluminum, kyanite, alusite, garnet, quartz, fluoride, mica, nepheline syenite, sulfates (e.g., barium sulfate), carbonates (e.g., calcium carbonate), cryolite, glass, glass fibers, titanates (e.g., potassium titanate fibers), rock wool, clay, sepiolite, an iron sulfide (e.g., $Fe_2S_3$, $FeS_2$, or a combination thereof), fluorspar ($CaF_2$), potassium sulfate ($K_2SO_4$), graphite, potassium fluoroborate ($KBF_4$), potassium aluminum fluoride ($KAlF_4$), zinc sulfide (ZnS), zinc borate, borax, boric acid, fine alundum powders, P15A, bubbled alumina, cork, glass spheres, silver, Saran™ resin, paradichlorobenzene, oxalic acid, alkali halides, organic halides, and attapulgite. Some fillers can volatilize or be consumed during later processing. Some fillers may become part of the finally-formed abrasive article. It will be appreciated that the body can include one or more reinforcing articles (e.g., woven or non-woven materials) that are incorporated into the body and are part of the finally-formed abrasive article.

The abrasive body precursor may further include one or more additives, including for example, but not limited to stabilizers, binders, plasticizers, surfactants, friction-reducing materials, rheology modifying materials, and the like.

In certain abrasive articles, such as coated abrasive articles, the abrasive body precursor may include a substrate or backing, upon which, may be formed one or more abrasive layers. According to one embodiment, the substrate can include an organic material, inorganic material, or any combination thereof. In certain instances, the substrate can include a woven material. However, the substrate may be made of a non-woven material. Particularly suitable substrate materials can include organic materials, including polymers such as polyester, polyurethane, polypropylene, and/or polyimides such as KAPTON from DuPont, and paper. Some suitable inorganic materials can include metals, metal alloys, and particularly, foils of copper, aluminum, steel, and a combination thereof. The backing can include one or more additives selected from the group of catalysts, coupling agents, curants, anti-static agents, suspending agents, anti-loading agents, lubricants, wetting agents, dyes, fillers, viscosity modifiers, dispersants, defoamers, and grinding agents.

In some abrasive articles, such as those utilizing a substrate, a polymer formulation may be used to form any of a variety of layers such as, for example, a frontfill, a pre-size, the make coat, the size coat, and/or a supersize coat. When used to form the frontfill, the polymer formulation generally includes a polymer resin, fibrillated fibers (preferably in the form of pulp), filler material, and other optional additives. Suitable formulations for some frontfill embodiments can include material such as a phenolic resin, wollastonite filler, defoamer, surfactant, a fibrillated fiber, and a balance of water. Suitable polymeric resin materials include curable resins selected from thermally curable resins including phenolic resins, urea/formaldehyde resins, phenolic/latex resins, as well as combinations of such resins. Other suitable polymeric resin materials may also include radiation curable resins, such as those resins curable using electron beam, UV radiation, or visible light, such as epoxy resins, acrylated oligomers of acrylated epoxy resins, polyester resins, acrylated urethanes and polyester acrylates and acrylated monomers including monoacrylated, multiacrylated monomers. The formulation can also comprise a nonreactive thermoplastic resin binder that may enhance the self-sharpening characteristics of the deposited abrasive particles by enhancing the erodability. Examples of such thermoplastic resin include polypropylene glycol, polyethylene glycol, and polyoxypropylene-polyoxyethene block copolymer, etc. Use of a frontfill on the substrate can improve the uniformity of the surface, for suitable application of the make coat and improved application and orientation of shaped abrasive particles in a predetermined orientation.

After forming the abrasive body precursor at step 101, the process continues at step 102 by combining at least one electronic assembly with the abrasive body precursor. According to an embodiment, the electronic assembly can include at least one electronic device. The electronic device can be configured to store and/or transmit information to one or more systems and/or individuals in the life of the abrasive article, including for example, those systems and/or individuals included in the manufacturing, sale, distribution, storage, use, maintenance and/or quality of the abrasive article.

The process of combining the electronic assembly with the abrasive body precursor can vary depending upon the nature of the abrasive body precursor. In one example, the process of combining the abrasive body precursor with the electronic assembly can include depositing the electronic assembly on or within the mixture of material defining the abrasive body precursor. In particular, the process of depositing the electronic assembly on or with the mixture can include incorporation of the electronic assembly into the mixture prior to formation of the finally-formed abrasive article. In such instances, the electronic assembly can be configured to survive one or more forming processes used to create the finally-formed abrasive article from the mixture. For example, the electronic assembly can be configured to survive and function after the mixture and electronic assembly are subjected to one or more processes including, for example, but not limited to, pressing, heating, drying, curing, cooling, molding, stamping, cutting, machining, dressing, and the like.

In one particular embodiment, the electronic assembly can be deposited on the mixture, such that at least a portion of the electronic assembly can be in contact with and overlying an exterior surface of the mixture. For example, the entire electronic assembly can be overlying the exterior surface of the mixture. Such a deposition process may facilitate forming an abrasive article having at least a portion of the electronic assembly at an exterior surface of the abrasive body.

In another embodiment, the electronic assembly can be deposited such that a portion of the electronic assembly can be contained within the mixture, such that at least a portion of the electronic assembly is positioned below the exterior surface of the mixture. For example, in one instance, a portion of the electronic assembly can be embedded within the mixture and another separate portion of the electronic assembly can be overlying the exterior surface of the mixture. Such a deposition process may facilitate formation of an electronic assembly in which a portion of the electronic assembly is embedded within the body of the abrasive article below an exterior surface of the body. In yet another embodiment, the entire electronic assembly can be embedded within the mixture. Such a deposition process may facilitate formation of an abrasive article, wherein the electronic assembly can be embedded entirely within the body of the abrasive article, such that no portion of the electronic assembly is protruding through the exterior surface of the body. It may be desirable to utilize a configuration in which the electronic assembly is partially or entirely embedded within the body of the abrasive article to reduce the likelihood of tampering with the electronic assembly and one or more electronic devices contained therein.

In still another embodiment, the process of depositing the electronic assembly on or within the mixture can further include applying the electronic assembly to one or more components and then applying the mixture to the component. For example, the electronic assembly can be placed on or within an article (e.g., a substrate, a backing, a reinforcing member, a partially-cured or completely cured abrasive portion, or the like) to be part of the finally-formed abrasive article and the mixture can be deposited onto the article. According to one embodiment, the electronic assembly may be adhered to the article and the mixture can be deposited over at least a portion or all of the electronic assembly. Further details regarding the placement of the electronic assembly are described herein.

Manufacturing information can be stored on the electronic assembly during or after one or more forming processes. The electronic assembly can include one or more electronic devices that can facilitate the measurement and/or storage of manufacturing data. Such manufacturing data may be helpful for manufacturers to know the manufacturing conditions used to form the abrasive article, and may further be useful in assessing the quality of the abrasive article. According to one embodiment, one or more read, write or erase operations can be conducted with each process. For example, a first process may be conducted in the manufacturing of the abrasive article and a first set of manufacturing information can be written to the electronic device. After completing the first process a read, write, or erase information can be performed. For example, manufacturing information can be read from the electronic device. Alternatively, or additionally, a write operation may be conducted to write new manufacturing information to the electronic device. Alternatively, or additionally, an erase operation may be conducted to remove all or a portion of the first set of manufacturing information. Thereafter, further processes can be conducted, and each process may include one or more read, write, or erase operations. In a particular embodiment, the electronic device can include partitioned portions. A partitioned portion may include a memory, and certain data may be stored in the memory. In some instances, one or more partitioned portions may be access-restricted to protect data from being read or edited by personnel who does not have the access. For example, manufacturing data may be stored in a partitioned portion for manufacturer use only so that others, such as users or distributors, may not make changes to the manufacturing data. In another instance, restriction of access to data stored in a partitioned portion may be changed to allow the data to be read or updated by personnel who is restricted from accessing the data previously.

In an alternative embodiment, the process of combining the at least one electronic assembly with the abrasive body precursor can include depositing the electronic assembly on a portion of a solidified green body. As disclosed herein, a green body can be an object that will undergo further processing. The process of depositing the electronic assembly on at least a portion of a green body can include attaching at least a portion of the electronic assembly to an exterior surface of the green body. In such instances, the electronic assembly is processed with the green body through one or more processes to form the finally-formed abrasive article. Various processes for depositing the electronic assembly on at least a portion of the green body can be used. For example, the electronic assembly can be bonded to a portion of the green body, such as the exterior surface of the green body. A bonding agent may be used, such as by an adhesive. In another embodiment, the electronic assembly can be fastened to at least a portion of the green body by one or more various types of fasteners. In still another embodiment, a portion of the electronic assembly can be pressed into a portion of the green body to facilitate attachment, such that a portion of the electronic assembly is embedded within the body of the green body.

In yet another embodiment, the abrasive body precursor can include an unfinished abrasive body that is a portion of a finally formed body. In an example, a portion of an abrasive body can be formed first, and in some instances, may undergo a further treatment during the process of forming a finally-formed abrasive body. In another instance, the abrasive body precursor may include a portion of a finally formed body and a green body of another portion. In still another instance, the abrasive body precursor may include a portion of a finally formed body and a material or material precursor for forming another portion of the finally formed body. In a further embodiment, an electronic assembly can be disposed over a portion of the abrasive body precursor, a material for forming another portion of the finally formed body can be applied to the abrasive body precursor and the electronic assembly. The electronic assembly can be coupled to the abrasive body after further treatment for forming the finally formed abrasive body.

After combining the at least one electronic assembly with the abrasive body precursor at step 102, the process can continue at step 103 by forming the abrasive body precursor into an abrasive body. Various suitable processes for forming the abrasive body precursor into an abrasive body can include, but is not limited to, curing, heating, sintering, firing, cooling, molding, pressing, or any combination thereof. It will be appreciated that in such instances, the electronic assembly can survive and function after one or more forming processes used to form the finally-formed abrasive article. Such forming processes may be used on a mixture or a solidified green body.

According to one embodiment, the forming process can include heating of the body to a forming temperature. The forming temperature can affect a transformation of one or more components in the mixture to form the finally-formed abrasive article. For example, the forming temperature can be at least 25° C., such as at least 40° C. or at least 60° C. or at least 80° C. or at least 100° C. or at least 150° C. or at least 200° C. or at least 300° C. or at least 400° C. or at least 500° C. or at least 600° C. or at least 700° C. or at least 800° C. or at least 900° C. or at least 1000° C. or at least 1100° C. or at least 1200° C. or at least 1300° C. Still, in one non-limiting embodiment, the forming temperature can be not greater than 1500° C. or not greater than 1400° C. or not greater than 1300° C. or not greater than 1200° C. or not greater than 1100° C. or not greater than 1000° C. or not greater than 900° C. or not greater than 800° C. or no greater than 700° C. or not greater than 600° C. or not greater than 500° C. or not greater than 400° C. or not greater than 300° C. or not greater than 200° C. or not greater than 100° C. or not greater than 80° C. or not greater than 60° C. It will be appreciated that the forming temperature can be within a range including any of the minimum and maximum values noted above.

In another embodiment, the forming process can include curing the electronic assembly. For instance, the electronic assembly can include a material or a material precursor that can undergo a curing process. Curing the electronic assembly can include curing of the material or material precursor. In another instance, curing of the electronic assembly can be conducted by heating, irradiation, chemical reactions, or any other means known in the art. In another instance, the forming process can include heating to cure the electronic assembly, heating to cure the abrasive body precursor, or heating to cure both. Curing of the abrasive body precursor can include curing of a precursor material of the abrasive body precursor. In an aspect, curing the electronic assembly or the abrasive body can facilitate coupling of the electronic assembly to the abrasive body, and particularly, curing can facilitate directly coupling the electronic assembly to the finally formed abrasive body in a tamper-proof manner. As used herein, the term, tamper-proof, is intended to mean that the manner of coupling may not allow the electronic assembly to be removed or extracted from the abrasive article without damaging the abrasive article. In a particular example, curing the electronic assembly and curing the abrasive body precursor can take place in the same heating process. In another particular embodiment, heating the electronic assembly and abrasive body precursor can allow the electronic assembly and abrasive body precursor to co-cure. In yet another embodiment, curing the electronic assembly and curing the abrasive body precursor can occur at the same heating temperature. In yet another instance, the abrasive body can be finally formed by co-curing the abrasive body precursor and the electronic assembly.

In another embodiment, the forming process can include heating the electronic assembly and heating at least a portion of the abrasive body precursor. Heating can be conducted at a temperature at that the abrasive body precursor and/or the electronic assembly can cure. Particularly, heating can be performed at the temperature that can allow both the abrasive body precursor and the electronic assembly to cure. In an aspect, co-curing the electronic assembly and the abrasive body can be performed at a temperature that can facilitate improved coupling of the electronic assembly to the abrasive body and formation of the abrasive article. For instance, co-curing the electronic assembly and the abrasive body precursor can be performed at a temperature of at least 90° C., at least 95° C., at least 100° C., at least 105° C., at least 108° C., at least 110° C., at least 115° C., at least 120° C., at least 130° C., at least 140° C., at least 150° C., at least 155° C., at least 160° C., at least 165° C., at least 170° C., at least 175° C., at least 180° C., at least 190° C., at least 200° C., at least 210° C., at least 220° C., at least 230° C., at least 240,° C., or at least 250° C. In another instance, co-curing the abrasive body precursor and the electronic assembly may be performed at a temperature of not greater than 250° C., not greater than 245° C., not greater than 240° C., not greater than 235° C., not greater than 230° C., not greater than 220° C., not greater than 215° C., not greater than 210° C., not greater than 200° C., not greater than 195° C., not greater than 185° C., not greater than 180° C., or not greater than 170° C., not greater than 165° C., not greater than 160° C., not greater than 155° C., not greater than 150° C., not greater than 145° C., not greater than 140° C., not greater than 135° C., not greater than 130° C., not greater than 125° C., or not greater than 120° C. Moreover, co-curing the abrasive body precursor and the electronic assembly can be performed at a temperature including any of the minimum and maximum values noted herein. For instance, co-curing may be performed at a temperature in a range including at least 90° C. and not greater than 250° C., such as in a range including at least 120° C. and not greater than 140° C., or in a range including at least 150° C. and not greater than 190° C.

In a further aspect, co-curing the abrasive body precursor and the electronic assembly can be performed for a certain period of time to facilitate improved coupling of the electronic assembly to the abrasive body and formation of the abrasive article. For instance, co-curing can be performed for at least 0.5 hours, at least 1 hour, at least 2 hours, at least 3 hours, at least 4 hours, at least 5 hours, at least 6 hours, at least 7 hours, at least 8 hours, at least 10 hours, at least 12 hours, at least 15 hours, at least 18 hours, at least 20 hours, at least 30 hours, at least 26 hours, at least 28 hours, at least 30 hours, at least 32 hours, at least 35 hours, or at least 36 hours. In another instance, co-curing may be performed for not greater than 38 hours, not greater than 36 hours, not greater than 32 hours, not greater than 30 hours, not greater than 28 hours, not greater than 25 hours, not greater than 21 hours, not greater than 18 hours, not greater than 16 hours, not greater than 14 hours, not greater than 12 hours, not greater than 10 hours, not greater than 8 hours, not greater than 7 hours, not greater than 6 hours, not greater than 5 hours, not greater than 4 hours, not greater than 3 hours, or not greater than 2 hours. Moreover, co-curing the abrasive body precursor and the electronic assembly can be performed for a period of time including any of the minimum and maximum values noted herein. For instance, co-curing may be performed for a period of time in a range including at least 0.5 hours and not greater than 38 hours, such as in a range including at least 4 hours and not greater than 10 hours, or in a range including at least 20 hours and not greater than 32 hours.

After reading this disclosure, a skilled artisan would understand that conditions for co-curing the abrasive body precursor and the electronic assembly can be determined, taking into consideration factors that can affect temperatures at that the abrasive body precursor and the electronic assembly cure, such as the nature of the precursor materials to be cured, to suit particular implementations.

In another aspect, the process illustrated in FIG. 1A may also be used to combine an electronic assembly with a non-abrasive precursor body. The non-abrasive precursor body will form a non-abrasive portion of the finally-formed abrasive body, which will be a region of the abrasive article that is free of abrasive particles. The non-abrasive precursor body and a non-abrasive portion of the body may include a precursor bond material or bond material. In an alternative embodiment, the non-abrasive precursor body and a non-abrasive portion of the body may be free of a precursor bond material or bond material.

Figure 1B:
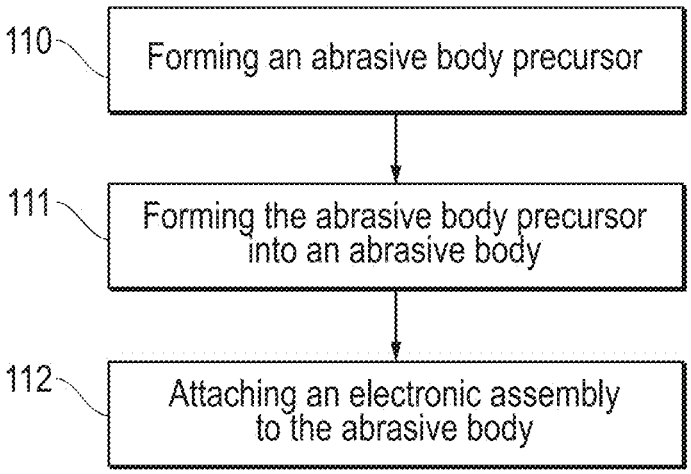
FIG. 1B includes a flow chart for forming an abrasive article according to an embodiment.

FIG. 1B includes a flow chart for forming an abrasive article according to an embodiment. As illustrated in FIG. 1B, the process can be initiated at step 110 forming an abrasive body precursor. The abrasive body precursor can be formed using any of the processes described in embodiments herein. The abrasive body precursor can include any of the features of abrasive body precursors as described in embodiments herein. The process of forming the abrasive body precursor can include forming a mixture as described in embodiments herein.

After forming the abrasive body precursor at step 110, the process can continue at step 111 by forming the abrasive body precursor into a finally-formed abrasive body. Suitable forming processes can include those described in embodiments herein, including for example, but not limited to, curing, heating, sintering, firing, cooling, pressing, molding or any combination thereof. According to one embodiment, the process of forming the abrasive body precursor into a finally-formed abrasive body can include heating the abrasive body precursor to a forming temperature as described in embodiments herein.

After forming the abrasive body precursor into a finally-formed abrasive body at step 111, the process can continue at step 112 by attaching an electronic assembly to the abrasive body, wherein the electronic assembly comprises at least one electronic device. The process of attaching can include adhering, chemical bonding, sinter-bonding, brazing, puncturing, fastening, connecting, heating, pressing, curing, or any combination thereof. Moreover, it will be appreciated that the method of attaching may determine the placement, orientation and exposure of the electronic assembly. For example, at least a portion of the electronic assembly can be attached and exposed at an exterior surface of the body of the abrasive article. In one embodiment, at least a portion of the electronic assembly can be embedded within the body of the abrasive article and another portion of the electronic assembly can be exposed and protruding from the exterior surface of the body of the abrasive article.

In an embodiment, attaching an electronic assembly to the abrasive body can include disposing the electronic assembly over a surface of the abrasive body. In a particular embodiment, the electronic assembly can be disposed on an exterior surface of the abrasive body. An example of an exterior surface can include a major surface or a peripheral surface the abrasive body. In a particular instance, the electronic assembly may be disposed on an exterior surface that is not a grinding surface of the abrasive body to reduce the likelihood of being damaged during a material removal operation. In another particular instance, the exterior surface can include a major surface of the abrasive body, such as a major surface of a grinding wheel or a major surface of a cut-off wheel. In yet another particular instance, the exterior surface can be the surface of an inner circumferential wall of the abrasive body with a central opening.

In an embodiment, attaching an electronic assembly to the abrasive body can include heating the electronic assembly. Heating can be performed at a temperature that can facilitate improved bonding of the electronic assembly to the abrasive body. For instance, heating can be performed at a temperature such that a portion of the electronic assembly can reach its glass transition temperature and adhere to the abrasive body in the subsequent cooling step. In another embodiment, the attaching can include heating the abrasive body and the electronic assembly such that a portion of the abrasive body and a portion of the electronic assembly can reach their respective glass transition temperature and bonding of the abrasive body and the electronic assembly can be formed during subsequent cooling.

In another embodiment, attaching an electronic assembly to the abrasive body can include pressing the electronic assembly at an elevated temperature to facilitate improved coupling of the electronic assembly to the abrasive body. The elevated temperature can include a temperature higher than room temperature (i.e., 20° C. to 25° C.). In a particular example, the elevated temperature can include a glass transition temperature of a material forming a portion of the electronic assembly, a glass transition temperature of the bond material, or both. In another particular instance, pressing the electronic assembly can be performed at a temperature of at least 90° C., such as at least 100° C., at least 110° C., at least 120° C., at least 125° C., at least 130° C., at least 150° C., at least 150° C., or at least 160° C. Alternatively or additionally, pressing the electronic assembly may be performed at a temperature of not greater than 180° C., not greater than 175° C., not greater than 170° C., not greater than 165° C., not greater than 160° C., not greater than 155° C., not greater than 150° C., not greater than 145° C., not greater than 140° C., not greater than 130° C., or not greater than 125° C. Moreover, pressing the electronic assembly may be performed at a temperature in a range including any of the minimum and maximum values noted herein. For example, pressing the electronic assembly may be performed at a temperature in a range from at least 90° C. to not greater than 180° C.

In a further example, pressing the electronic assembly can be performed for a certain period of time to facilitate improved coupling of the electronic assembly to the bonded body and formation of the abrasive article, such as at least 10 seconds, at least 30 seconds, at least 1 minute, at least 2 minutes, at least 5 minutes, at least 10 minutes, at least 15 minutes, at least 20 minutes, at least 25 minutes, or at least 30 minutes. Alternatively, or additionally, pressing the electronic assembly may be performed for not greater than 35 minutes, not greater than 30 minutes, not greater than 25 minutes, or not greater than 20 minutes. Moreover, pressing the electronic assembly may be performed for a time period in a range including any of the minimum and maximum values noted herein. For example, pressing the electronic assembly may be performed for at least 10 seconds to not greater than 35 minutes.

In a further example, pressing the electronic assembly can be performed at a certain pressure to facilitate attaching the electronic assembly to the bonded body and formation of the abrasive article, such as at least 0.3 bars, at least 1 bar, at least 3 bars, at least 5 bars, at least 10 bars, at least 15 bars, at least 20 bars, at least 25 bars, at least 30 bars, at least 35 bars, at least 40 bars, at least 45 bars or at least 50 bars, at least 60 bars, at least 65 bars, at least 70 bars, at least 75 bars, at least 80 bars, at least 85 bars, at least 90 bars, at least 100 bars, at least 120 bars, at least 130 bars, at least 135 bars, at least 140 bars, at least 150 bars, at least 160 bars, at least 170 bars, or at least 180 bars. Alternatively, or additionally, the pressure may be at most 200 bars, at most 190 bars, at most 180 bars, at most 170 bars, at most 160 bars, at most 150 bars, at most 140 bars, at most 130 bars, at most 120 bars, at most 110 bars, at most 100 bars, at most 90 bars, at most 80 bars, at most 70 bars, at most 60 bars, or at most 50 bars. Moreover, pressing can be operated at the pressure in a range including any of the minimum and maximum values noted herein. For example, pressing can be performed at a pressure in a range including at least 10 bars and at most 200 bars.

In a particular example, attaching an electronic assembly to the abrasive body can include subjecting the electronic assembly and at least a portion of the abrasive body to an autoclaving operation. In a particular instance, autoclaving can be performed to attach a plurality of the electronic assemblies to the abrasive body. In an aspect, the autoclaving operation can include applying a pressure to the electronic assembly, such as a pressure of at least 2 bars, at least 5 bars, at least 8 bars, at least 10 bars, at least 12 bars, at least 13 bars, at least 15 bars or at least 16 bars. Alternatively, or additionally, the pressure may be at most 16 bars, at most 13 bars, at most 11 bars, at most 10 bars, at most 9 bars, at most 7 bars, at most 5 bars, at most 3 bars or at most 2 bars. Moreover, autoclaving can be operated at the pressure including any of the minimum and maximum values noted herein. For instance, autoclaving pressure can be in a range including at least 0.3 bars and at most 16 bars.

The autoclaving operation can also include heating the electronic assembly at a temperature of at least 90° C., such as at least at least 100° C., at least 110° C., at least 120° C., at least 125° C., at least 130° C., at least 150° C., at least 150° C., or at least 160° C. Alternatively, or additionally, the heating temperature for performing autoclaving may be not greater than 160° C., not greater than 155° C., not greater than 150° C., not greater than 145° C., not greater than 140° C., not greater than 130° C., not greater than 125° C., or not greater than 120° C. Moreover, autoclaving can be operated at a temperature including any of the minimum and maximum values noted herein. Autoclaving can be operated for a certain period of time to facilitate coupling the electronic assembly to the abrasive body, such as for at least 10 minutes to not greater than 30 minutes.

In another embodiment, attaching an electronic assembly to the abrasive body can include applying a bonding material over at least a portion of the abrasive assembly, at least a portion of an exterior surface of the abrasive body, or both. The bonding material can include a polymer, an inorganic material, a cement material, or any combination thereof. A particular example of the bonding material can include a cement material. The cement material can be organic or non-organic. A further example of a cement material can include an oxide, a silicate, such as calcium-based silicate, aluminum-based silicate, magnesium-based silicate, or any combination thereof. Another exemplary of the bonding material can include an adhesive, and in some particular instance, the adhesive can include epoxy. In a further embodiment, attaching an electronic assembly to the abrasive body can include curing the bonding material to form the abrasive article including the abrasive body coupled to the electronic assembly. In some instances, curing may be performed at a temperature of at least 15° C., and additionally or alternatively, curing may be performed at a temperature of not greater than 40° C., such as not greater than 35° C. or not greater than 30° C. or not greater than 25° C. Particularly, curing the cement material may be performed at a temperature from 20° C. to 40° C., such as at room temperature.

In an embodiment, the electronic assembly can be coupled to and in direct contact with at least a portion of the abrasive body. In some particular instances, the electronic assembly can bond to a portion of the abrasive body. For instance, the electronic assembly can bond to a component of the abrasive body, such as the bond material, the abrasive particles, an additive, or any combination thereof. In particular embodiments, the electronic assembly can be coupled to the abrasive body in a tamper-proof manner.

In another aspect, the process illustrated in FIG. 1B may also be used to combine an electronic assembly with a non-abrasive precursor body. The non-abrasive precursor body will form a non-abrasive portion of the finally-formed abrasive body, which will be a region of the abrasive article that is free of abrasive particles. The non-abrasive precursor body and a non-abrasive portion of the body may include a precursor bond material or bond material. In an alternative embodiment, the non-abrasive precursor body and a non-abrasive portion of the body may be free of a precursor bond material or bond material.

Figure 1C:
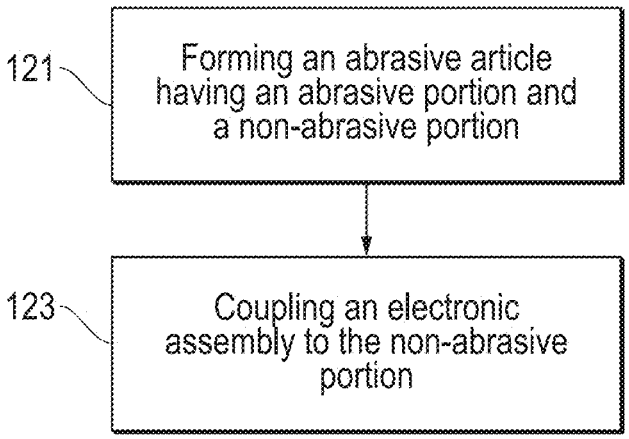
FIG. 1C includes a flow chart for forming an abrasive article according to an embodiment.

FIG. 1C includes a flow chart providing a process for forming an abrasive article having an electronic assembly coupled to a non-abrasive portion of the body of the abrasive article. The process can be initiated at step 121 by forming an abrasive article having an abrasive portion and non-abrasive portion. The abrasive portion includes abrasive particles. The abrasive portion may further include an abrasive surface having abrasive particles capable of conducting a material removal operation. The abrasive portion may include one or more bond materials configured to contain the abrasive particles or bond the abrasive particles to a nonabrasive portion. A non-abrasive portion can be free of abrasive particles. A non-abrasive portion may also be free of bond material. Still, in at least one embodiment the nonabrasive portion may comprise only bond material such that it consists essentially of bond material. An example of the non-abrasive portion can include a material including a fabric, a fiber, a film, a woven material, a non-woven material, a glass, a fiberglass, a ceramic, a polymer, a resin, a polymer, a fluorinated polymer, an epoxy resin, a polyester resin, a polyurethane, a polyester, a rubber, a polyimide, a polybenzimidazole, an aromatic polyamide, a modified phenolic resin, paper, or any combination thereof.

In a particular embodiment, the non-abrasive portion can include a reinforcement component, a layer of fabric, a layer including a woven or non-woven material, a layer including fiber, blotter paper, or the like, or any combination thereof. In another particular embodiment, the abrasive body can be a bonded body of a grinding wheel, a thin wheel, such as a cut-off wheel, a combination wheel, or an ultra-thin wheel. In more particular embodiments, the bonded body can include an organic bond material, and in even more particular embodiments, the bond material can consist essentially of an organic material. In a particular example of a thin wheel, the bonded body can include in the body, at least one abrasive portion and at least one non-abrasive portion that can be the same as or different from the non-abrasive portion attached to the surface of the bonded body. An example of the non-abrasive portion in the abrasive body can include a reinforcement component.

In certain instances, the non-abrasive portion may be integrally formed with the abrasive portion, such as a core or hub containing abrasive particles on at least a portion of the surface of the core or hub. The non-abrasive portion may be integrally bonded to the abrasive portion and facilitate mounting or coupling of the abrasive article with a tool. Any one or more suitable methods of joining the abrasive and non-abrasive portions may be used as known by those of skill in the art. Suitable examples can include, but is not limited to, pressing, sintering, curing, bonding, infiltrating, drying, heating, cooling, mechanical fastening, chemical bonding, welding, brazing, and the like.

The hub can be configured to facilitate mounting of the body to a tool. In certain instances, the non-abrasive portion may include a metal, and more particularly, may consist essentially of a metal or metal alloy including a transition metal element, aluminum or any combination thereof. In particular instances, the metal can include an element such as iron, copper, nickel, silver, aluminum, cobalt, or any combination thereof.

In another embodiment, the non-abrasive portion may include a material having a particular electrical conductivity, such as at least 10×103 Siemens/meter at 25° C. or at least 12×103 Siemens/meter at 25° C. or at least 15×103 Siemens/meter at 25° C. or at least 20×103 Siemens/meter at 25° C. or at least 30×103 Siemens/meter at 25° C. or at least 50×103 Siemens/meter at 25° C. or at least 100×103 Siemens/meter at 25° C. or at least 500×103 Siemens/meter at 25° C. or at least 1000×103 Siemens/meter at 25° C.

The process may further continue at step 123 by coupling electronic assembly to the non-abrasive portion of the abrasive article. Notably, unlike the processes described in the embodiments above, the process of FIG. 1C facilitates the coupling of an electronic assembly to a nonabrasive portion of an abrasive article. Coupling can include direct or indirect contact the abrasive and nonabrasive portion. Various orientations and placements of the electronic assembly is described in more detail in embodiments herein.

Figure 2A:
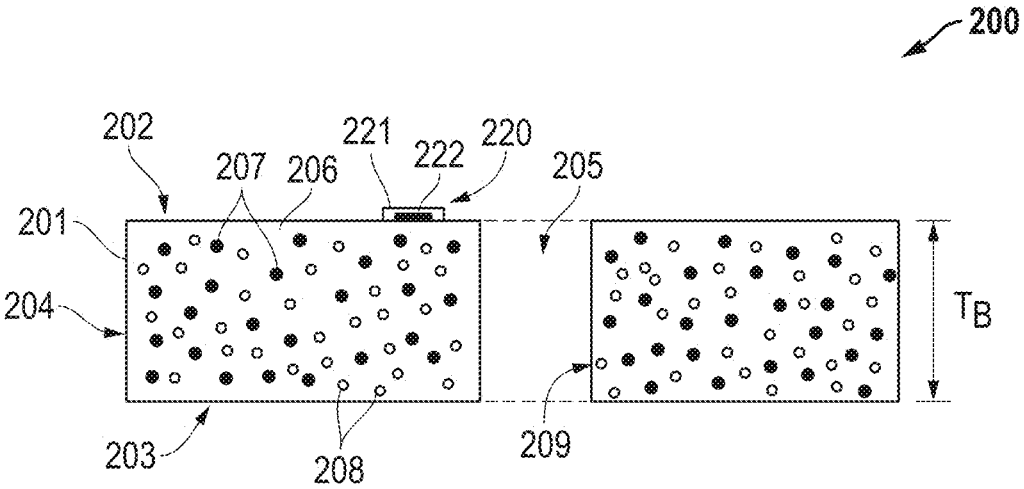
FIG. 2A includes a cross-sectional illustration of a portion of an abrasive article according to an embodiment.
Figure 2B:
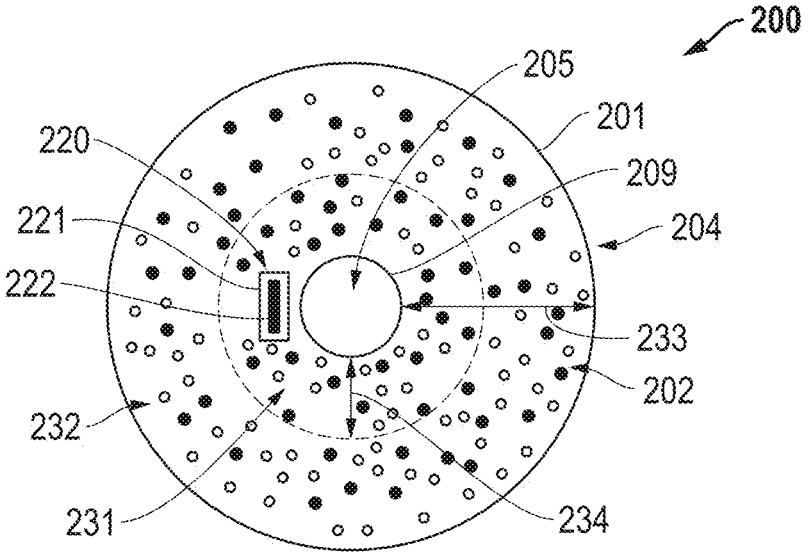
FIG. 2B includes a top-down illustration of the abrasive article of FIG. 2A according to an embodiment.

FIG. 2A includes a cross-sectional illustration of a portion of an abrasive article according to an embodiment. FIG. 2B includes a top-down illustration of the abrasive article of FIG. 2A according to an embodiment.

As illustrated in FIGS. 2A and 2B, the abrasive article 200 includes a bonded abrasive including a body 201, a first major surface 202, a second major surface 203 and a side or a peripheral surface extending between the first major surface 202 and second major surface 203. The body 201 can further include abrasive particles 207 contained in a bond material 206. The body 201 can further include optional porosity 208 that may be distributed throughout the body 201. The abrasive particles 207 can have any of the features of abrasive particles described in any of the embodiments herein.

In accordance with an embodiment, the bond material 206 can be an inorganic material, organic material, or any combination thereof. For example, suitable inorganic materials can include a metal, a metal alloy, a vitreous material, a monocrystalline material, a polycrystalline material, a glass, a ceramic, or any combination thereof. Suitable examples of organic materials can include, but is not limited to, thermoplastic materials, thermosets, elastomers, or any combination thereof. In a particular embodiment, the bond material 206 can include a resin, epoxy, or any combination thereof.

In accordance with an embodiment, the bond material 206 may have a particular forming temperature that is the same as the forming temperatures used to form the abrasive body as described in embodiments herein. For example, the bond material 206 may have a forming temperature of at least 25° C., such as at least 40° C. or at least 60° C. or at least 80° C. or at least 100° C. or at least 150° C. or at least 200° C. or at least 300° C. or at least 400° C. or at least 500° C. or at least 600° C. or at least 700° C. or at least 800° C. or at least 900° C. or at least 1000° C. or at least 1100° C. or at least 1200° C. or at least 1300° C. Still, in one non-limiting embodiment, the forming temperature can be not greater than 1500° C. or not greater than 1400° C. or not greater than 1300° C. or not greater than 1200° C. or not greater than 1100° C. or not greater than 1000° C. or not greater than 900° C. or not greater than 800° C. or not greater than 700° C. or not greater than 600° C. or not greater than 500° C. or not greater than 400° C. or not greater than 300° C. or not greater than 200° C. or not greater than 100° C. or not greater than 80° C. or not greater than 60° C. It will be appreciated that the forming temperature of the bond material 206 can be within a range including any of the minimum and maximum values noted above.

As noted herein, the body 201 can include porosity 208 contained within the body. For example, the body 201 may include closed prosody, open porosity, or any combination thereof. Closed pores are generally discrete and separate pores contained within the bond material 206. In contrast, open porosity can define interconnected channels extending through the body 201. In one particular embodiment, the abrasive body may have a content of porosity 208 within a range of at least 0.5 vol % to not greater than 95 vol % for a total volume of the body 201.

According to one embodiment, the abrasive article 200 can include an electronic assembly 220 attached to an exterior surface of the body 201, such as the first major surface 202. In one embodiment, the electronic assembly 220 can include at least one electronic device 222 that may be contained within a package 221. The package 221 may be suitable for attaching the electronic assembly 220 to the body 201, and may provide some suitable protection of the one or more electronic devices contained therein. In particular examples, the electronic device 222 can be encapsulated within the package 221.

According to one embodiment, the electronic device 222 can be configured to be written-to with information, store information, or provide information to other objects during a read operation. Such information may be relevant to the manufacturing of the abrasive article, operation of the abrasive article or conditions encountered by the electronic assembly 220. Reference herein to the electronic device will be understood to be reference to at least one electronic device, which can include one or more electronic devices. In at least one embodiment, the electronic device 222 can include at least one device selected from the group including an integrated circuit and chip, data transponder, a radio frequency based tag or sensor with or without chip, an electronic tag, electronic memory, a sensor, an analog to digital converter, a transmitter, a receiver, a transceiver, a modulator circuit, a multiplexer, an antenna, a near-field communication device, a power source, a display (e.g., LCD or OLED screen), optical devices (e.g., LEDs), global positioning system (GPS) or device, or any combination thereof. In some instances, the electronic device may optionally include a substrate, a power source, or both. In one particular embodiment, the electronic device 222 can include a tag, such as a passive radio frequency identification (RFID) tag. In another embodiment, the electronic device 222 can include an active radio frequency identification (RFID) tag. An active RFID tag can include a power supply, such as a batter or inductive capacitive (LC) tank circuit. In a further embodiment, the electronic device 222 can be wired or wireless.

According to one aspect, the electronic device 222 can include a sensor. The sensor may be selectively operated by any system and/or individual within the supply chain. For example, the sensor can be configured to sense one or more processing conditions during the formation of the abrasive article. In another embodiment, the sensor may be configured to sense a condition during use of the abrasive article. In yet another embodiment, the sensor can be configured to sense a condition in the environment of the abrasive article. The sensor can include an acoustic sensor (e.g., ultrasound sensor), force sensor, vibration sensor, temperature sensor, moisture sensor, pressure sensor, gas sensor, timer, accelerometer, gyroscope, or any combination thereof. The sensor can be configured to alert any system and/or individual associated with the abrasive article, such as a manufacturer and/or customer to a particular condition sensed by the sensor. The sensor may be configured to generate an alarm signal to one or more systems and/or individuals in the supply chain, including but not limited to, manufacturers, distributors, customers, users, or any combination thereof.

In another embodiment, the electronic device 222 may include a near-field communication device. A near field communication device can be any device capable of transmitting information via electromagnetic radiation within a certain defined radius of the device, typically less than 20 meters. The near-field communication device can be coupled to one or more electronic devices, including for example a sensor. In one particular embodiment, a sensor can be coupled to the near-field communication device and configured to relay information to one or systems and/or individuals in the supply chain via the near-field communication device.

In an alternative embodiment, the electronic device 222 can include a transceiver. A transceiver can be a device that can receive information and/or transmit information. Unlike passive RFID tags or passive near-field communication devices, which are generally read-only devices that store information for a read operation, a transceiver can actively transmit information without having to conduct an active read operation. Moreover, the transceiver may be capable of transmitting information over various select frequencies, which may improve the communication capabilities of the electronic assembly with a variety of systems and/or individuals in the supply chain.

In another embodiment, the electronic assembly 220 can include a flexible electronic device. For instance, the electronic device can have a certain bend radius, such as not greater than 13 times the thickness of the electronic device, not greater than 12 times the thickness of the electronic device, not greater than 10 times the thickness of the electronic device, not greater than 9 times the thickness of the electronic device, not greater than 8 times the thickness of the electronic device, not greater than 7 times the thickness of the electronic device, not greater than 6 times the thickness of the electronic device, not greater than 5 times the thickness of the electronic device. Alternatively, or additionally, the electronic device can have a bend radius at least half the thickness of the electronic device, or at least the thickness the electronic device. It is to be understood the flexible electronic device can have a bend radius within a range including any of the minimum and maximum values noted herein. As used herein, bend radius is measured to the inside curvature and is the minimum radius that the electronic device can be bent without being damaged. In an embodiment, bend radius may be affected by the structure of the flexible electronics. For example, a single-layered flexible electronic device may have a bending radius not greater than 5 times its thickness, while a flexible electronic device having a plurality of layers may have bending radius not greater than 12 times its thickness.

In an aspect, the flexible electronic device can include a substrate, wherein the substrate can include a flexible material. In another aspect, the flexible electronic device can include a flexible substrate. For instance, the substrate can include an organic material, such as a polymer. In another example, the substrate can include a flexible conductive material, such as conductive polyester. In a particular example, the substrate can consist essentially of an organic material, and in more particular examples, the substrate can consist essentially of a polymer. A particular example of a polymer can include a plastic material, including for example, but not limited to a polyimide, a polyether ether ketone (PEEK), a fluoropolymer, or a combination thereof. Another example of the substrate can include a Pyralux® material. In some even more particular examples, the substrate can consist essentially of at least one of the materials noted herein. In another embodiment, the substrate can include a flexible thin silicon layer or monocrystalline silicon.

In a further example, the substrate can include at least one layer. In a further aspect, the flexible electronic device can include a printed circuit. In another aspect, the electronic device can include a plurality of layers. In a particular aspect, the flexible electronic device can include a substrate that consists essentially of one layer. In a more particular aspect, the flexible electronic device can be a singled-layered electronic device.

In a particular embodiment, the flexible electronic device can have a thickness of not greater than 1 mm, such as not greater than 0.80 mm, not greater than 0.60 mm, not greater than 0.50 mm, not greater than 0.40 mm, not greater than 0.30 mm, not greater than 0.20 mm, not greater than 0.15 mm, or not greater than 0.12 mm, or not greater than 0.10 mm. Alternatively, or additionally, the flexible electronic device can have a thickness of at least 0.06 mm, such as at least 0.08 mm, at least 0.10 mm, at least 0.12 mm, at least 0.15 mm, or at least 0.20 mm. Moreover, the flexible electronic device can have a thickness including any of the minimum and maximum values noted herein.

In an embodiment, the electronic assembly 220 can include a flexible printed circuit. In an example, the flexible printed circuit can be contained within the package 221, as illustrated in FIGS. 2A and 2B. In particular instances, the flexible printed circuit can be encapsulated in the package. The flexible electronic device, such as flexible printed circuit (FPC), disclosed in embodiments herein is considered distinct from printed circuit board (PCB) at least due to architecture characteristics. Such characteristics can allow particular placement and orientation to be implemented for coupling the electronic assembly to the abrasive body. For instance, such characteristics can allow the electronic assembly to be coupled in tamper-proof manner.

In an embodiment, a flexible electronic device described in embodiments herein may be particularly suited for abrasive articles including coated abrasives, non-woven abrasives, thin wheels, or the like. In some situations, coupling a single-layered flexible electronics to a coated or non-woven abrasive may not cause detectable or noticeable changes to thickness, flexibility, or other performance of the abrasive. In certain situations, utilizing a flexible electronics can help to prevent issues, such as imbalance of wheels, that can be caused by uneven weight distribution due to coupling of an electronic assembly to the wheels.

In an embodiment, the electronic device can have a certain communication range while the electronic assembly is coupled to the abrasive body. As used herein, the communication range can be determined using the near field or far field method as applicable and according to ISO/IEC 18000 (125 Khz-5.8 Ghz), or related standards such as ISO/IEC 15693, ISO/IEC 14443, EPC Global Gen2, or ISO/IEC 24753. The applicable standard is selected based on the radio frequency of the electronic device. An abrasive article can be placed in a 3-axis turntable, and a transmitting or receiving antenna can be arranged such that communication ranges in different orientations can be tested.

In an embodiment, the electronic device can have a communication range of at least 1.0 meter, at least 1.5 meters, at least 2.0 meters, at least 2.5 meters, at least 3.0 meters, at least 3.5 meters, at least 4.0 meters, at least 4.5 meters, at least 5.0 meters, at least 5.5 meters, at least 6.0 meters, at least 6.5 meters, at least 7.0 meters, at least 7.5 meters, at least 8.0 meters, at least 8.5 meters, at least 9.0 meters, at least 9.5 meters, at least 10 meters, at least 11 meters, at least 12 meters, at least 13 meters, at least 14 meters, at least 15 meters, at least 16 meters, at least 17 meters, at least 18 meters, at least 19 meters, or at least 20 meters. Additionally or alternatively, the electronic device may have a communication range of not greater than 20 meters, not greater than 19 meters, not greater than 18 meters, not greater than 17 meters, not greater than 16 meters, not greater than 15 meters, not greater than 14 meters, not greater than 13 meters, not greater than 12 meters, not greater than 11 meters, not greater than 10 meters, not greater than 9.0 meters, not greater than 8.5 meters, not greater than 8.0 meters, not greater than 7.5 meters, not greater than 7.0 meters, not greater than 6.5 meters, not greater than 6.0 meters, not greater than 5.5 meters, not greater than 5.0 meters, not greater than 4.5 meters, not greater than 4.0 meters, not greater than 3.5 meters, not greater than 3.0 meters, not greater than 2.5 meters, or not greater than 2.0 meters. Moreover, the communication range of the electronic device can be in a range including any of the minimum and maximum values noted herein.

In another embodiment, the abrasive article can include certain electronic devices, such as an active RFID, that have higher communication ranges. In some instances, the communication range can be at least 100 meters, at least 200 meters, at least 400 meters, at least 500 meters, or at least 700 meters. In another instance, the communication range may be not greater than 1000 meters, such as not greater than 800 meters, or not greater than 700 meters. It is to be understood that the communication range can be in a range including any of the minimum and maximum values noted herein.

In another embodiment, the abrasive article can include an electronic device having a communication range of not greater than 35 mm, not greater than 30 mm, or not greater than 25 mm. Additionally, or alternatively, the electronic device can have a communication range of at least 10 mm, at least 15 mm, at least 20 mm, or at least 25 mm. Moreover, the communication range of the electronic device can be in a range including any of the minimum and maximum values noted herein. After reading the present disclosure, a skilled artisan would understand that the communication range can be affected by factors, such as the nature of the electronic device, the configuration and materials of the electronic assembly, the manner of coupling, the composition and type of the abrasive article, or any combination thereof. A skilled artisan would also understand that the choice for any or all factors can be made and combined for forming an abrasive article that can suit particular applications.

According to one embodiment, the package 221 can include a thermal barrier material. For example a thermal barrier material can include material from the group of materials including, but not limited to, thermoplastic polymers (e.g., polycarbonates, polyacrylates, polyamides, polyimides, polysulphones, polyketones, polybenzimidizoles, polyesters), blends of thermoplastic polymers, thermoset polymers (e.g., epoxies, cyanoesters, phenol formaldehyde, polyurethanes, polyamides, polyimides, cross-linkable unsaturated polyesters) blends of thermoset polymers, ceramics, cermets, metals, metal alloys, glass, or any combination thereof. In accordance with one particular embodiment, the package 221 can include a thermal barrier material suitable for surviving one or more processes, including the forming temperature used to form the finally form abrasive article.

In accordance with another embodiment, thermal barrier material of the package 221 can have a particular thermal conductivity which may be suitable for protecting the one or more electronic devices contained therein. For example the thermal barrier package may have a thermal conductivity of at least 0.33 W/m/K, such as at least about 0.40 W/m/K, such as at least 0.50 W/m/K or at least 1 W/m/K or at least 2 W/m/K or at least 5 W/m/K or at least 10 W/m/K or at least 20 W/m/K or at least 50 W/m/K or at least 80 W/m/K or at least 100 W/m/K or at least 120 W/m/K or at least 150 W/m/K or at least 180 W/m/K. In still another non-limiting embodiment, the thermal barrier material can have a thermal conductivity that is not greater than 200 W/m/K, such as not greater than 180 W/m/K or not greater than 150 W/m/K or not greater than 120 W/m/K or not greater than 100 W/m/K or not greater than 80 W/m/K or not greater than 60 W/m/K or not greater than 40 W/m/K or not and 20 W/m/K or not greater than 10 W/m/K. It will be appreciated that the thermal barrier material can have a thermal conductivity within a range including any of the minimum and maximum values noted above, including for example within a range of at least 0.33 W/m/K to not greater than 200 W/m/K.

According to one embodiment, the package 221 can include a thermal barrier material that encapsulates some volume of space between the thermal barrier material and the electronic device contained therein. In one embodiment, the volume of space may include a particular gaseous material that may be suitable for survival of the electronic device through one or more manufacturing processes and/or improved performance of the electronic assembly. Some suitable examples of the gaseous materials can include noble gases, nitrogen, air, oxygen, or any combination thereof.

In another embodiment, the volume of space may have a particular pressure that may facilitate survival of the electronic device during one or more manufacturing processes and/or improved performance of the electronic assembly. For example, in one embodiment, the pressure within the electronic assembly can be less than atmospheric pressure. In still another embodiment, the pressure within the electronic assembly can be greater than atmospheric pressure. In still another embodiment, at least a portion of the volume of space can be filled with a liquid material, which may facilitate survival of the electronic device during one or more manufacturing operations and/or improved performance of the electronic assembly. The gaseous material or liquid material may have particularly suitable thermal conductivity to limit thermal damage to the electronic device.

In yet another aspect the package 221 can include one or more materials having a particular water vapor transmission rate to reduce or eliminate water and water vapor being transferred from the exterior of the package 222 the interior. Such a package may be suitable to reduce or eliminate damage to the one or more electronic devices 222 contained within the electronic assembly 220. In accordance with an embodiment, the package 221 can include a material having a water vapor transmission rate. In an embodiment, the barrier layer can prevent or reduce water vapor transmission into the bonded abrasive body, compared to a conventional abrasive tool. In a non-limiting embodiment, the package 221 and/or one or more materials comprising the package 221, can have a water vapor transmission rate (WVTR), as measured according to ASTM F1249-01 (Standard Test Method for Water Vapor Transmission Rate Through Plastic Film and Sheeting Using a Modulated Infrared Sensor), of not greater than about 2.0 $g/m^2$-day (i.e., grams per square meter, per 24 hours), such as not greater than about 1.5 $g/m^2$-day, such as not greater than about 1 $g/m^2$-day or not greater than about 0.1 $g/m^2$-day or not greater than about 0.015 $g/m^2$-day or not greater than about 0.010 $g/m^2$-day or not greater than about 0.005 $g/m^2$-day or not greater than about 0.001 $g/m^2$-day or even not greater than about 0.0005 $g/m^2$-day. In another non-limiting embodiment, the WVTR of the one or more materials of the package 2221, and thus the package 221, can be greater than 0 $g/m^2$-day, such as at least 0.00001 $g/m^2$-day. It will be appreciated that the WVTR can be within a range including any of the minimum and maximum values noted herein. For instance, the WVTR may be within a range including greater than 0 $g/m^2$-day and not greater than 2.0 $g/m^2$-day, such as within a range including at least 0.00001 $g/m^2$-day and not greater than 2.0 $g/m^2$-day.

In another aspect, the electronic device 222 may be configured to transmit information via one or more electromagnetic radiation wavelengths. Accordingly, the package to 221 can be substantially transparent or transmissive to the frequencies or wavelengths of electromagnetic radiation used by the electronic device 222 to receive and/or transmit information. For example, the package 221 can include one or more materials that are transparent to electromagnetic radiation in the radio frequency spectrum, such as electromagnetic radiation having a frequency of 3 kHz to 300 GHz and an approximate wavelength within a range of 1 mm to 100 km. Some suitable examples of such materials can include non-metallic materials, such as glasses, ceramic, thermoplastics, elastomers, thermosets, and the like.

As noted in embodiments herein, the electronic device 222 can be configured to communicate with one or more systems and/or individuals. In particular instances, the electronic device 222 can be configured to communicate with a mobile device. A mobile device will be understood as an electronic device intended for personal use and configured to be carried on or used by an individual.

In accordance with one embodiment, the electronic device 222 can include a read-only device. In an alternative embodiment, the electronic device 222 can be a read-write device. It will be understood that a read-only device is a device that can store information, which can be read by a system and/or individual in an active read operation. An active read operation includes any action by a system and/or individual to access the information stored on the electronic device 222. A read-only device cannot be written to in an active write operation to store information. By contrast a read-write device can be an electronic device wherein information can be read from the device in an active read operation or information can be stored to the electronic device by one or more systems and/or individuals in an active writing operation. Some suitable examples of information that can be stored on the electronic device 222 can include manufacturing information and/or customer information. According to one embodiment, manufacturing information can include, but is not limited to, processing information, manufacturing date, shipment information, or any combination thereof. In accordance with another embodiment, customer information can include, but is not limited to, registration information, product identification information, product cost information, manufacturing date, shipment date, environmental information, use information, or any combination thereof. The customer registration information may include certain information such as an account number of the customer. Environmental information may include details regarding the age or general information about the conditions encountered by the abrasive article (e.g., water vapor, temperature, etc.) during shipment, storage or use. Use information can include details regarding the conditions for use of the wheel, including for example, but not limited to the appropriate wheel speed, force, power of the machine to be used, burst speed, and the like.

In a further embodiment, the package 221 can include a protective layer that can help the electronic device survive one or more forming process, environmental conditions, or grinding operations, or facilitate bonding of the electronic assembly to the abrasive body. For instance, the protective layer may facilitate improved resistance against moisture or humidity of the electronic assembly. In another instance, the protective layer can facilitate improved mechanical integrity, resistance against certain pressure or chemical corrosion, or improved electrical insulation, or improved thermal resistance in some instances. In an aspect, the protective layer can overlie at least a portion of the electronic device. In an aspect, the protective layer can be in contact with the electronic device. In a further aspect, the protective layer may be spaced apart from the abrasive body. In another embodiment, the protective layer can be in contact with at least a portion of the abrasive body. In still another embodiment, the protective layer can encapsulate the electronic device.

Figure 2C:
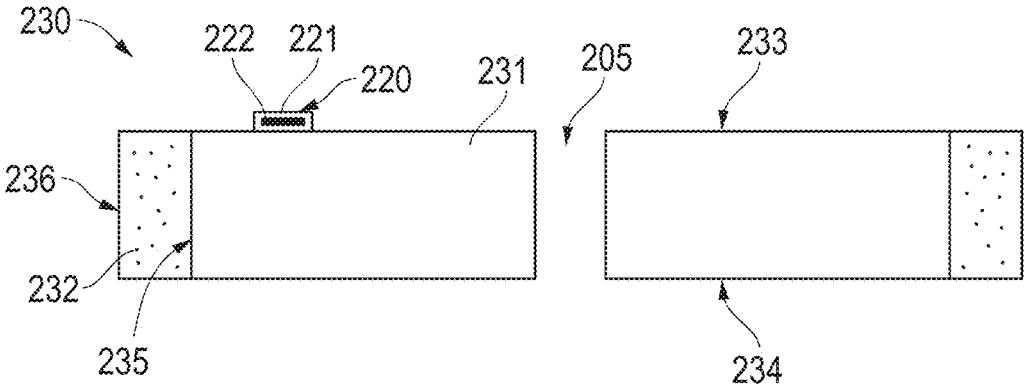
FIG. 2C includes a cross-sectional illustration of a portion of an abrasive article according to an embodiment.

FIG. 2C includes a cross-sectional illustration of an abrasive article according to an embodiment. For all embodiments herein, the electronic assembly may be coupled to, partially contained within, or completely embedded within, an abrasive portion and/or non-abrasive portion.

In the embodiment of FIG. 2C, the abrasive article 200 includes an abrasive portion 232 and a non-abrasive portion 231, and an electronic assembly 220 coupled to the non-abrasive portion 231 of an abrasive article 200. The non-abrasive portion 231 can have a first surface 233, a second surface 234, and a side surface 235 extending between the first surface 233 and second surface 234. The first and second surfaces 233 and 234 may be major planar surfaces. The second surface 234 may be a major planar surface of the same size or different size relative to the first surface 233. As further illustrated, the non-abrasive portion 231 may include an opening 205, such as an arbor hole. The electronic assembly 220 can be coupled to the first surface 233. The electronic assembly may include an electronic device 222 and package 221 as described in embodiments herein.

Figure 2D:
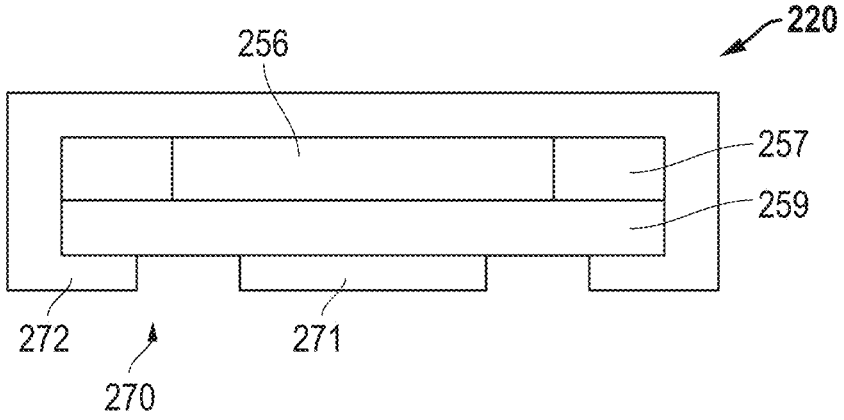
FIGS. 2D-2J include cross-sectional illustrations of portions of an electronic assemblies according to embodiments.
Figure 2E:
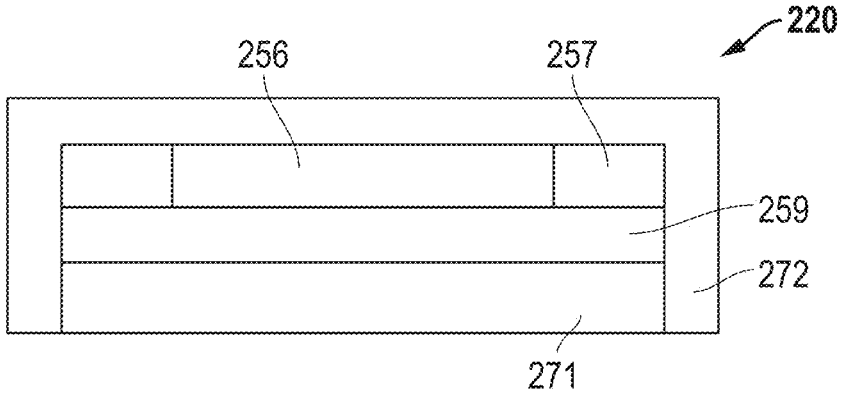
Figure 2F:
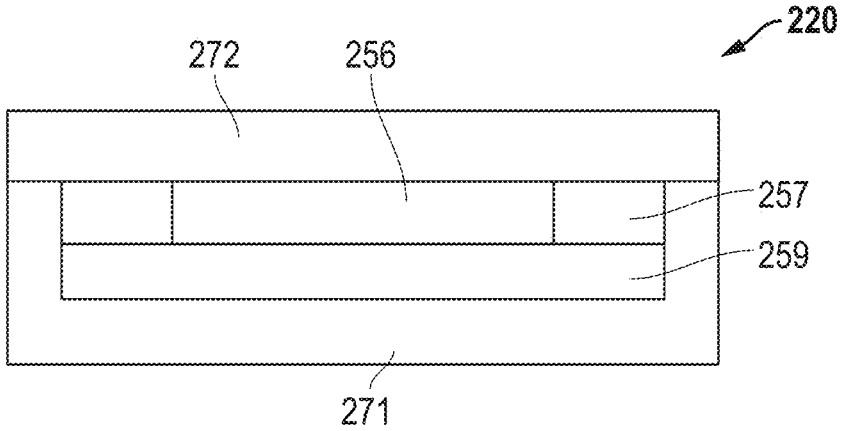
Figure 2G:
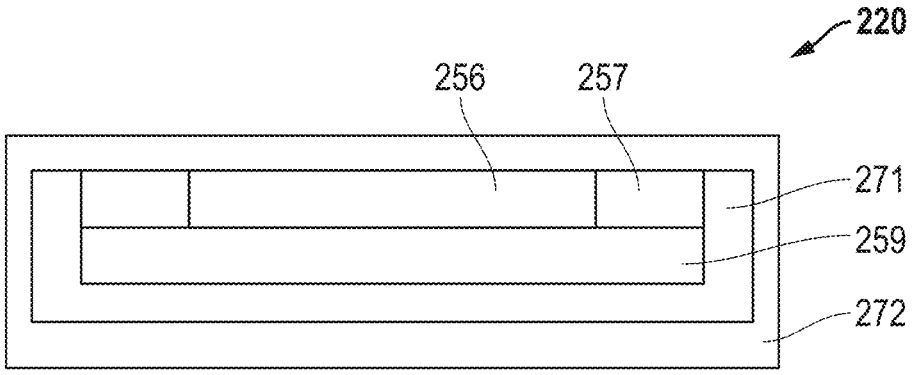
Figure 2H:
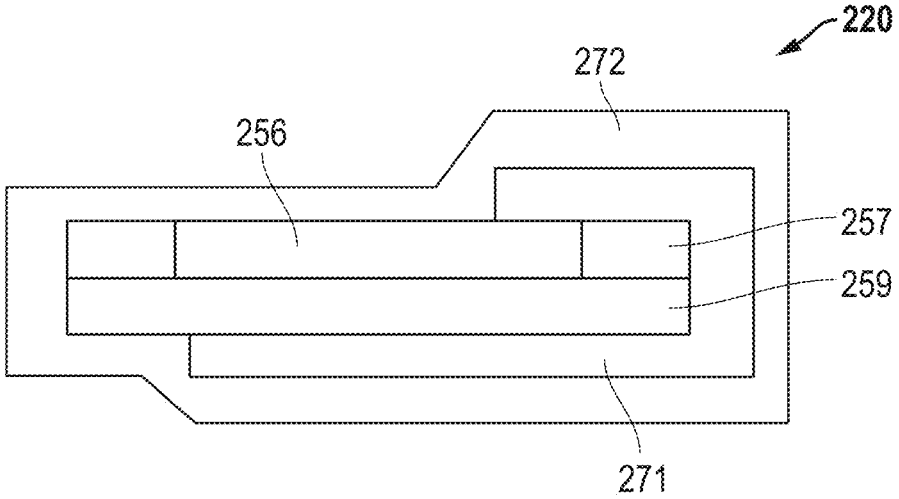

In accordance with one aspect, as illustrated in FIG. 2D, the electronic assembly 220 may include one or more electronic devices, including for example electronic device 256 and electronic device 257. In certain instances, the electronic assembly 220 may include a substrate 259 upon which the one or more electronic devices 256 and 257 can be disposed. In yet other instances, the electronic assembly 220 may further include a first portion 271 and a second portion 272. The first portion 271 and second portion 272 may be part of a package 270 that may overlie at least a portion of the electronic assembly 220. The package 270 may consist essentially of the first and second portions 271 and 272. The package 270 may partially surround at least a portion of the one or more electronic devices 256 and 257. In one particular embodiment, the package 270 may completely surround at least a portion, or even all of, the one or more electronic devices 256 and 257. It is to be understood that the electronic devices 256 and 257 can include any electronic devices noted in embodiments herein.

FIGS. 2D-2J, include cross-sectional illustrations of various arrangements of the first and second portions 271 and 272 with respect to each other, the one or more electronic devices 256 and 257, and the substrate 259. FIGS. 2D-2J provide illustrations of electronic assemblies having different arrangements of the first and second portions 271 and 272. Those of skill in the art will appreciate that other possible arrangements are possible.

For example, as illustrated in FIGS. 2D-2J the first portion 271 can be underlying the substrate 259 and one or more electronic devices 256 and 257. In certain instances, the first portion 271 can be coupled to, such as directly contacting, the second portion 272. In still another embodiment, electronic assembly 220 may include a first portion 271 that is underlying and partially enveloping at least a portion of the substrate 259 and the one or more electronic devices 256 and 257. The second portion 272 can be overlying at least a portion of the one or more electronic devices 256 and 257. The second portion 272 may be indirectly coupled or directly coupled (e.g., directly contacting or bonded to) the first portion 271. As illustrated, the first portion and second portion 272 can substantially surround the entire one or more electronic devices 256 and 257 as well as substrate 259.

Figure 2I:
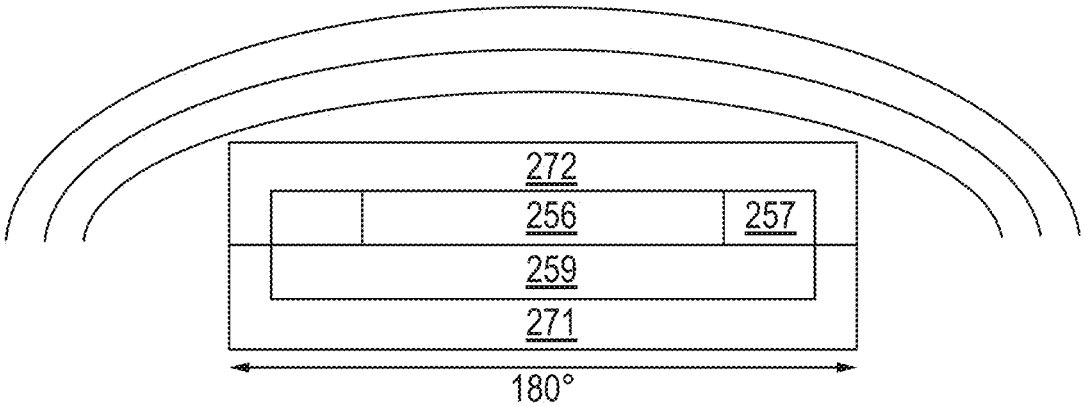

FIG. 2I includes an illustration of an electronic assembly 220 having a first portion 271, a second portion 270, a substrate 259, and one or more electronic devices 256 and 257. In particular, the embodiment of FIG. 2J demonstrates a 180° wireless communication hemisphere for all signals emitted from the one or more electronic devices 256 and 257. Notably, the second portion 272 may be significantly transparent to the RF radiation, whereas the first portion 271 may have a significantly lower RF transmission value as compared to the second portion 272. RF electromagnetic radiation may be transmitted freely through the second portion 272.

Figure 2J:
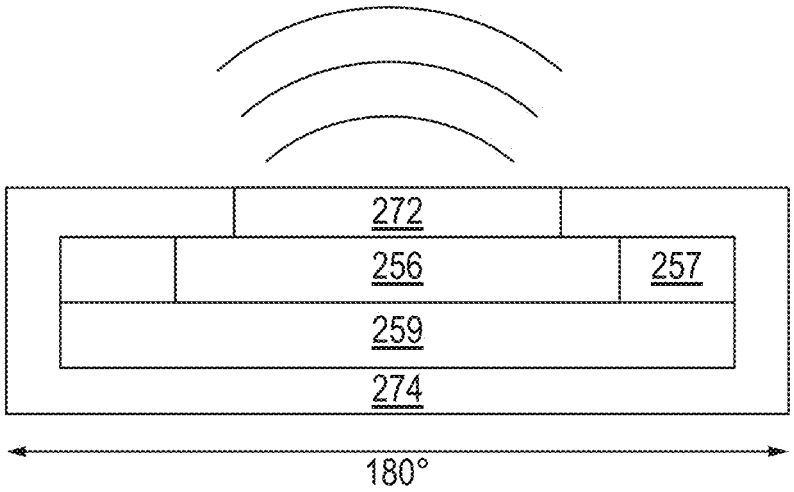

FIG. 2J includes an alternative illustration an electronic assembly 220 including a first portion 271 and a second portion 272. The first portion 271 may substantially envelop the one or more electronic devices 256 and 257 such that any RF frequency electromagnetic radiation emitted from the one of more electronic devices 256 and 257 is transmitted only through the second portion 272. In such instances, the second portion 272 may define a transmission window in the package 270 of the electronic assembly 220 that may facilitate directional control of the transmitted radiation and thus the transmitted data.

Figure 2K:
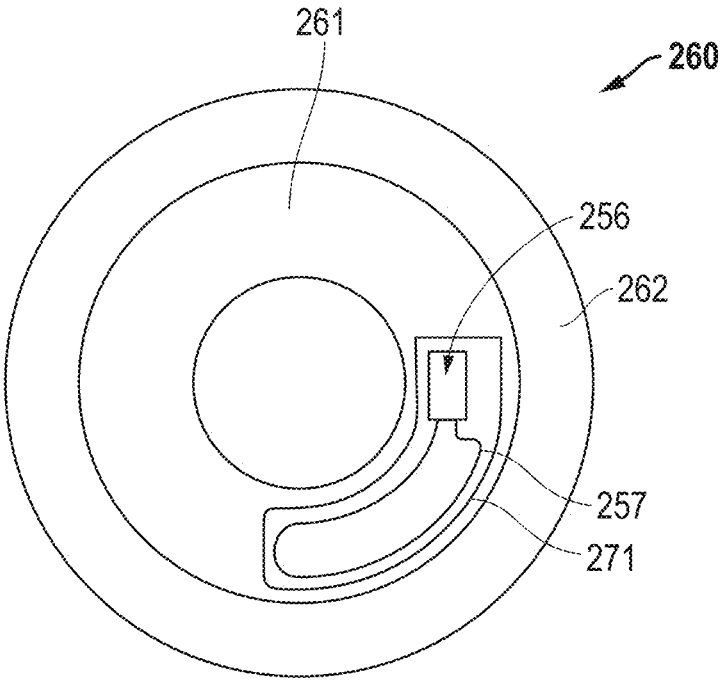
FIG. 2K includes a top-down illustration of a portion of an abrasive article according to an embodiment.

FIG. 2K is a top-down view of an abrasive article according to an embodiment. The embodiment includes an abrasive article 260 including a body having a non-abrasive portion 261 and an abrasive portion 262. The body further includes an electronic assembly including an antenna 257, which may be a secondary antenna apart from an antenna contained on one or more other electronic device, such as an on chip antenna. In one embodiment, the antenna 257 can be a booster antenna configured to expand the wireless transmission range and accuracy of one or more electronic devices to which is coupled. A first portion 271 can underlie at least a portion, such as at least 50% of the electronic device 257. The first portion 271 can electrically insulate and isolate the antenna 257 from the non-abrasive portion 261 to which it is coupled. In particular instances, the first portion 271 can be disposed between and electrically insulating at least one of the at least one or more electronic devices 256 and 257 from the body of the abrasive article. More particularly, the electronic devices 256 and/or 257 may include at least one antenna, and the first portion 271 can be disposed between and electrically insulating the antenna from the body of the abrasive article.

In certain instances, the one or more electronic devices 256 and 257 may have a footprint surface area. The footprint surface area may be the surface area of the one or more electronic devices 256 at 257 as viewed top-down. In particular instances, the footprint surface area of the at least one or more electronic devices 256 and 257 may be defined as that portion of the surface area taken up by the device on the substrate 259 or on the body 301 to which the electronic assembly is attached. In particular instances, the first portion 271 may be underlying at least 10% of the footprint surface area of any one or all of the one or more electronic devices 256 and/or 257, such as at least 20% or at least 30% or at least 40% or at least 50% or at least 60% or at least 70% or at least 80% or at least 90% or at least 100%. In another embodiment, the first portion 271 may be partially enveloping at least a portion of the one or more electronic devices 256 and 257. In such instances, a bottom surface of the one or more electronic devices 256 and 257, such as the surface in contact with the substrate to 59 may be below an upper surface of the first portion 252 71 is viewed in cross-section.

In other embodiments, the first portion 271 may be surrounding a particular percentage of the total surface area of the one or more electronic devices 256 and 257 is viewed in cross-section. For example, the first portion 271 may be surrounded at least 10% of the total surface area of the one or more electronic devices 256 and 257, such as at least 20% or at least 30% or at least 40% or at least 50% or at least 60% or at least 70% or at least 80% or at least 90%.

Figure 2L:
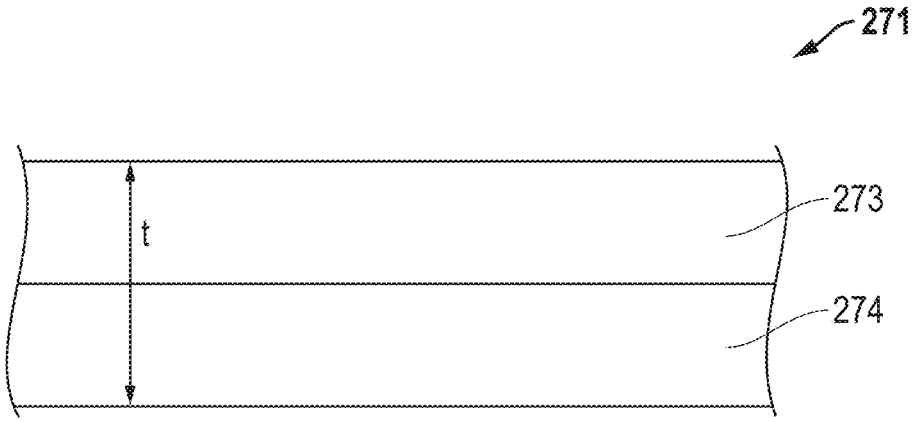
FIG. 2L includes a cross-sectional illustration of a first portion according to an embodiment.

The first portion 271 or the second portion 272 may be made of more than one layer of material (i.e., multi-layered articles). FIG. 2L includes a cross-sectional illustration of a first portion 271 having a first layer 273 and a second layer 274. The composition, position, and characteristics of the first layer 273 and second layer 274 can have any of the characteristics of the first and second portions 271 and 272 of any one or more of the embodiments herein.

In certain instances, second portion 272 may act as a protective layer. In some instances, the substrate can serve as a protective layer or facilitate bonding of the electronic assembly to a body to obviate the use of a protective layer that is disposed underlying the substrate. In another instance, the protective layer may be disposed to underlie the electronic device, and an upper surface and side surfaces of the electronic devices 257 or 256 may not be covered by the protective layer. In a further embodiment, the electronic assembly 220 can include an extra protection layer that is disposed over and/or under the second portion for additional protection. The second portion 272 can act as a protective layer to limit impact of coolant and swarf on the electronic assembly. In other instances, the protective layer may protect the electronic devices from mechanical damage or chemical damage during re-profiling, dressing, maintenance of the abrasive portion or non-abrasive portion, and the like.

In an embodiment, a protective layer can include an organic material, an inorganic material, or any combination thereof. In some instances, a protective layer can include parylene, silicone, acrylic, an epoxy based resin, ceramics, metal, such as an alloy (e.g., stainless steel), polycarbonate (PC), polyvinyl chloride (PVC), polyimide, polyvinyl butyral (PVB), polyurethane (PU), polytetrafluoroethylene (PTFE), a high performance polymer, such as polyester, polyurethane, polypropylene, polyimides, polysulfone (PSU), polyethersulfone (PES), polyetherimide (PEI), poly (phenylene sulfide) (PPS), polyetheretherketone (PEEK), polyether ketones (PEK), aromatic polymers, poly(p-phenylene), ethylene propylene rubber and/or cross-linked polyethylene, or a fluoropolymer such as PTFE. In some instances, the protective layer can include the same metal as an antenna contained in the electronic assembly. In some examples, the protective layer can be in the form of a coating, such as a polymer coating, e.g., epoxy-based resin coating, a ceramic coating, or a ceramic coated layer. In another instance, the protective layer may be in the form of a tape, such as a Teflon® tape, a PET tape, or a polyimide film with an adhesive on one side, such as Kapton® tape.

In some instances, the protective layer can include at least one opening to allow a sensing element to be exposed for the sensing element to perform its function, such as sensing environmental conditions the abrasive article is exposed to, e.g., temperature or humidity.

In a further embodiment, the protective layer can include a hydrophobic layer to help to protect the electronic device from potential damage caused by certain fluid, such as coolant or slurries used in some operations. An exemplary hydrophobic layer can include a material including manganese oxide polystyrene ($MnO_2$/PS) nano-composite, zinc oxide polystyrene (ZnO/PS) nano-composite, calcium carbonate (e.g., precipitated calcium carbonate), carbon nanotubes, silica nano-coating, fluorinated silanes, fluoropolymer, or any combination thereof. In an exemplary forming process, a hydrophobic layer can be formed by preparing and applying a gel-based or aerosol based solutions including any of the materials noted herein to the electronic device or over a protection layer.

In a further embodiment, the protective layer can include an autoclavable material that can help the electronic assembly survive an autoclave operation and facilitate bonding of the electronic assembly to the abrasive body. In some instances, the autoclavable material can also facilitate improved environmental resistance and electrical integrity of the electronic assembly. An exemplary material can include poly vinyl butyral (PVB), polycarbonate (PC), acoustic PVB, thermal control PVB, ethylene vinyl acetate (EVA), thermoplastic polyurethane (TPU), ionomer, a thermoplastic material, polybutylene terephthalate (PBT), polyethylenevinylacetate (PET), polyethylene naphthalate (PEN), polyvinyl chloride (PVC), polyvinyl fluorides (PVf), polyacrylate (PA), polymethyl methacrylate (PMMA), polyurethane (PUR), or combinations thereof.

In an embodiment, the package can include any of the protection layer, thermal barrier, pressure barrier, as noted in embodiments herein, or any combination thereof. Any of the component layer of the package can be formed by extrusion, printing, spraying on, coating or the like. The package including a plurality of layers can be formed by adhesion, lamination, coating, printing, or the like. In particular embodiments, treatment, such as heating, curing, pressing, or any combination thereof, can be performed to form a component layer or the package. For instance, a precursor material may be used and cured to form a protection layer.

In accordance with aspects herein the electronic assembly 220 may include a first portion 271 and a second portion 272. The first and second portions 271 and 272 may be part of the electronic assembly, and may form at least a portion of the packaging 270 surrounding one or more portions of the electronic assembly 220, including the one or more electronic devices 256 and 257. In certain instances, the first portion 271 can be disposed between the body 301 and the one or more electronic devices may have a particular magnetic permeability. It is noted in certain instances, a certain magnetic permeability of the first portion or a material of the first portion may be suitable to enhance the performance of the electronic assembly in real-world material removal operations. For example, in one embodiment the first portion 271 may have a material having a magnetic permeability of not greater than 15, such as not greater than 14.5 or not greater than 14 or not greater than 13.5 or not greater than 13 or not greater than 12.5 or not greater than 12 or not greater than 11.5 or not greater than 11 or not greater than 10.5 or not greater than 10 or not greater than 9.5 or not greater than 9 or not greater than 8.5 or not greater than 8 or not greater than 7.5 or not greater than 7 or not greater than 6.5 or not greater than 6 or not greater than 5.5 or not greater than 5 or not greater than 4.5 or not greater than 4 or not greater than 3.5 or not greater than 3 or not greater than 2.5 or not greater than 2 or not greater than 1.5 or not greater than 1.25. In another non-limiting embodiment, the relative magnetic permeability can be at least 1 or at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10. The relative magnetic permeability can be within a range of any of the minimum and maximum values noted above. The relative magnetic permeability of a material of the first portion 271 and/or the first portion 271 in its entirety may be measured according to ASTM A596, ASTM D5568, ASTM A343, ASTM A804, or ASTM A342.

The relative magnetic permeability may be for a frequency of electromagnetic radiation of at least 3 kHz or at least 5 kHz or at least 10 kHz or at least 20 kHz or at least 30 kHz or at least 40 kHz or at least 50 kHz or at least 60 kHz or at least 70 kHz or at least 80 kHz or at least 90 kHz or at least 100 kHz or at least 200 kHz or at least 300 kHz or at least 400 kHz or at least 500 kHz or at least 600 kHz or at least 700 kHz or at least 800 kHz or at least 900 kHz or at least 1 MHz or at least 2 MHz or at least 3 MHz or at least 4 MHz or at least 5 MHz or at least 6 MHz or at least 7 MHz or at least 8 MHz or at least 9 MHz or at least 10 MHz or at least 12 MHz. Still, in other embodiments, the relative magnetic permeability of the material may be relative to electromagnetic radiation having a frequency of not greater than 3 GHz or not greater than 2 GHz or not greater than 1 GHz or not greater than 900 MHz or not greater than 500 MHz or not greater than 200 MHz or not greater than 150 MHz or not greater than 100 MHz or not greater than 80 MHz or not greater than 60 MHz or not greater than 40 MHz or not greater than 30 MHz or not greater than 20 MHz. It will be appreciated that the frequency of the electromagnetic radiation may be within a range including any of the minimum and maximum frequencies noted above.

In certain other instances, the first portion 271 may have a particular dielectric value that may facilitate improved performance of the electronic assembly in real-world material removal operations. For example, the first portion 271 may have a first dielectric value of at least 1 or at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10 or at least 10.5 or at least 11 or at least 11.5 or at least 12 or at least 12.5 or at least 13 or at least 13.5 or at least 14. Still, and a non-limiting embodiment, a material of the first portion 271 may have a first dielectric value of not greater than 20 or not greater than 19 or not greater than 18 or not greater than 17 or not greater than 16 or not greater than 15 or not greater than 14 or not greater than 13 or not greater than 12 or not greater than 11 or not greater than 10 or not greater than 9 or not greater than 8 or not greater than 7 or not greater than 6 or not greater than 5 or not greater than 4 or not greater than 3. It will be appreciated that the first dielectric value may be within a range including any of the minimum and maximum values noted above. In certain instances, the material of the first portion 271 may consist essentially of a dielectric material having a dielectric value within a range of at least 1 to not greater than 20. The dielectric value of the material and/or the first portion may be measured according to ASTM STP 926, ASTM STP 783, ASTM D2149, or ASTM D3380.

In certain instances, the first portion 271 itself, including all of its component layers (if any), may have an average relative magnetic permeability and dielectric value within a range of any of the values noted above with respect to a single layer of the first portion 271. The average relative magnetic permeability values may be relative to an electromagnetic radiation having a frequency of at least 3 kHz to not greater than 300 GHz and those values in between as described above. The first portion 271 may consist essentially of a dielectric material having a first relative magnetic permeability within a range of those values noted above. In still another embodiment, the second portion 272 may be free of a dielectric material.

In certain instances, it may be desirable that the second portion 272 have particular characteristics that may facilitate improved operation of the electronic assembly 220 in real-world material-removal operations. For example, the second portion 272 may have a particular dielectric value that may facilitate improved performance. In one instance, the second portion 272 may have a second dielectric value of at least 1, such as at least 2 or at least 3 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10 or at least 10.5 or at least 11 or at least 11.5 or at least 12 or at least 12.5 or at least 13 or at least 13.5 or at least 14. In another non-limiting embodiment, the second portion 272 can have a second dielectric value of not greater than 100 or not greater than 70 or not greater than 50 or not greater than 40 or not greater than 30 or not greater than 20, such as not greater than 19 or not greater than 18 or not greater than 17 or not greater than 16 or not greater than 15 or not greater than 14 or not greater than 13 or not greater than 12 or not greater than 11 or not greater than 10 or not greater than 9 or not greater than 8 or not greater than 7 or not greater than 6 or not greater than 5 or not greater than 4 or not greater than 3. It will be appreciated that the second dielectric value can be within a range including any of the minimum and maximum values noted above.

In another embodiment, the second portion 272 may have a particular relative average magnetic permeability that may enhance performance of the electronic assembly in real-world material removal operations. For example, the second portion 272 may have a second average relative magnetic permeability of not greater than 15, such as not greater than 14.5 or not greater than 14 or not greater than 13.5 or not greater than 13 or not greater than 12.5 or not greater than 12 or not greater than 11.5 or not greater than 11 or not greater than 10.5 or not greater than 10 or not greater than 9.5 or not greater than 9 or not greater than 8.5 or not greater than 8 or not greater than 7.5 or not greater than 7 or not greater than 6.5 or not greater than 6 or not greater than 5.5 or not greater than 5 or not greater than 4.5 or not greater than 4 or not greater than 3.5 or not greater than 3 or not greater than 2.5 or not greater than 2 or not greater than 1.5 or not greater than 1.25. In another non-limiting embodiment, the second portion 272 may have a second average relative magnetic permeability of at least 1, such as at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10. It will be appreciated that the second average relative magnetic permeability may be within range including any of the minimum and maximum values noted above. The frequency of the electromagnetic radiation for which the second portion 272 has a particular average relative magnetic permeability can be for frequency of at least 3 kHz and not greater than 300 GHz, including any of those alternative minimum and maximum values as noted above.

In certain instances, the first portion 271 may have a different first average relative magnetic permeability as compared to the second average relative magnetic permeability of the second portion 272. This may facilitate improved operation of the abrasive article and associated systems using such abrasive articles. For example, in certain instances the first average relative magnetic permeability may be greater than the second average relative magnetic permeability. More particularly, the difference in the magnetic permeability may be defined as a magnetic permeability difference value (ΔMP), which is defined by the equation (ΔMP=MP2/MP1), wherein MP1 is the first average relative magnetic permeability and MP2 is the second average relative magnetic permeability. The magnetic permeability difference value (ΔMP) can be at least 1.1, such as at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100 or at least 1000. In another non-limiting embodiment, the magnetic permeability difference value (ΔMP) can be not greater than 1,000,000 or not greater than 100,000 or not greater than 10,000 or not greater than 1,000 or not greater than 100 or not greater than 10 or even not greater than 5. It will be appreciated that reference herein to the average magnetic permeability may be reference to an average relative magnetic permeability of the first portion 271 or second portion 272 in totality. In the alternative, reference to the first average relative magnetic permeability may be reference to the average relative magnetic permeability of a material of the first portion 271, such as a layer contained within the first portion 271. Likewise, reference to a second average relative magnetic permeability may be reference to the relative magnetic permeability of a material, such as at layer contained within the second portion 272.

In another aspect, the package can include the first portion and the second portion and each the first portion and second portion may define and have a first average dielectric value the second average dielectric value, respectively, in certain instances the first dielectric first average dielectric value can be different than the second average dielectric value. For example, the first average dielectric value can be less than the second average dielectric value. More particularly, the difference in the dielectric values between the first portion 271 of the second portion 272 may be defined as a dielectric difference value (ΔDV), which is defined by the equation (ΔDV=DV1/DV2), wherein DV1 is the first average dielectric value and DV2 is the second average dielectric value. In one embodiment, the dielectric difference value (ΔDV) can be at least 1.1, such as at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100 or at least 1000.

Reference herein to a first average dielectric value can be reference to the dielectric value of the first portion 271 in its entirety. In the alternative, reference to a first average dielectric value can be reference to a dielectric value of a material of the first portion 271, such as a layer, of the first portion 271. Likewise, reference herein to a second average dielectric value can be reference to the second dielectric value of the second portion 272 in its entirety. In the alternative, reference to the second average dielectric value can be reference to a material of the second portion 272, such as a layer, of the second portion 272.

In certain instances, the first portion 271 may have a particular average RF reflectance, which may facilitate improved performance of the electronic assembly in real-world material removal operations. For example, first portion 271 may have an RF reflectance of at least 50% for electromagnetic radiation having a frequency between 3 kHz and 300 GHz. In other embodiments, the first portion 271 can have a first average reflectance of at least 51%, such as at least 52% or at least 53% or at least 54% or at least 55% or at least 56% or at least 57% or at least 58% or at least 59% or at least 60% or at least 61% or at least 62% or at least 63% or at least 64% or at least 65% or at least 66% or at least 67% or at least 68% or at least 69% or at least 70% or at least 71% or at least 72% or at least 73% or at least 74% or at least 75% or at least 76% or at least 77% or at least 78% or at least 79% or at least 80% or at least 81% or at least 82% or at least 83% or at least 84% or at least 85% or at least 86% or at least 87% or at least 88% or at least 89% or at least 90% or at least 91% or at least 92% or at least 93% or at least 94% or at least 95% or at least 96% or at least 97% or at least 98% or at least 99%. It will be understood that reference to the first average RF reflectance can be reference to the total RF reflectance of the first portion 271 as a whole. Alternatively, the first average RF reflectance may be the RF reflectance of a material within the first portion, such as a layer of material, contained within the first portion 271.

The second portion 272 may have a particular second average RF reflectance, which may facilitate improved performance of the electronic assembly in real-world material removal operations. For example, second portion 272 may have an RF reflectance of not greater than 50% for electromagnetic radiation have a frequency between 3 kHz and 300 GHz, such as not greater than 40% or not greater than 30% or not greater than 20% or not greater than 10% or not greater than 5%. It will be understood that reference to the second average RF reflectance can be reference to the total RF reflectance of the second portion 272 as a whole. Alternatively, the second average RF reflectance may be the RF reflectance of a material within the second portion 272, such as a layer of material, contained within the second portion 272.

In another embodiment, second portion 272 may have a particular RF reflectance that may facilitate improved performance of the electronic assembly 220. For example, the second portion 272 may have a second average RF reflectance that may be different than the first average RF reflectance. For example, the second average RF reflectance can be less than the first average RF reflectance. In particular instances, the difference between the first average RF reflectance and the second average RF reflectance can be defined as a reflection difference value (ΔRFR), which is defined by the equation (ΔRFR=RFR1/RFR2), wherein RFR1 is the first average RF reflectance and RFR2 is the second average RF reflectance. In one embodiment, the reflection difference value (ΔRFR) can be at least 1.1, such as at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100. In another embodiment, ΔRFR may be not greater than 1000, or not greater than 500 or not greater than 300 or not greater than 200 or not greater than 100 or not greater than 50. The ΔRFR can be a value within any of the lower and upper values noted above. It will be appreciated that reference to the second average RF reflectance can be reference to the average RF reflectance of the second portion 272 as a whole. Alternatively, the second average article reflectance may be the RF reflectance of a material, such as a layer, contained within the second portion 272.

In yet another embodiment, the first portion 271 may have a particular RF transmittance, such as a first average RF transmittance that may facilitate improved operation of the electronic assembly in real-world material removal operations. The first portion 271 may have a first average RF transmittance that is different than an RF transmittance of the second portion 272. For example, the first average RF transmittance can be less than the second average RF transmittance. The difference in RF transmittance may be defined as a transmit difference value (ΔRFT), which is defined by the equation (ΔRFT=RFT2/RFT1), wherein RFT1 is the first average RF transmittance and RFT2 is the second average RF transmittance. The transmit difference value (ΔRFT) can be at least 1.1, such as at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100. It will be appreciated that reference herein to the first or second RF transmittance can be reference to the average RF transmittance of the either of the portions 271 or 272 as a whole or a component of such portions 271 and 272, such as a material layer contained within either of the first or second portions 271 and 272.

In certain instances, the first portion 271 may be part of a package 270 of the electronic assembly 220. In at least one embodiment, the first portion 271 may define a particular volume percent of the total volume of the package 270, which may in facilitate improved performance of the electronic assembly 220. For example, the first portion 271 can define at least 10 vol % of a total volume of the package 270, such as least 20% or at least 30% or at least 40% or at least 50% or at least 60% or at least 70% or at least 80% or at least 90% or at least 100%. Still, in at least one non-limiting embodiment, the first portion 271 can define not greater than 90% of the total volume of the package or not greater than 80% or not greater than 70% or not greater than 60% or not greater than 50%.

In certain embodiments, the first portion 271 and the second portion 272 are part of a package 270 of the electronic assembly 220, and the first portion 271 can account for a greater volume percent of the total volume of the package as compared to the volume percent of the second portion 272. Still, another non-limiting embodiment, the first portion 271 can define a lesser volume percent of the total volume of the package 270 as compared to the volume percent of the second portion 272 for the total volume of the package 270.

The first portion 271 may have a first average thickness (T1) and the second portion 272 may have a second average thickness (T2) that may facilitate improved performance. For example, the first average thickness (T1) can be different than the second average thickness (T2). It will be appreciated the average thickness may be measured utilizing a plurality of thickness measurements as measured in cross-section at different, randomly selected places in the portions. In certain embodiments, T1 may be greater than T2. Still, in other instances, T1 can be less than T2. In still another embodiment, T1 and T2 can be substantially the same.

The particular instances, the first portion 271 may have an average thickness of at least 0.1 mm, such as at least 0.2 mm or at least 0.3 mm or at least 0.4 mm or at least 0.5 mm or at least 0.6 mm or at least 0.7 mm or at least 0.8 mm or at least 0.9 mm or at least 1 mm or at least 1.2 mm or at least 1.5 mm or at least 1.8 mm or at least 2 mm or at least 2.5 mm or at least 3 mm or at least 3.5 mm or at least 4 mm or at least 4.5 mm or at least 5 mm. Still, the first average thickness may be not greater than 10 mm or not greater than 9 mm or not greater than 8 mm or not greater than 7 mm or not greater than 6 mm or not greater than 5 mm or not greater than 4 mm or not greater than 3 mm or not greater than 2 mm. It will be appreciated that the first average thickness can be within a range including any of the minimum and maximum values noted above.

The second portion 272 may have an average thickness of at least 0.1 mm, such as at least 0.2 mm or at least 0.3 mm or at least 0.4 mm or at least 0.5 mm or at least 0.6 mm or at least 0.7 mm or at least 0.8 mm or at least 0.9 mm or at least 1 mm or at least 1.2 mm or at least 1.5 mm or at least 1.8 mm or at least 2 mm or at least 2.5 mm or at least 3 mm or at least 3.5 mm or at least 4 mm or at least 4.5 mm or at least 5 mm. Still, the second average thickness may be not greater than 10 mm or not greater than 9 mm or not greater than 8 mm or not greater than 7 mm or not greater than 6 mm or not greater than 5 mm or not greater than 4 mm or not greater than 3 mm or not greater than 2 mm. It will be appreciated that the second average thickness can be within a range including any of the minimum and maximum values noted above.

The first portion 271 may include one or more particular types of material that have one or more characteristics of the embodiments herein. For example, the first portion 271 may be a material from the group of inorganic materials, ceramics, glass, organic materials, or any combination thereof. In more particular instances, the first portion may include a material selected from the group of fluoropolymers, polyester, polyimide, polyamide thermoplastics, thermosets, rubber, or any combination thereof. Thermoplastic polymers may include, but is not limited to polycarbonates, polyacrylates, polyamides, polyimides, polysulphones, polyketones, polybenzimidizoles, polyesters, and blends of the above-mentioned polymers. Thermoset polymers may include, but is not limited to, epoxies, cyanoesters, phenol formaldehyde, polyurethanes, poly (amide/imide), cross-linkable unsaturated polyesters, polypropylene, polyimides, polysulfone (PSU), poly(ethersulfone) (PES) and polyetherimide (PEI), poly(phenylene sulfide) (PPS), polyetheretherketone (PEEK), polyether ketones (PEK), aromatic polymers, poly (p-phenylene), ethylene propylene rubber and/or cross-linked polyethylene, a fluoropolymer including polytetrafluorethylene, or any combination thereof. In more particular instances, the first portion 271 may include at least one of polyimide, polyethylene terephthalate, polytetrafluoroethylene, polyvinyl chloride, polycarbonate, polypropylene, polyvinyl butyral, polyethylene naphthalate, polydimethylsiloxane, polyether ether keytone (PEEK) or any combination thereof. More particularly, the first portion 271 may consist of or consist essentially of, polyimide, polyethylene terephthalate or polytetrafluoroethylene.

The second portion 272 may include one or more particular types of material that have one or more characteristics of the embodiments herein. For example, the second portion 271 may be a material from the group of inorganic materials, ceramics, glass, organic materials, or any combination thereof. In more particular instances, the second portion 272 may include a material selected from the group of fluoropolymers, polyester, polyimide, polyamide thermoplastics, thermosets, rubber, or any combination thereof. Thermoplastic polymers may include, but is not limited to polycarbonates, polyacrylates, polyamides, polyimides, polysulphones, polyketones, polybenzimidizoles, polyesters, and blends of the above mentioned polymers. Thermoset polymers may include, but is not limited to, epoxies, cyanoesters, phenol formaldehyde, polyurethanes, poly (amide/imide), cross-linkable unsaturated polyesters, polypropylene, polyimides, polysulfone (PSU), poly(ethersulfone) (PES) and polyetherimide (PEI), poly(phenylene sulfide) (PPS), polyetheretherketone (PEEK), polyether ketones (PEK), aromatic polymers, poly(p-phenylene), ethylene propylene rubber and/or cross-linked polyethylene, a fluoropolymer including polytetrafluorethylene, or any combination thereof. In more particular instances, the second portion 272 may include at least one of polytetrafluoroethylene, polyimide, polyethylene naphthalate, polydimethylsiloxane, phthalazinone ether ketone or any combination thereof. More particularly, the second portion 272 may consist of or consist essentially of a polytetrafluoroethylene, polyimide, polyethylene naphthalate, polydimethylsiloxane, phthalazinone ether ketone or any combination thereof.

In an embodiment, the electronic assembly can be coupled to the body of the abrasive article in an abrasive portion or a non-abrasive portion. In some instances, the coupling can be direct or indirect, wherein indirect coupling includes at least one intermediate component between the electronic assembly and the body. In particular instances, the electronic assembly can be coupled to the abrasive body in a tamper-proof manner.

Any one or more electronic devices and/or electronic assemblies may have improved operation based on the embodiments including at least a first portion. For example, any one of the electronic devices and/or electronic assemblies of the embodiments herein may have a minimum effective communication range of at least 0.01 meters or at least 0.02 meters or at least 0.04 meters or at least 0.06 meters or at least 0.08 meters or at least 0.1 meters or at least 0.2 meters or at least 0.25 meters or at least 0.3 meters or at least 0.35 meters or at least 0.4 meters or at least 0.5 meters or at least 0.6 meters or at least 0.7 meters or at least 0.8 meters or at least 0.9 meters or at least 1 meter or at least 1.2 meters or at least 1.4 meters or at least 1.6 meters or at least 1.8 meters or at least 2 meters or at least 2.2 meters or at least 2.4 meters or at least 2.6 meters or at least 2.8 meters or at least 3 meters or at least 3.2 meters or at least 3.4 meters or at least 3.6 meters or at least 3.8 meters or at least 4 meters or at least 5 meters or at least 6 meters or at least 7 meters or at least 8 meters or at least 9 meters or at least 10 meters. In another aspect, any one of the electronic devices and/or electronic assemblies may have a minimum data transmission rate of at 4 kbps or at least 8 kbps or at least 10 kbps or at least 15 kbps or at least 20 kbps or at least 40 kbps or at least 60 kbps or at least 80 kbps or at least 100 kbps or at least 150 kbps or at least 200 kbps or at least 250 kbps or at least 300 kbps or at least 400 kbps or at least 500 kbps or at least 600 kbps. In still other instances, the electronic devices and/or electronic assemblies may have a maximum loss of not more than 50 dB [absolute value] over a range of frequencies of at least 3 kHz to not greater than 300 GHz.

FIGS. 3A-3E include embodiments demonstrating various arrangements that may be utilized between the body 301 and the electronic assembly 310. Other arrangements are possible. For example, the electronic assembly 310 can be bonded directly to an exterior surface of the abrasive body 301, such as the first major surface 302. It will be appreciated that the electronic assembly 310 can be bonded directly to other surfaces of the body 301 depending upon the desired transmission direction, shape of the body, potential RF transmission blocking structures, and the like.

Figure 3A:
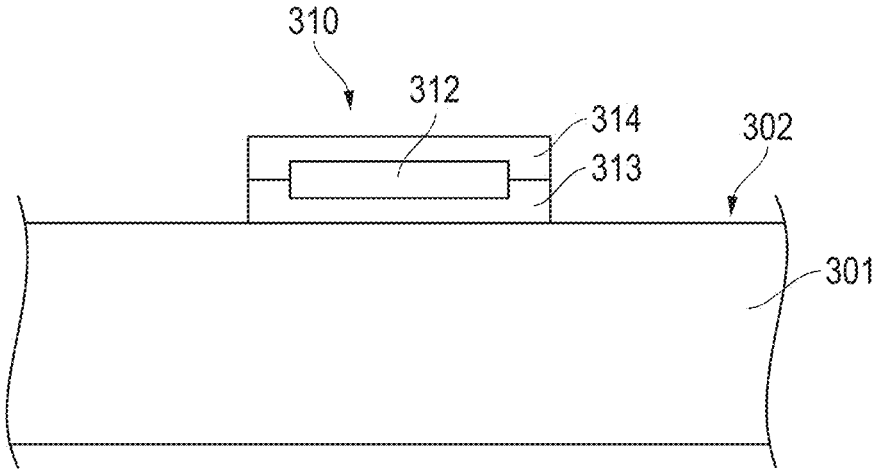
FIGS. 3A-3E include cross-sectional illustrations of portions of abrasive articles according to embodiments.
Figure 3B:
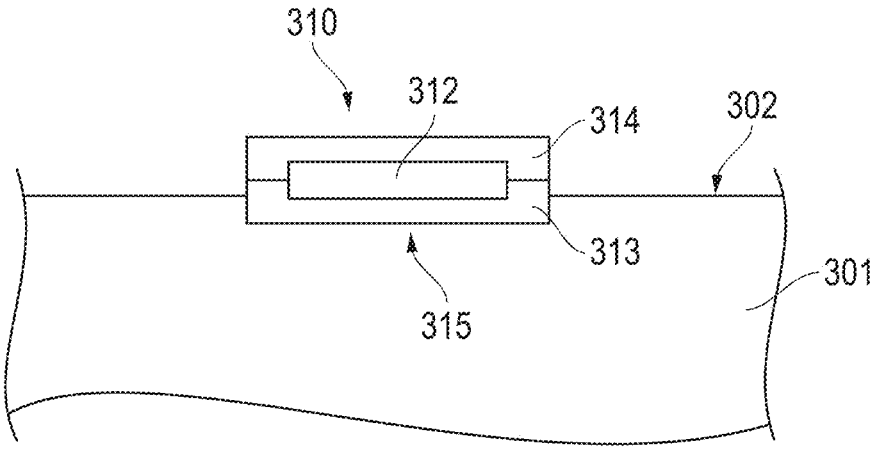

As illustrated in FIG. 3A, the electronic assembly 310, including the one or more electronic devices 312, the first portion 313 and the second portion 314 are coupled to a body 301. The coupling can be direct or indirect. The body 301 may be an abrasive portion or a non-abrasive portion of the body 301. In particular instances, the first portion 313 may be directly coupled to the surface 302 of the body 301. In another embodiment, such as illustrated in FIG. 3B, at least a portion of the electronic assembly 310 may be partially embedded in the body 301. For example, the bottom surface 315 of the first portion 313 may be below a surface 302 of the body 301.

Figure 3C:
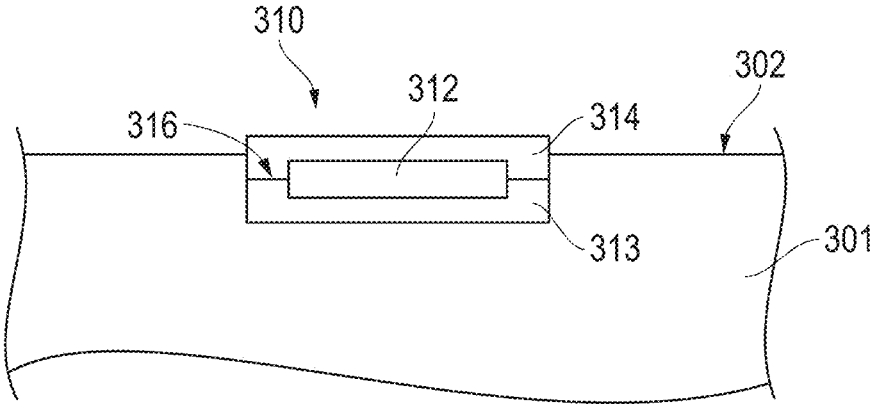

FIG. 3C includes an illustration of an electronic assembly 310 partially embedded in a portion of the body 301. As illustrated, the electronic assembly 310 is partially embedded such that an upper surface 316 of the first portion 313 is at or below the surface 302 of the body 301. In certain partially-embedded embodiments, at least a portion of the second portion 314, such as the uppermost surface of the second portion 314 may extend above the surface 302, such as illustrated in FIG. 3C.

Figure 3D:
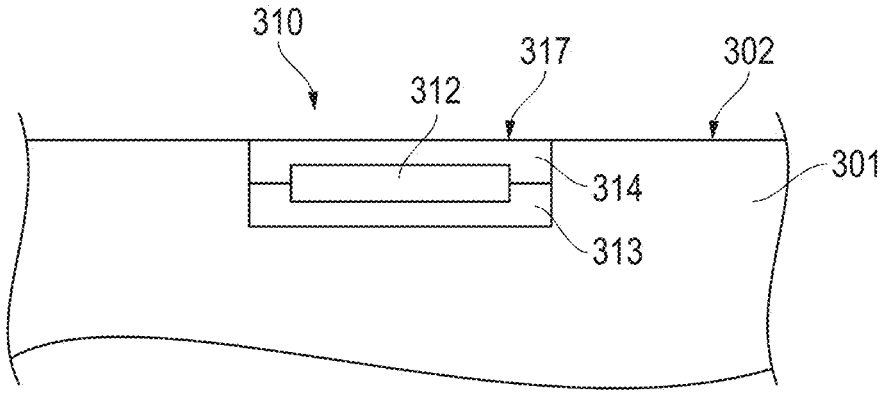

FIG. 3D includes an illustration of a partially-embedded electronic assembly 310 in a portion of a body 301. The electronic assembly 310 can be partially-embedded such that at least a portion of the upper surface 317 of the second portion 314 intersects the surface 302. For example, at least a portion of the upper surface 317 can be substantially continuous and co-planar with the surface 302.

In accordance with an embodiment, the embedded portion of the electronic assembly 310 may have a particular size relative to the total volume of the electronic assembly 310 that facilitates suitable engagement with the body 301. For example, the embedded portion can be at least 1% of the total volume of the electronic assembly 310, such as at least 5% or at least 10% or at least 15% or at least 20% or at least 30% or at least 40% or at least 50% or at least 60% or at least 70% or at least 80% or even at least 90% of the total volume of electronic assembly 310. Still, in another non-limiting embodiment, the embedded portion can have a particular size such as not greater than 95% of the total volume of electronic assembly 310, such as not greater than 90%, or not greater than 80% or not greater than 70% or not greater than 60% or not greater than 50% or not greater than 40% or not greater than 30% or not greater than 20% or not greater than 10% or not greater than 5% of the total volume of the electronic assembly. It will be appreciated that the embedded portion can have a size relative to the volume of electronic assembly 310 that is within a range including any of the minimum and maximum percentages noted above. Furthermore, will be appreciated that alternative size and shaped embedded portions may be utilized to facilitate suitable attachment of electronic assembly 310 in the body 301.

Figure 3E:
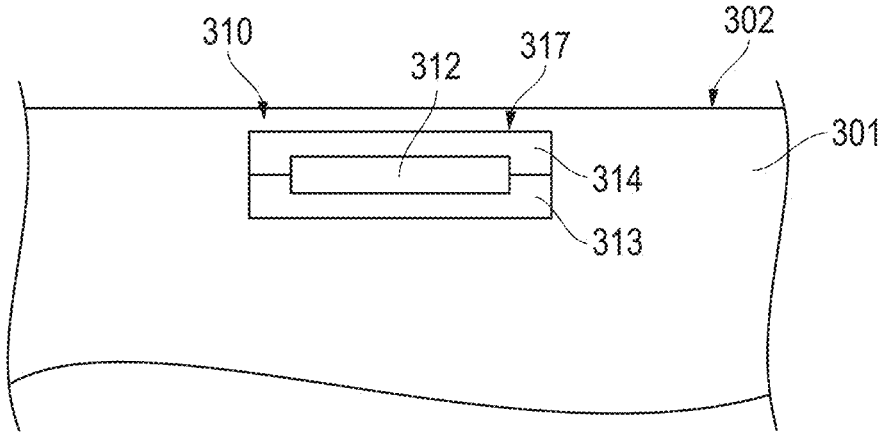

In still another embodiment, as illustrated in FIG. 3E, the electronic assembly 310 can be completely embedded in the body 301. As illustrated, in a completely embedded embodiment, the entirety of the electronic assembly 310 can be displaced below the surface 302, as viewed in cross-section. For example, in the embodiment of FIG. 3E, the upper surface 317 of the second portion 314 is disposed beneath the surface 302 as viewed in cross-section.

In accordance with an embodiment, the electronic assembly 310 can be embedded at a particular depth that is suitable for protecting the electronic assembly 310 while maintaining suitable capabilities to allow information to be sent to and/or received by the electronic device 362. For example, the electronic assembly 310 can be embedded at a depth (D) of less than 50% of the total thickness of the body (TB). In other instances, the embedded depth of electronic assembly 310 can be less, such as not greater than 45% or not greater than 40% or not greater than 35% or not greater than 30% or not greater than 25% or not greater than 20% or not greater than 15% or not greater than 10% or not greater than 5% or not greater than 3% of the total thickness of the body (TB). Still in one non-limiting embodiment, the electronic assembly 310 can be embedded at a depth of at least 1% of the total thickness of the body (TB), such as at least 2% or at least 3% or at least 5% or at least 8% or at least 10% or at least 12% or at least 13% or at least 15% or at least 20% or at least 25% or at least 30% or even at least 40% of the total thickness of the body (TB). It will be appreciated that the embedded depth of the electronic assembly 310 can be within a range including any of the minimum and maximum percentages noted above.

The abrasive articles herein can include a plurality of electronic assemblies distributed over the body in controlled orientations and placements relative to each other. The plurality of electronic assemblies may be coupled to, partially embedded within, or completely embedded in the abrasive portion, non-abrasive portion, or a combination thereof.

Figure 4A:
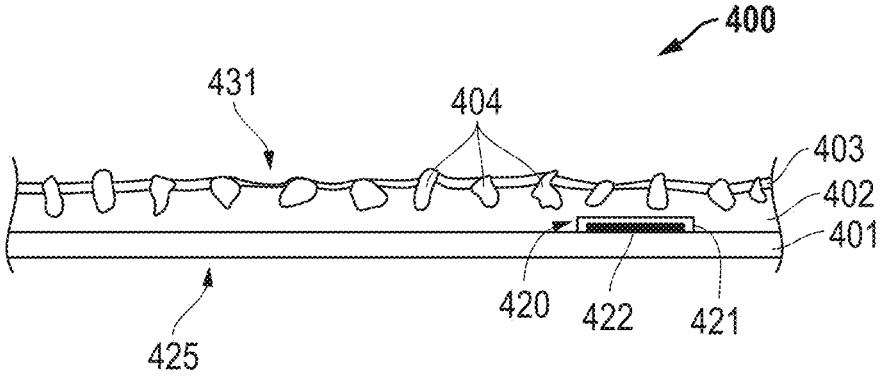
FIG. 4A includes a cross-sectional illustration of a portion of a coated abrasive article according to an embodiment.

FIG. 4A includes a cross-sectional illustration of a coated abrasive article according to an embodiment. As illustrated, the coated abrasive 400 can include a substrate 401 and a make coat 402 overlying a surface of the substrate 401. The coated abrasive 400 can further include one or more types of particulate material 404, which can include abrasive particles (e.g., primary abrasive particles and/or secondary abrasive particles), filler particles, additive particles, or any combination thereof. The coated abrasive 400 may further include size coat 403 overlying and bonded to the particulate material 404 and the make coat 402.

According to one embodiment, the substrate 401 can include an organic material, inorganic material, and a combination thereof. In certain instances, the substrate 401 can include a woven material. However, the substrate 401 may be made of a non-woven material. Particularly suitable substrate materials can include organic materials, including polymers, and particularly, polyester, polyurethane, polypropylene, polyimides such as KAPTON from DuPont, paper or any combination thereof. Some suitable inorganic materials can include metals, metal alloys, and particularly, foils of copper, aluminum, steel, and a combination thereof.

The make coat 402 can be applied to the surface of the substrate 401 in a single process, or alternatively, the particulate material 404 can be combined with a make coat 402 material and the combination of the make coat 402 and particulate material 404 can be applied as a mixture to the surface of the substrate 401. In certain instances, controlled deposition or placement of the particulate material 404 in the make coat 402 may be better suited by separating the processes of applying the make coat 402 from the deposition of the particulate material 404 in the make coat 402. Still, it is contemplated that such processes may be combined. Suitable materials of the make coat 402 can include organic materials, particularly polymeric materials, including for example, polyesters, epoxy resins, polyurethanes, polyamides, polyacrylates, polymethacrylates, polyvinylchlorides, polyethylene, polysiloxane, silicones, cellulose acetates, nitrocellulose, natural rubber, starch, shellac, and mixtures thereof. In one embodiment, the make coat 402 can include a polyester resin. The coated substrate can then be heated in order to cure the resin and the particulate material 404 to the substrate 401. In general, the coated substrate 401 can be heated to a temperature of between about 100° C. to less than about 250° C. during this curing process.

The particulate material 404 can include different types of abrasive particles according to embodiments herein. The different types of abrasive particles can include different types of shaped abrasive particles, different types of secondary particles or any combination thereof. The different types of particles can be different from each other in composition, two-dimensional shape, three-dimensional shape, grain size, particle size, hardness, friability, agglomeration, or any combination thereof.

After sufficiently forming the make coat 402 with the particulate material 404 contained therein, the size coat 403 can be formed to overlie and bond the particulate material 404 to the make coat 402 and the substrate 401. The size coat 403 can include an organic material, and may be made essentially of a polymeric material, and notably, can use polyesters, epoxy resins, polyurethanes, polyamides, polyacrylates, polymethacrylates, poly vinyl chlorides, polyethylene, polysiloxane, silicones, cellulose acetates, nitrocellulose, natural rubber, starch, shellac, and mixtures thereof.

As further illustrated in FIG. 4A, the coated abrasive 400 can include an electronic assembly 420 including an electronic device 422 contained within a package 421. According to an embodiment, the package may be optional and one may opt to utilize the make coat 402 and/or size coat 403 as a material suitable for packaging and enclosing at least a portion of the electronic device 422. The electronic assembly 420 can have any of the features of electronic assemblies described in embodiments herein. The electronic device 422 may have any of the features of other electronic devices described in embodiments herein. The package 421 may have any of the features of any of the other packages described in embodiments herein, including a first portion and a second portion.

According to one particular embodiment, the electronic assembly 420 can be overlying and/or coupled to the substrate 401. In a particular embodiment, at least a portion of the electronic device 422 can be in contact with the substrate 401. Furthermore, as illustrated in FIG. 4, at least a portion of the electronic device 422 can be encompassed by the package 421. According to one embodiment, the electronic assembly 420 can be embedded within the make coat 402 such that the make coat 402 covers the entirety of the electronic assembly 420. However, in other embodiments, at least a portion of the electronic assembly 410 may be protruding from the make coat 402 and/or size coat 403 such that at least a portion of the electronic assembly 420 can be exposed above the exterior surface 431 of the size coat 403.

FIG. 4A provides one potential embodiment for the incorporation of the electronic assembly 420 into a coated abrasive article 400. Other possible placements and orientations of the electronic assembly for 20 are possible. For example, the electronic assembly 420 may be placed on the opposite side of the backing 401, such as the backside 425 of the backing 401. In still another embodiment, the electronic assembly 420 can be overlying at least a portion of the exterior surface 431 of the abrasive article 400, and particularly the size coat 403. In certain instances, none of the electronic assembly 420 may be embedded within the size coat 403 or make coat 402 of the coated abrasive article 400.

In an embodiment, an abrasive article can include a substrate and an abrasive coating overlying the substrate.

The substrate can be any substrate disclosed in embodiments herein. For instance, the abrasive article can include a non-woven abrasive article, wherein the substrate can include a fibrous web. The abrasive coating can include any composition that is known to a skilled artisan for forming the non-woven abrasive article. In another instance, the abrasive article can include a coated abrasive article including a substrate similar to the backing 401, and the abrasive coating can include the make coat 402 and abrasive particles 404, and optionally the size coat 403. In some instances, the abrasive coating can include a top coat overlying the size coat 403. In an embodiment, the abrasive coating can include an exterior surface that can be a grinding surface. For instance, the grinding surface can be the upper surface of the size coat 403, as illustrated in FIG. 4A.

In an embodiment, an electronic assembly can be coupled to the abrasive coating in a manner such that at least a portion of the electronic assembly is in direct contact with a portion of the abrasive coating. For instance, as illustrated in FIG. 4A, the electronic assembly 420 is in direct contact with the make coat 402. In a particular embodiment, the electronic assembly can be coupled to the abrasive coating in a tamper-proof manner.

In an embodiment, the electronic assembly 420 can be at least partially embedded in the abrasive coating. For instance, the electronic assembly 420 can be disposed such that at least a portion of the electronic assembly 420 can be beneath the grinding surface of the abrasive coating. In a particular embodiment, the electronic assembly 420 can be fully embedded within the abrasive coating. For example, the electronic assembly 420 can be fully enveloped in the abrasive coating. In another instance, the entire electronic assembly 420 can be beneath the grinding surface of the abrasive coating.

In a further embodiment, the electronic assembly can be disposed over the substrate, such as between the substrate and the abrasive coating. In an example, the electronic assembly can be on the substrate. Alternatively, the electronic assembly can be spaced apart from the substrate. In some instances, the electronic assembly may be partially embedded or completely embedded in the substrate (i.e., a non-abrasive portion).

In another embodiment, the electronic assembly 420 can have a certain thickness that can facilitate placement and coupling of the electronic assembly to the body. In one instance, the electronic assembly 420 can have a thickness of at least 1 micron, such as at least 2 microns, at least 3 microns, or at least 4 microns. In another instance, the electronic assembly can be thicker, having a thickness of at least 0.5 mm, at least 0.7 mm, at least 0.8 mm, at least 1 mm, or at least 2 mm. Alternatively, or additionally, the electronic assembly 420 may have a thickness of not greater than 5 mm, such as not greater than 4 mm, not greater than 3 mm, not greater than 2 mm, or not greater than 1 mm. In some instances, the electronic assembly can be thinner, such as having a thickness of not greater than 10 microns, not greater than 9 microns, not greater than 7 microns, not greater than 5 microns, or not greater than 4 microns. Moreover, the thickness of the electronic assembly can be in a range including any of the minimum and maximum values noted herein. For example, the electronic assembly 420 may have a thickness in a range including at least 1 micron and not greater than 5 mm, or in a range including at least 1 microns and not greater than 10 microns, or in a range including at least 1 mm and not greater than 5 mm. After reading the instant disclosure, a skilled artisan would understand that the thickness of the electronic assembly 420 can be selected to suit a forming process of the abrasive article, such as placement and coupling of the electronic assembly or surviving a condition used to form the abrasive article, or to improve use of the abrasive article having the electronic assembly.

In another embodiment, the electronic assembly 420 can have a certain thickness relative to the average thickness of the abrasive coating that can facilitate formation of the abrasive article. For instance, the thickness of the electronic assembly 420 may be not greater than 99% of the average thickness of the abrasive coating, such as not greater than 98%, not greater than 96%, not greater than 94%, not greater than 92%, not greater than 90%, not greater than 88%, not greater than 86%, not greater than 84%, not greater than 82%, not greater than 80%, not greater than 78%, not greater than 76%, not greater than 75%, not greater than 73%, not greater than 71%, not greater than 70%, not greater than 68%, not greater than 66%, not greater than 64%, not greater than 62%, not greater than 60%, not greater than 58%, not greater than 55%, not greater than 53%, not greater than 51%, not greater than 50%, not greater than 48%, not greater than 45%, not greater than 43%, not greater than 41%, not greater than 40%, not greater than 38%, not greater than 36%, not greater than 34%, not greater than 32%, or not greater than 30% of the average thickness of the abrasive coating. In another instance, the electronic assembly 420 can have a thickness of at least 5% of an average thickness of the abrasive coating, such as at least 10%, at least 12%, at least 13%, at least 15%, at least 17%, at least 18%, at least 20%, at least 22%, at least 24%, at least 25%, at least 27%, at least 30%, at least 31%, at least 33%, at least 35%, at least 37%, at least 40%, at least 42%, at least 44%, at least 46%, at least 48%, at least 50%, at least 52%, at least 54%, at least 55%, at least 58%, at least 60%, at least 62%, at least 64%, at least 66%, at least 68%, or at least 70% of the average thickness of the abrasive coating. Moreover, the thickness of the electronic assembly 420 can include any minimum and maximum percentages noted herein. For instance, the electronic assembly 420 can have a thickness of at least 5% and at most 99% of the average thickness of the abrasive coating. In another embodiment, the abrasive coating can have an average thickness from 0.015 mm to 1.5 mm. As used herein, average thickness of the abrasive coating can be determined according to ASTM D1777-96. The average thickness can be the average of 10 samples taken from the abrasive article in the same longitudinal direction (or machine direction).

In another embodiment, the electronic assembly 420 can have a certain thickness relative to the average thickness of the abrasive article that can facilitate formation of the abrasive article. A particular abrasive article can include a coated abrasive, as illustrated in FIG. 4A, or a non-woven abrasive article. For instance, the thickness of the electronic assembly 420 may be not greater than 55% of an average thickness of the abrasive article, such as not greater than 53%, not greater than 51%, not greater than 50%, not greater than 48%, not greater than 45%, not greater than 43%, not greater than 41%, not greater than 40%, not greater than 38%, not greater than 36%, not greater than 34%, not greater than 32%, or not greater than 30% of the average thickness of the abrasive article. In another instance, the electronic assembly 420 can have a thickness of at least 1% of an average thickness of the abrasive article, such as at least 3%, at least 5%, at least 7%, at least 10%, at least 12%, at least 13%, at least 15%, at least 17%, at least 18%, at least 20%, at least 22%, at least 24%, at least 25%, at least 27%, at least 30%, at least 31%, at least 33%, at least 35%, at least 37%, at least 40%, at least 42%, at least 44%, at least 46%, at least 48%, or at least 50% of the average thickness of the abrasive article. Moreover, the thickness of the electronic assembly 420 can include any minimum and maximum percentages noted herein. For instance, the electronic assembly 420 can have a thickness of at least 1% and at most 55% of the average thickness of the abrasive article. In another embodiment, the average thickness of the coated abrasive can be from 0.2 mm to 3.5 mm. As used herein, average thickness of the abrasive article can be determined according to ASTM D1777-96. The average thickness can be the average of 10 samples taken from the abrasive article in the same longitudinal direction (or machine direction).

In an exemplary forming process for forming an exemplary abrasive article, an electronic assembly can be disposed over the substrate, such as the backing 401, and at least a portion of the abrasive coating, such as at least a portion of the make coat 402, can be disposed over the substrate and the electronic assembly 420. In an instance, curing of the portion can be performed prior to applying the rest of the abrasive coating. For instance, the make coat 402 overlying the electronic assembly 420 can be cured prior to application of abrasive particles 404, the size coat 403, or both. The rest of the abrasive coating can be applied and cured to form a finally-formed abrasive article. In another instance, a first portion of the abrasive coating may be applied to the substrate before an electronic assembly is disposed on the substrate, and another portion or the rest of the abrasive coating can be applied before or after curing of the first portion of the abrasive coating and cured. The abrasive article may be formed when all of the abrasive coating is applied and cured. In another instance, the electronic assembly can be releasably coupled to at least a portion of the body.

In one embodiment, the abrasive article can have a certain flexibility difference that can allow the abrasive article to perform and function in the similar manner as a same abrasive article not including the electronic assembly, particularly when the abrasive article is a non-woven or coated abrasive. A first portion of the abrasive article including the electronic assembly and a substantially same second portion not including the electronic assembly can be cut from the abrasive article. Flexibility of the first and second portions can be used to determine the flexibility difference. Each of the first and second portion samples can have a size of 75 mm×150 mm. Test of flexibility can be performed using mandrel bend test according to ASTM D4338-97 with modifications. Tests are conducted on freshly prepared portion samples. Each portion sample is folded to form an inverted U-shaped angle over the mandrel maintaining intimate contact across the mandrel surface. The test is repeated with progressively smaller diameter mandrels until the sample cracks or fails in bending. Flexibility is considered as the smallest diameter mandrel over which four out of five test portion samples do not break. Test of flexibility of the first and second portions can be performed in the longitudinal, transversal, or both directions.

The flexibility difference can be determined using the formula, $\delta F=[|(F2nd-F1st)|/F2nd]\times 100\%$, wherein $\delta F$ is the flexibility difference in the tested direction, F1st is the first flexibility in the tested direction (i.e., longitudinal or transversal), and F2nd is the second flexibility in the tested direction. In an aspect, the first portion can have a first flexibility in a longitudinal direction and the second portion can have a second flexibility in the longitudinal direction, wherein the flexibility difference between the first and the second flexibility may be not greater than 50%, not greater than 45%, not greater than 40%, not greater than 35%, not greater than 30%, not greater than 25%, not greater than 20%, not greater than 15%, not greater than 10%, not greater than 9%, not greater than 8%, not greater than 6%, not greater than 5%, not greater than 4%, not greater than 2%, or not greater than 1%. In another aspect, the flexibility difference in the longitudinal direction can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the flexibility difference in the longitudinal direction can be in a range including any of the minimum and maximum percentages noted herein. In a particular aspect, the first flexibility and the second flexibly in the longitudinal direction can be substantially the same.

In a further aspect, the first portion can have a third flexibility in a transversal direction and the second portion can have a fourth flexibility in the transversal direction, wherein the flexibility difference between the first and second portion in the transversal direction may be not greater than 50%, not greater than 45%, not greater than 40%, not greater than 35%, not greater than 30%, not greater than 25%, not greater than 20%, not greater than 15%, not greater than 10% of the fourth flexibility or not greater than 9% or not greater than 8% or not greater than 6% or not greater than 5% or not greater than 4% or not greater than 2%. In another aspect, the flexibility difference between the third and fourth flexibility can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the flexibility difference between the third and fourth flexibility can be in a range including any of the minimum and maximum percentages noted herein. In a particular aspect, the third flexibility and the fourth flexibly in the longitudinal direction can be substantially the same.

In another embodiment, the abrasive article can have a certain flexural rigidity difference that can allow the abrasive article to perform and function in the similar manner as a same abrasive article not including the electronic assembly, particularly when the abrasive article is a non-woven or coated abrasive. The flexural rigidity difference can be determined based on the flexural rigidity difference of the first portion and the second portion and using the formula, $\delta FX=[|(FX2nd-FX1st)|/FX2nd]\times 100\%$, wherein $\delta FX$ is the flexure rigidity difference, FX1st is flexure rigidity of the first portion, and FX2nd is flexure rigidity of the second portion. The first portion of the abrasive article includes the electronic assembly and the second portion is substantially the same not including the electronic assembly. The first portion and second portion samples are cut in the machine direction having the dimension of 200 mm×25 mm. Flexure rigidity of the first and second portions can be determined according to ASTM D1388-96 using a heart loop tester. 5 samples for each of the first and second portions can be tested. Each sample is formed into a heart-shaped loop. The length of the loop is measured when it is hanging vertically under its own mass. From this measured length, the bending length, and flexural rigidity can be calculated.

In an aspect, the flexural rigidity difference of the abrasive article may be not greater than 50% or not greater than 45% or not greater than 40% or not greater than 35% or not greater than 30% or not greater than 25% or not greater than 20% or not greater than 19% or not greater than 18% or not greater than 16% or not greater than 15% or not greater than 14% or not greater than 12% or not greater than 11% or not greater than 10% or not greater than 9% or not greater than 8% or not greater than 6% or not greater than 5% or not greater than 4% or not greater than 2% or not greater than 1% of the second flexural rigidity. In another aspect, the flexure rigidity difference can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the flexure rigidity difference can be in a range including any of the minimum and maximum percentages noted herein. In a particular aspect, the flexure rigidity of the first portion and the second portion can be substantially the same.

In another embodiment, the abrasive article can have a certain tensile strength difference that can allow the abrasive article to perform and function in the similar manner as a same abrasive article not including the electronic assembly, particularly when the abrasive article is a non-woven or coated abrasive. The tensile strength difference can be determined based on the tensile strength difference of a first portion and a second portion of the abrasive article, using the formula, $\delta T=[|(T2nd-T1st)|/T2nd]\times 100\%$, wherein $\delta T$ is the tensile strength difference, T1st is the tensile strength of the first portion, and T2nd is the tensile strength of the second portion. The tensile strength of the first and second portions is determined using a method derived from ASTM D5035. The first portion includes the electronic assembly, and the second portion is substantially the same without the electronic assembly. The portion samples are cut such that the gauge length is parallel to the longitudinal (machine) direction or the radial axis based on the type of abrasive article. 5 samples for each of the first and second portions can be prepared having the size of 25 mm×50 mm. Each sample is clamped in a tensile testing machine and a force is applied until the sample breaks at a loading rate of 300 mm/min. The breaking force and elongation is recorded and used to determine the tensile strength. The average of 5 samples is used as the tensile strength of the abrasive article.

In an aspect, the tensile strength difference of the abrasive article may be not greater than 50% or not greater than 45% or not greater than 40% or not greater than 35% or not greater than 30% or not greater than 25% or not greater than 20% or not greater than 19% or not greater than 18% or not greater than 16% or not greater than 15% or not greater than 14% or not greater than 12% or not greater than 11% or not greater than 10% or not greater than 9% or not greater than 8% or not greater than 6% or not greater than 5% or not greater than 4% or not greater than 2% or not greater than 1% of the second flexural strength. In another aspect, the tensile difference can be greater than 0, such as at least 0.001%, at least 0.005%, at least 0.01%, at least 0.05%, at least 0.1%, at least 0.3%, at least 0.5%, at least 0.8%, at least 1%, at least 2%, at least 5%, or at least 10%. In a further aspect, the tensile strength difference can be in a range including any of the minimum and maximum percentages noted herein. In a particular aspect, the tensile strength of the first portion and the second portion can be substantially the same.

In an embodiment, the electronic assembly can be placed out of the flange area to help to reduce the likelihood of damaging the electronic assembly during a material removal operation of the abrasive article. In a further embodiment, the electronic assembly may be placed in an area between the discard diameter of a wheel and the flange diameter. In another embodiment, the electronic assembly can be placed in the inner circumferential region.

Figure 4B:
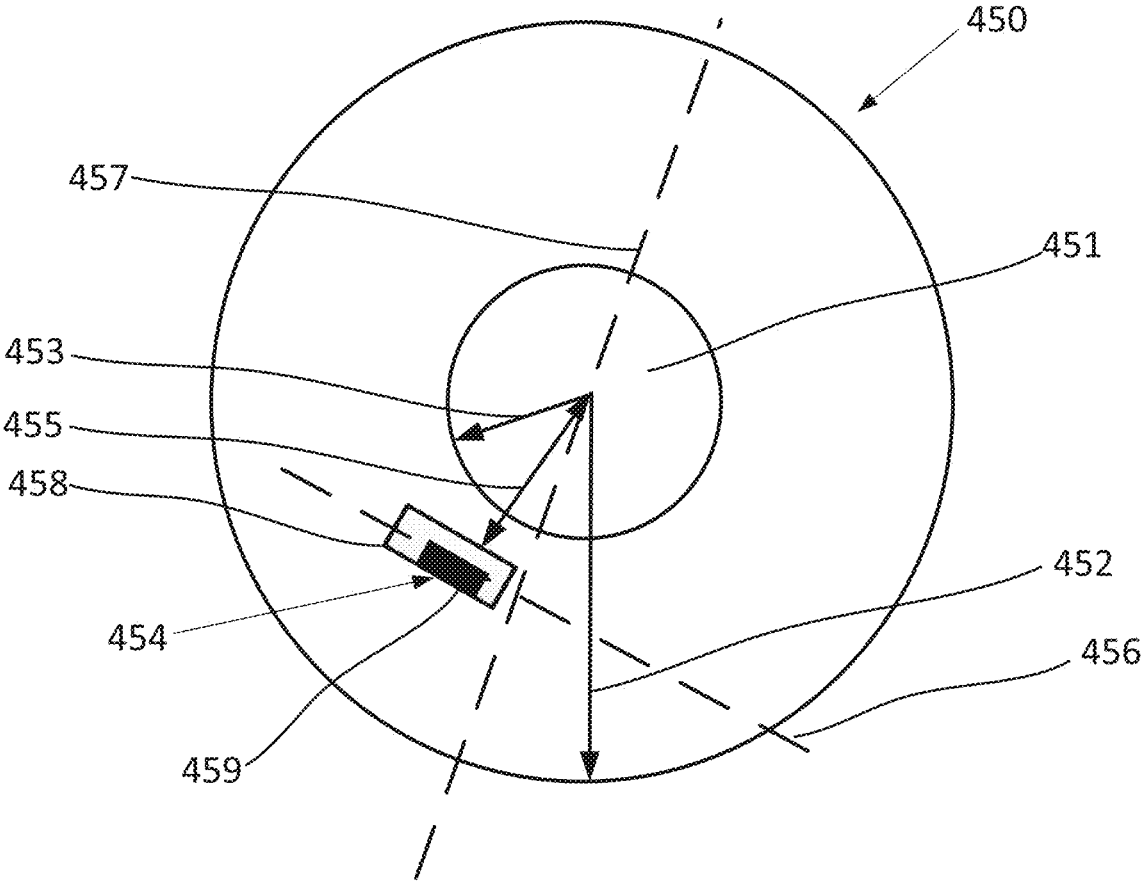
FIG. 4B includes a top-down illustration of a portion of a coated abrasive article according to an embodiment.

In another embodiment, the abrasive article can be in the form of a disc or a wheel having a central opening. As illustrated in FIG. 4B, the abrasive article 450 including an opening 451 having an inner radius 453, and an outer radius 452 (referred to as "R"). In an embodiment, an electronic assembly 454 including a package 458 containing at least one electronic device 459 can be disposed at a position relative to the central opening 451 to facilitate operations utilizing the abrasive article, facilitate function and performance of the electronic assembly, and/or reduce the likelihood of damaging the electronic assembly. For instance, the electronic assembly can be adjacent the central opening 451, wherein the distance 455 between the center of the abrasive article and the electronic assembly 454 may be less than 0.5R, such as not greater than 0.4R, not greater than 0.3R, not greater than 0.2R, or not greater than 0.1R. Additionally, or alternatively, the distance 455 can be at least 0.05R, such as at least 0.08R or at least 0.1R. Moreover, the distance 455 can be in a range including any of the minimum and maximum values noted herein.

In another instance, the electronic assembly can be distal to the central opening 451 and adjacent the outer circumference of the abrasive article. For instance, the distance 455 between the center of the abrasive article and the electronic assembly 454 may be greater than 0.5R, such as at least 0.6R, at least 0.7R, at least 0.8R, or at least 0.9R. Additionally, or alternatively, the distance 455 may be not greater than 0.99R or not greater than 0.95R or not greater than 0.93R or not greater than 0.9R. Moreover, the distance 455 can be in a range including any of the minimum and maximum values noted herein.

In another embodiment, the electronic assembly 454 can have a certain orientation that can facilitate improved performance of the electronic assembly or help to reduce likelihood of damaging the electronic assembly during operations utilizing the abrasive article. For example, as illustrated in FIG. 4B, the abrasive article 450 can have a radial axis 457, and the electronic assembly 454 can have a longitudinal axis 456, wherein the radial axis 457 and the longitudinal axis 456 can be angled.

Figure 4C:
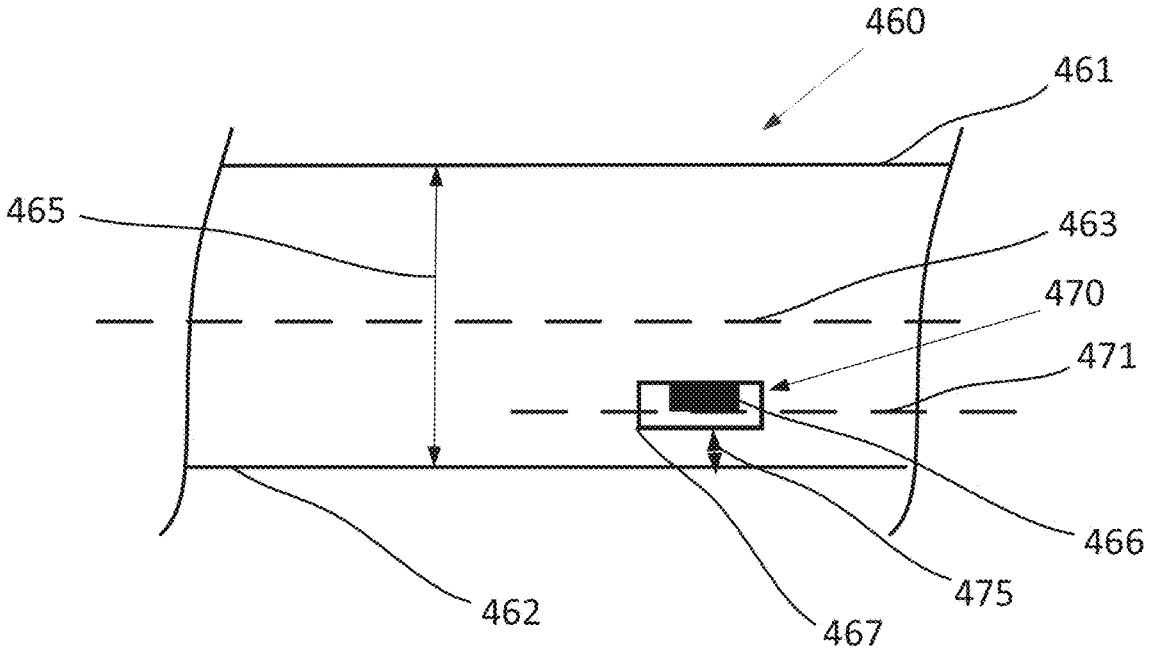
FIG. 4C includes an illustration of a portion of a coated abrasive article according to an embodiment.

In another embodiment, the abrasive article may be in the form of a belt. As illustrated in FIG. 4C, a portion of an abrasive belt 460 can include an edge 461 and an opposite edge 462, and a longitudinal axis 471. As illustrated, the longitudinal axis 471 extends along a midline of the belt 460. The belt 460 can include a width 465 (referred to as "W") across the belt in the lateral direction. The electronic assembly 470 can include a package 467 and an electronic device 466. In an embodiment, the electronic device 470 can be disposed at a position that is adjacent an edge, such as 462 as illustrated, and distal to the midline of the belt, which can facilitate operations utilizing the abrasive article, facilitate function and performance of the electronic assembly, and/or reduce the likelihood of damaging the electronic assembly during operations utilizing the belt. For instance, the distance 475 between the edge 462 and the electronic assembly 470 may be less than 0.5 W or not greater than 0.4 W or not greater than 0.3 W or not greater than 0.2 W or not greater than 0.1 W, wherein W is a width across the belt in lateral direction. In another instance, the distance 475 from the edge 462 of the belt 460 to the electronic assembly 470 can be at least 0.05 W or at least 0.07 W or at least 0.09 W or at least 0.1 W or at least 0.15 W. Moreover, the distance 475 can be in a range including any of the minimum and maximum values noted herein.

In a further embodiment, the electronic assembly 470 can have a certain orientation that can facilitate improved performance of the electronic assembly or help to reduce likelihood of damaging the electronic assembly during operations utilizing the abrasive article. For example, as illustrated, the longitudinal axis 471 of the electronic assembly 470 can substantially aligned with a longitudinal axis 463 of the abrasive article 460. In another example, a lateral axis of the electronic assembly can be substantially aligned with the longitudinal axis of the abrasive article. In another instance, the longitudinal axis of the electronic assembly can be angled with respect to the longitudinal axis of the abrasive article.

Figure 4D:
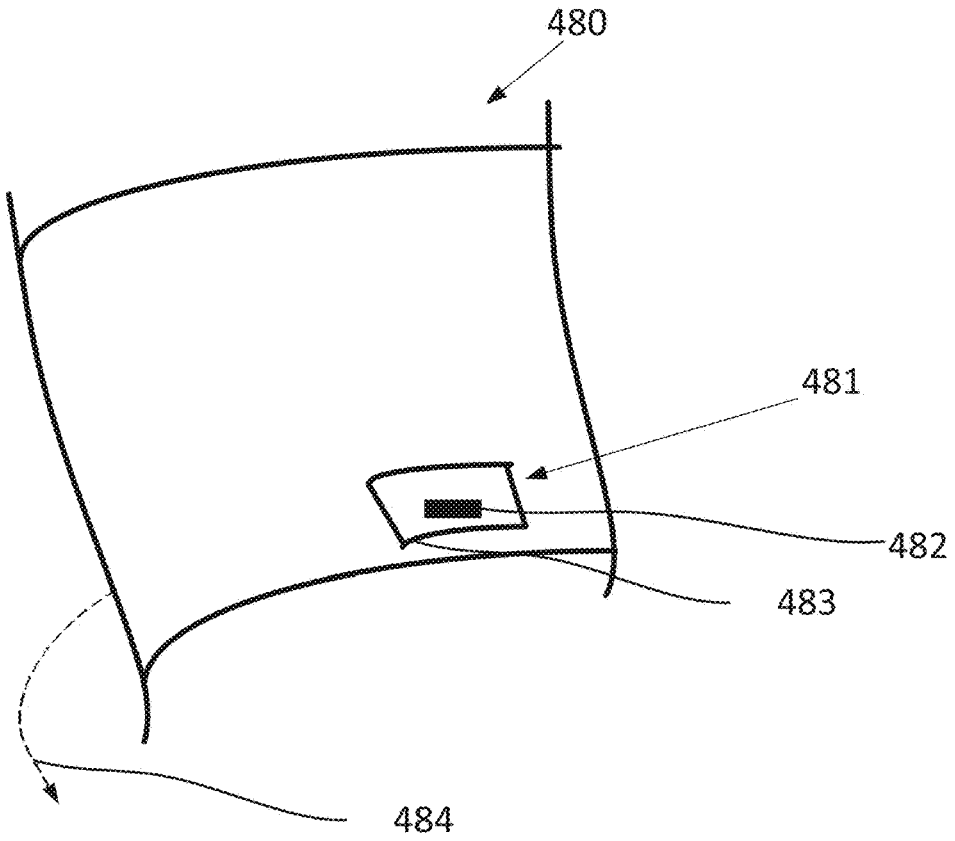
FIG. 4D includes an illustration of a portion of an abrasive article according to an embodiment.

As illustrated in FIG. 4D, the abrasive article 480 can have a curvature and a curvature axis 482. The electronic assembly 481 can include a package 483 and at least one electronic device 482. As illustrated, the electronic assembly 481 can also have a curvature, and in some particular instances, the curvature of the electronic assembly can be co-axial with the curvature of the abrasive article 480.

Figure 5:
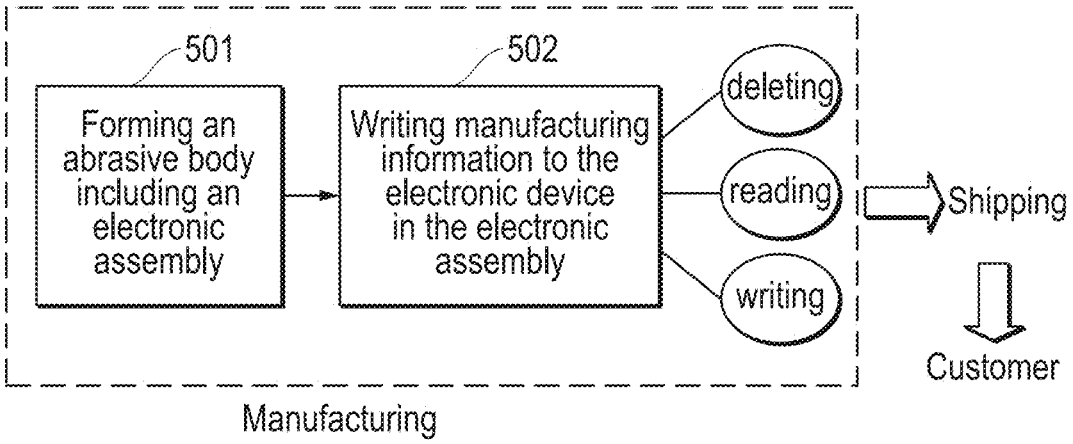
FIG. 5 includes a diagram of a supply chain and function of an abrasive article according to an embodiment.

FIG. 5 includes a diagram of a supply chain and function of an abrasive article according to an embodiment. The embodiments provided in FIG. 5 include examples of using an electronic assembly as part of an abrasive article, particularly as part of the manufacturing portion of the supply chain. As illustrated in the diagram of FIG. 5, the diagram includes forming an abrasive body including an electronic assembly at 501. Forming of the abrasive body can include any forming methods described in the embodiments herein.

After forming the abrasive body with the electronic assembly including the electronic device, the process can further include writing manufacturing information to the electronic device at 502. Writing information can be conducted during a write operation, wherein information can be written to and stored on the electronic device. Some suitable examples of manufacturing information can include processing information, manufacturing date, shipment information, product identification information or any combination thereof. In certain instances, processing information can include information pertaining to at least one processing condition used during forming of the abrasive body. Some suitable examples of processing information can include manufacturing machine data (e.g., machine identification, serial number, etc.) processing temperature, a processing pressure, processing time, processing atmosphere, or any combination thereof.

According to one embodiment, writing manufacturing information to the electronic device can occur during at least one process of forming the abrasive body. The process of forming can include any of the processes described herein, including for example, but not limited to, pressing, molding, casting, heating, curing, coating, cooling, stamping, drying, or any combination thereof. In certain instances, a machine conducting the forming process can conduct the writing operation and write the manufacturing information onto the electronic device. It will be appreciated that such manufacturing information can be processing information.

In an alternative embodiment, a sensor included in the electronic assembly can assist writing manufacturing information to the electronic device during forming of the abrasive body. The sensor may be configured to sense the conditions occurring during processing and write this information to an electronic device as manufacturing information. In still another embodiment, one or more other systems and/or individuals may write the one or more processing conditions used during the forming of the abrasive body as manufacturing information to the electronic device.

In an alternative embodiment, the process of writing manufacturing information to the electronic device can occur after forming the abrasive body. One or more systems and/or individuals may conduct a writing operation to write the manufacturing information on the electronic device after forming of the abrasive body.

In accordance with an embodiment, the manufacturing information stored on the electronic device may be utilized to conduct a quality control inspection of an abrasive article or a plurality of abrasive articles. Review of the manufacturing information, such as processing information, may assist with the identification of processing conditions and identification of abrasive articles that may not meeting a desired minimum quality rating.

After writing information to the electronic device, the one or more actions may be conducted using the manufacturing information. For example, in one embodiment, a system and/or individual may delete at least a portion of the manufacturing information prior to sending the abrasive article to a customer. It may be suitable to delete certain manufacturing information, such as certain processing information pertaining to aspects of forming the abrasive article.

In another embodiment, one or more write operations may be conducted to write information to the electronic device prior to sending the abrasive article to a customer. Such a writing operation may include storing customer information on the electronic device. The customer information may assist with the shipment and/or use of the abrasive article. Various types of customer information that can be included on the electronic device are described herein.

In another embodiment, a read operation may be conducted after writing information to the electronic device. For example, the read operation may read information from the electronic device prior to sending the abrasive article to a customer. Conducting a read operation may facilitate a quality inspection of the abrasive article and the information contained on the electronic device. Upon finalizing of the manufacturing operation, the abrasive article may be sent to shipping and thereafter sent to a customer for use of the abrasive article.

Figure 6:
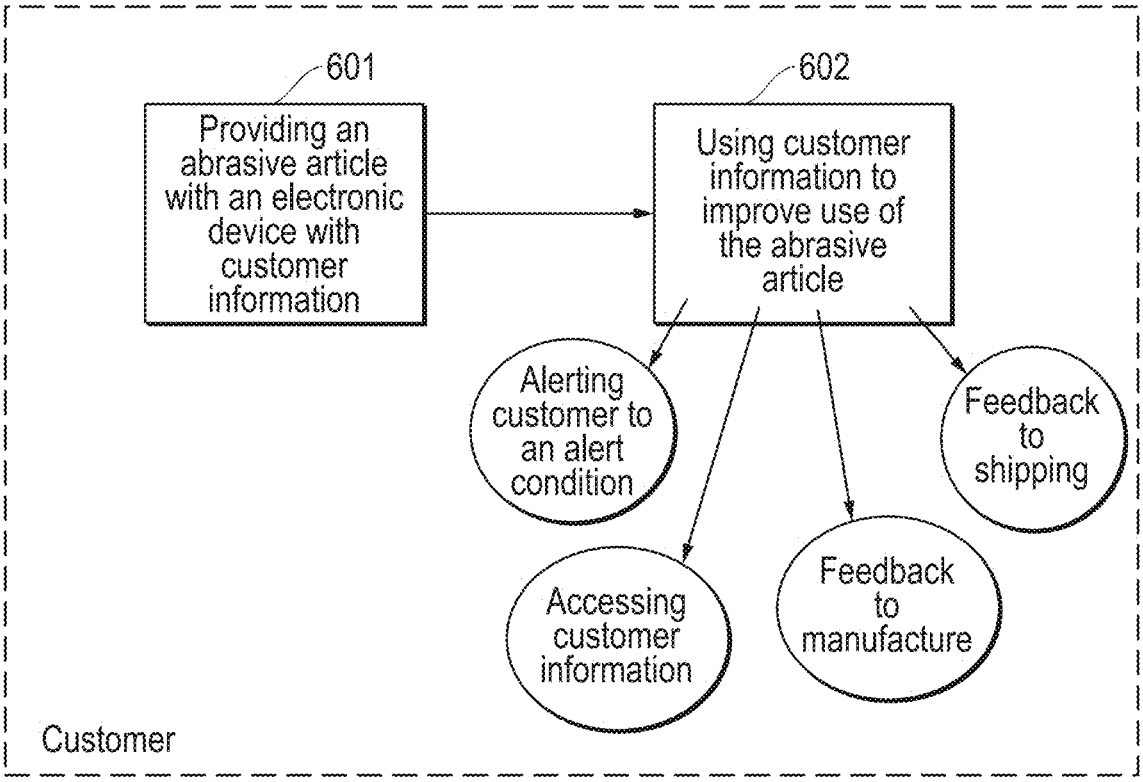
FIG. 6 includes a diagram of a supply chain and function of an abrasive article according to an embodiment.

FIG. 6 includes a diagram of a supply chain and function of the abrasive article according to an embodiment. As illustrated, the customer may obtain or be provided with an abrasive article including an electronic device. Depending upon the one or more electronic devices, the abrasive article may be supplied with customer information or alternatively, the customer may conduct a write operation to write certain customer information onto the electronic device. According to an embodiment, customer information can include information such as customer registration information, product identification information, product cost information, manufacturing date, shipment date, environmental information, use information, or any combination thereof. The customer information may be used to improve the use of the customer at 602. For example, the customer information may facilitate improved information exchange between the manufacturer and customer, and such feedback of information from the customer to the manufacturer may facilitate improved use of the abrasive article.

In one particular embodiment, customer information can include use information pertaining to suitable use conditions of the abrasive article. Accordingly, the customer may use the use information to ensure that the abrasive article is used under the proper operating conditions. Specific example of the use information can include, but is not limited to, minimum operating speed, maximum operating speed, burst speed, maximum power of the machine, maximum depth of cut, maximum down force, optimal wheel angle, and the like.

In still another embodiment the process of using customer information can include alerting one or more systems and/or individuals in the supply chain to a particular alert condition. Alert conditions may be based upon one or more pre-programmed thresholds, whereupon exceeding such a threshold, the electronic device can be configured to generate an alert signal. The alert signal can be any signal suitable to contact a system and/or individual in the supply chain, including any system and/or individual associated with manufacturing, shipping, and customers. According to one embodiment, the alert signal may be a sound, optical indicia, or a combination thereof intended to alert a user. In another embodiment, the alert signal may be an electronic communication sent to one or more remote systems or individuals. For example, the alert signal can be sent to a customer-registered device, a manufacturer-registered device, or any combination thereof. Some examples of customer-registered devices can include a customer-registered mobile device or a machine configured to use the abrasive article. In one embodiment the alert signal can be in the form of a text message to a customer-registered mobile device. In another embodiment the alert signal can be an electronic mail (i.e., email) communication to a customer-registered mobile device. A manufacturer-registered device can include for example a manufacturer-registered mobile device, or a manufacturer-registered computer system configured to monitor alert signals from various customers and associated abrasive articles.

In one embodiment, the alert condition can warn of potential damage to the abrasive article. The alert signal can be sent to a user, a system utilizing the abrasive article, and/or other systems and/or individuals in the supply chain of the abrasive article. According to a particular embodiment, the electronic device may include one or more sensors be configured to sense one or more operating conditions. When one of the operating conditions is exceeded, the sensors can communicate with one or more other electronic devices in the electronic assembly and create an alert condition. The alert condition can generate an alert signal that can be sent to one or more systems and/or individuals in the supply chain. In particular instance, the alert signal can be sent to the grinding machine using the abrasive article. The alert signal may be used by the grinding machine to change the operating conditions and eliminate the alert condition.

In another embodiment, the process of alerting the customer can include alerting the customer to alert condition associated with the age of the abrasive article. For example, the electronic device may include one or more timers, wherein after a programmed amount of time has elapsed without use of the abrasive article, the timer can generate an alert condition warning the customer of the age of the abrasive article. It will be appreciated that the other systems and/or individuals in the supply chain can be alerted.

According to another aspect, alerting the customer can include alerting the customer to an alert condition associated with one or more environmental conditions of the abrasive article. For example, in one embodiment, the electronic device can be coupled to a sensor configured to sense one or more environmental conditions. Some suitable examples of environmental conditions that may be sensed by the sensor can include, but is not limited to, the presence of a threshold amount of water vapor within the packaging of the abrasive article, the presence of a threshold amount of water vapor in the abrasive article, the temperature of the abrasive article, the pressure on the abrasive article, the presence of harmful chemicals in the packaging, the presence of harmful chemicals in the abrasive article, damage to the abrasive article, tampering, age of the abrasive article or any combination thereof. The sensors can be pre-programmed with suitable threshold values for certain environmental conditions. If any of the pre-programmed threshold values are exceeded, the sensor can communicate with an electronic device to generate an alert condition and send an alert signal. The alert signal can be sent to one or more systems and/or individuals in the supply chain.

In still another embodiment, alerting the customer can include alerting the customer and/or manufacturer to an alert condition associated with the shipment of the abrasive article. Such an alert signal may facilitate improved distribution and transfer of abrasive articles between a manufacturer and customer. For example, the electronic assembly may include a GPS, which may facilitate tracking of the abrasive article by a customer or manufacturer. Customer information may be used to provide feedback to other systems and/or individuals in the supply chain. For example, customer information may be used to provide feedback to systems and/or individuals associated with the shipping of abrasive articles between the manufacturer and customer. As noted herein, feedback of customer information may facilitate smoother and improved sales, distribution and/or transportation of abrasive articles to customers.

According to another aspect, customer information may be utilized to provide feedback to a manufacturer. For example, in one embodiment customer information such as product use information may be utilized and provided to a manufacturer to better understand conditions of use by customer for a given abrasive article. Such information may be valuable to a manufacturer to assist with providing a customer with optimized abrasive articles and or making suggestions for alternative use conditions or alternative abrasive products.

In another embodiment, the customer information may be used to facilitate future exchanges between the manufacturer and the customer. For example, one or more types of information, such as environmental information or customer information may be used to notify the manufacturer that the customer is in need of more abrasive articles. In one particular embodiment, the customer information may be used to alert the one or more systems or individuals in the supply chain, including for example, an alert to one or more website addresses, emails, and/or sales representatives of the manufacturer.

Figure 7A:
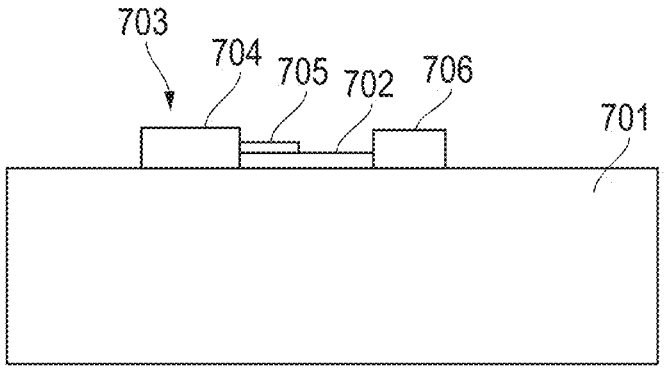
FIG. 7A includes a cross-sectional illustration of a portion of an abrasive article including a securing assembly according to an embodiment.

As illustrated in FIG. 7A, an electronic assembly 702 may be overlying and coupled to the body 701. While this illustration is showing the electronic assembly 702 as being in an overlying position relative to the body 701, it will be appreciated that the elements herein may be utilized with an electronic assembly in alternative positions, such as a partially embedded or fully embedded position within the body 701. It will be appreciated that reference herein to the body 701 will include an abrasive portion or non-abrasive portion of the body. As further illustrated in FIG. 7A, the abrasive article may include a securing assembly 703. The securing assembly 703 can be configured to facilitate releasable coupling of the electronic assembly 702 relative to the body 701. The securing assembly 703 may include one or more securing elements, such as a securing element 704, a securing element 705, and a securing element 706.

Figure 7B:
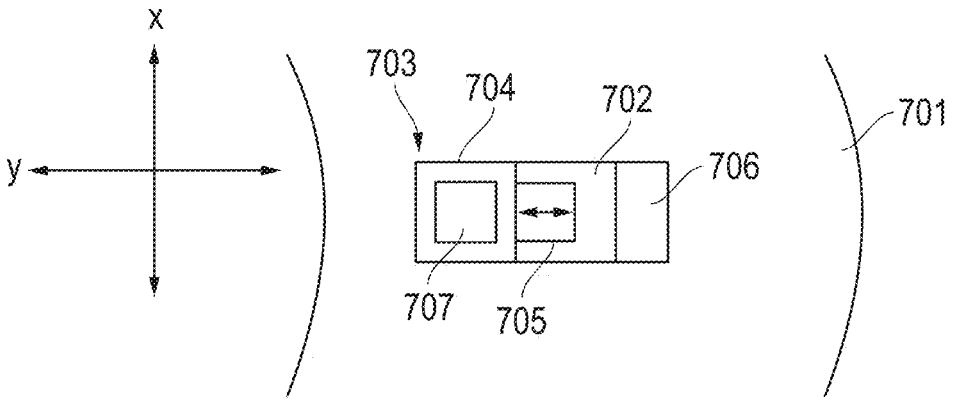
FIG. 7B includes a top-down view of the embodiment of FIG. 7A.

FIG. 7B includes a top-down illustration of the portion of the abrasive article of FIG. 7A. In particular instances, the securing assembly 703 can be configured for actuation of at least one of the securing elements (e.g., 705) relative to the electronic assembly 702. For example, the securing element 705 may be configured for movement between an engaged position and a disengaged position. In an engaged position, the securing element 705 can be overlying and engaging the electronic assembly 702, thus securing the electronic assembly 702 to the body 701. In a disengaged position, the securing element 705 may be moved to an alternative position, such as translated in the X-direction, Y-direction, and/or Z-direction (perpendicular to the plane defined by the X and Y directions). In the disengaged position, the securing element 705 may be spaced apart from and disengaged from the electronic assembly 702. In the disengaged position, the electronic assembly 702 is in a non-secure position and may be readily removed from the body 701. In such instances, removal of electronic assembly 702 from the body 701 may be accomplished without need for applying heat or other chemical additives to remove or dissolve an adhesive.

Figure 8A:
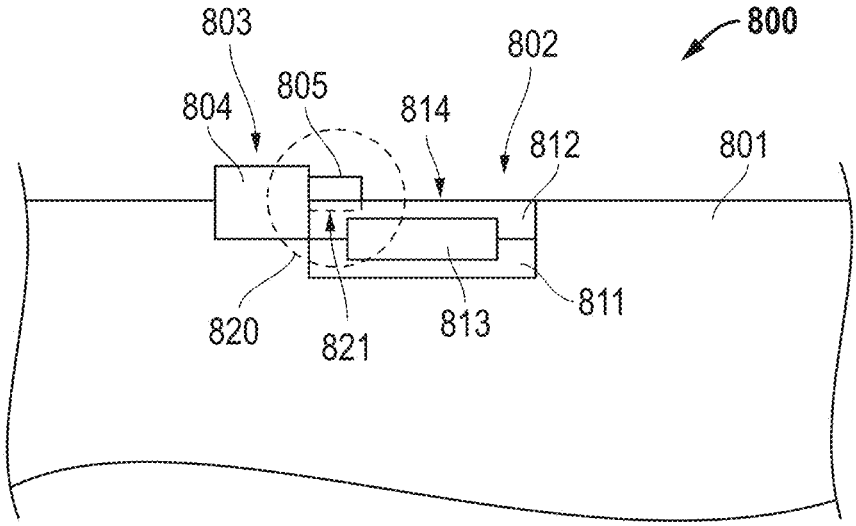
FIG. 8A includes a cross-sectional illustration of a portion of an abrasive article including a securing assembly according to an embodiment.

FIG. 8A includes a cross-sectional illustration of an abrasive article including an electronic assembly and a securing assembly according to one embodiment. As illustrated, the abrasive article 800 includes a body 801. The body 801 may be an abrasive portion or a non-abrasive portion. As further illustrated, the abrasive article 800 may include an electronic assembly 802 including a first portion 811, second portion 812, and one or more electronic devices 813 having any of the characteristics of corresponding components in other embodiments herein. The abrasive article 800 can include a securing assembly 803 including a complementary engagement structure 804 including at least one engagement element 805 coupled to the electronic assembly 802 and configured for complementary engagement with at least one receiving element 821. Further details of area 820 are provided in FIG. 8B. As illustrated, the at least one engagement element 805 may be configured for translation in the Y-direction such that it can move between an engaged position in a disengaged position. In the disengaged position, the at least one engagement element 805 may be spaced apart from the at least one receiving surface 821. The at least one receiving surface 821 can be in the form of a groove. The at least one engagement element 805 can be in the form of an extension that can be articulated into and out of the groove to move between the engaged position and disengaged position, respectively.

Figure 8B:
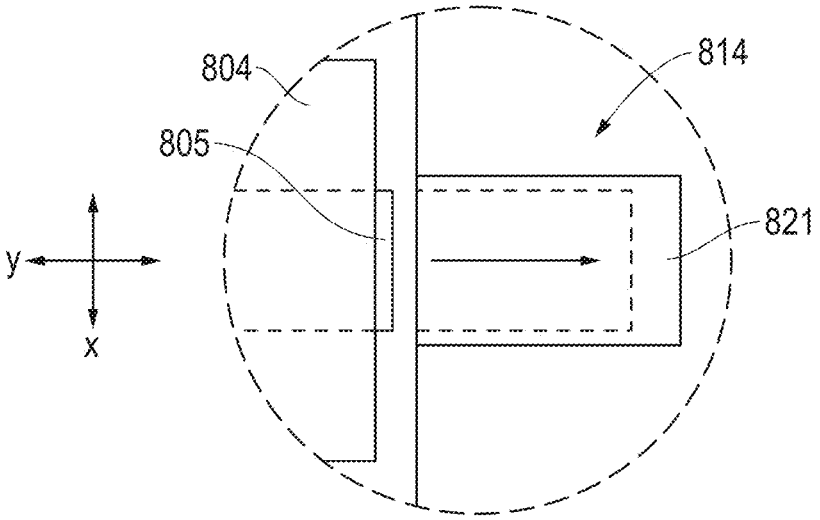
FIG. 8B includes a magnified illustration of a portion of the embodiment of FIG. 8A.

As further illustrated in FIG. 8B, the at least one receiving element 821 can be in the surface 814 of at least a portion of the electronic assembly 802, and more particularly, in the one of the portions forming the packaging. Notably, the at least one receiving element 821 can be in the surface 814 of the second portion 812 of the electronic assembly 802.

Any of the embodiments herein directed to systems to facilitate releasable coupling between the electronic assembly and at least a portion of the body may include one or more secure keying elements. For example, as illustrated in FIG. 7B, the securing element 704 can include a secure keying element. A secure keying element is an element allowing for selective removal of the electronic assembly 702 by only those programs and/or individuals with suitable credentials. Credentials can be presented in the form of encrypted data, a mechanical key, electronic identification device, biometric data, or any combination thereof. For example, in one embodiment the secure keying element 704 may be adapted to accept a key that can be engaged with a portion of the securing assembly 703 and used to facilitate the articulation of the securing element 705. It will be appreciated that one or more secure keying elements may also be configured to work with the complementary engagement structure of the embodiments of FIGS. 8A and 8B or any other embodiments herein.

In particular instances, the securing assembly can include at least one biometric security system. A biometric security system may be configured to identify particular aspects of individuals, thereby limiting and controlling the individuals who may access the electronic assembly 702 contained on the body 702 by the securing assembly 703. Some suitable examples of biometric security systems may be fingerprint identification systems, iris identification systems, facial recognition systems, and the like.

Figure 9A:
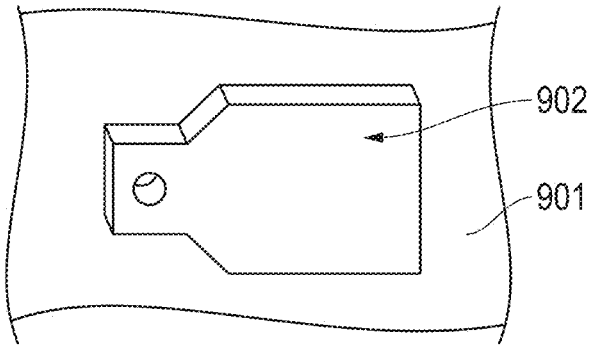
FIGS. 9A and 9B include perspective-view illustrations of a portion of a body of an abrasive article and a portion of an electronic assembly according to an embodiment.

FIG. 9A includes a perspective-view illustration of a portion of a body of an abrasive article according to an embodiment. In particular, the body 901 may have a securing assembly in the form of a shaped depression 902 in the surface of the body 901. The shaped depression 902 may be one part of a coupling connection configured to facilitate coupling between the body 901 and at least a portion of electronic assembly, and specifically, coupling of only electronic assemblies having a shape feature on a surface that is complementary to the shaped depression 902.

Figure 9B:
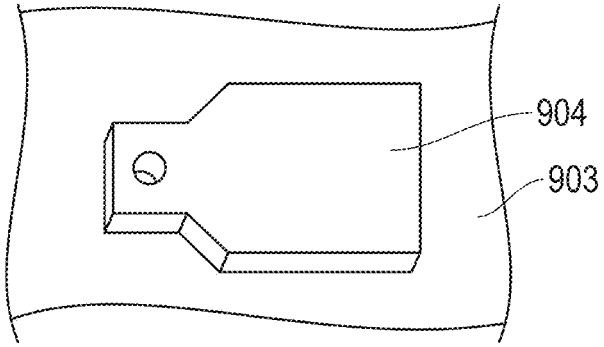

FIG. 9B includes a perspective-view illustration of a portion of an electronic assembly according to an embodiment. In particular, the electronic assembly 903 may have a shaped protrusion 904 that is complementary to the shaped depression 902 in the body 901. Accordingly, the shaped depression 902 and shaped protrusion 904 can be a type of coupling connection between the body 901 and electronic assembly 903 that may ensure use of the proper assembly with the appropriate abrasive article, preferred mounting placement and orientation of the electronic assembly on the body to improve data transmission.

Figure 10A:
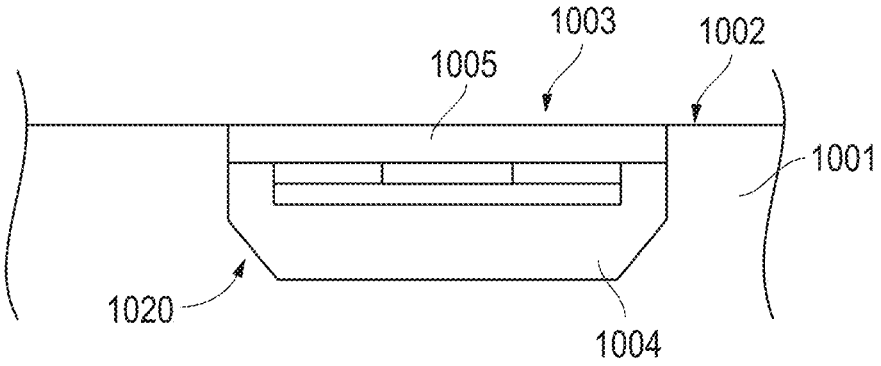
FIG. 10A includes a cross-sectional illustration of a portion of an abrasive article including a securing assembly according to an embodiment.

FIG. 10A includes a cross-sectional illustration of a portion of an abrasive article according to an embodiment. As illustrated, the body 1001 can have an upper surface 1002. The body 1001 may be an abrasive portion or a non-abrasive portion. The abrasive article includes an electronic assembly 1003 in a partially embedded configuration in the body 1001. The electronic assembly 1003 can include a first portion 1004 and a second portion 1005. More particularly, the electronic assembly 1003 can be contained within a cavity 1020 in the body 1001. The cavity may be sized and shaped to facilitate a releasable connection between the electronic assembly 1003 the body 1001. For example, the electronic assembly 1003 may be press fit into the cavity 1020 of the body 1001.

Figure 10B:
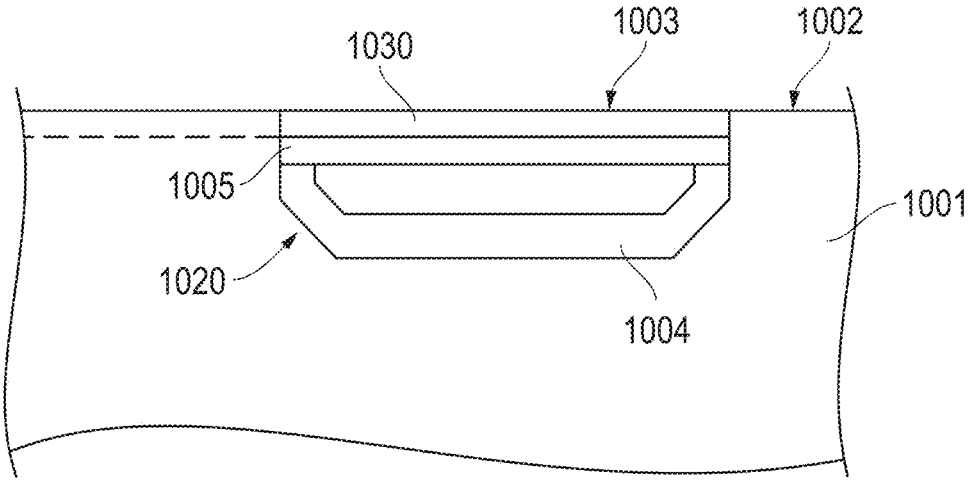
FIG. 10B includes a cross-sectional illustration of a portion of an abrasive article including a securing assembly according to an embodiment.
Figure 10C:
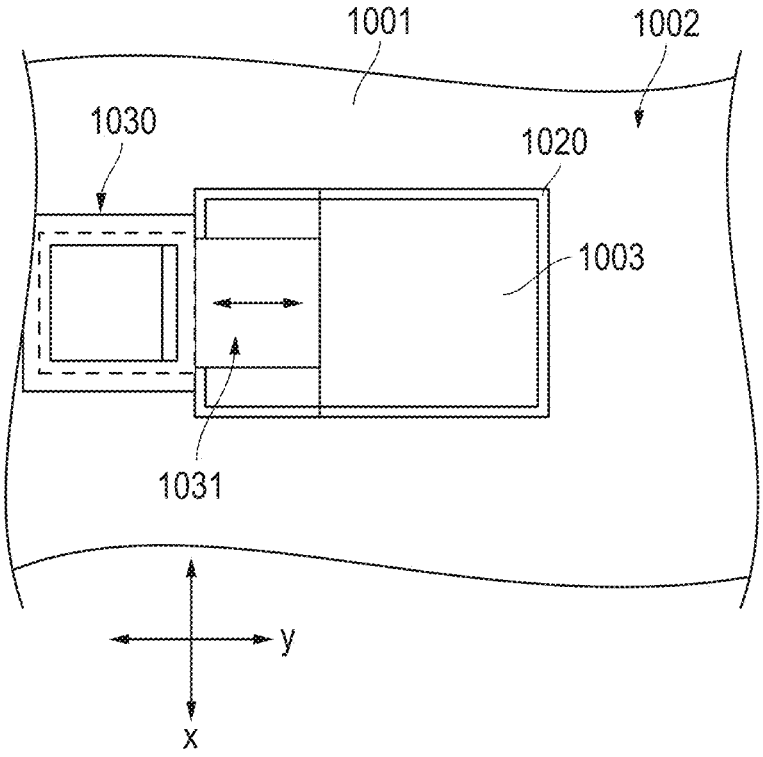
FIG. 10C includes a top-down illustration of the embodiment of FIG. 10B.

FIG. 10 B includes a cross-sectional illustration of a portion of an abrasive article according to an embodiment. FIG. 10C includes a top-down illustration of the embodiment of FIG. 10B. As illustrated, the body 1001 can include an upper surface 1002. An electronic assembly 1003 including a first portion 1004 and a second portion 1005 may be contained within a cavity 1020 in the body 1001. The electronic assembly 1003 may be press-fit in the cavity 1020. A securing assembly 1030 including a securing element 1031 may be configured to translate from and engage position to a disengaged position. In an engaged position, as illustrated in FIGS. 10B and 10C, the securing element 1031 can be overlying and engaging the electronic assembly 1003, thus securing the electronic assembly 1003 to the body 1001. In a disengaged position, the securing element 1031 may be spaced apart from and disengaged from the electronic assembly 1003. The securing element 1031 may articulate between the engaged position and the disengaged position by translating in the Y-direction. In the disengaged position, the electronic assembly 1003 is in a non-secure position and may be readily removed from the body 1003. In such instances, removal of electronic assembly 702 from the body 701 may be accomplished without need for applying heat or other chemical additives to remove or dissolve an adhesive.

Figure 11:
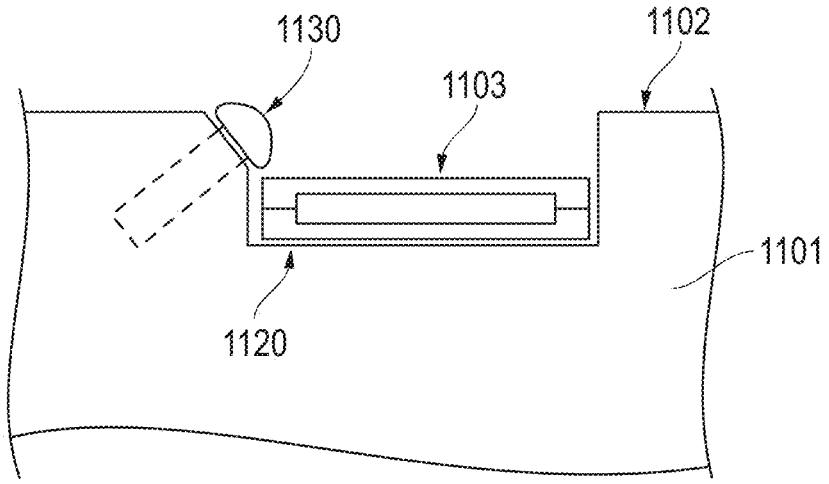
FIG. 11 includes a cross-sectional illustration of a portion of an abrasive article including a securing assembly according to an embodiment.

FIG. 11 includes a cross-sectional illustration of an abrasive article according to an embodiment. As illustrated, the body 1101 can include a surface 1102. The body 1101 may include an abrasive portion or a non-abrasive portion. An electronic assembly 1103 can be contained in a cavity 1120 within the body 1101. The cavity 1120 may include at least one fastener 1130 contained in, or at least partially contained in the cavity 1120. The fastener may be positioned and oriented relative to the electronic assembly 1103 to maintain the electronic assembly in the cavity 1120 as long as the faster is engaged with the body 1101. Thus, in an engage position, the faster 1130 is engaged with the body 1101 securing the electronic assembly 1103 in the cavity 1120. To remove the electronic assembly 1103 from the cavity 1120, the fastener 1130 must first be removed. While not illustrated, it will be appreciated that in alternative embodiments, the packaging of the electronic assembly 1103 may directly engage at least a portion of a fastener which may facilitate releasable engagement between the electronic assembly 1103 in the body 1101.

The foregoing embodiments provide various mechanisms to facilitate the releasable coupling between an electronic assembly and a body of an abrasive article. Such embodiments may facilitate selective removal of the electronic assembly from the body. Such embodiments may facilitate maintenance and replacement of an electronic assembly that may become damaged or need maintenance. Furthermore, such a releasable mechanism may facilitate an alternative way to access the electronic devices contained in the assembly. It will be appreciated that any of the embodiments herein and the elements of those securing assemblies may be used alone or in combination with each other. Furthermore, such assemblies may have certain advantages over conventional approaches, which may include only the use of adhesive to secure an abrasive and electronic assembly to a body.

Figure 12:
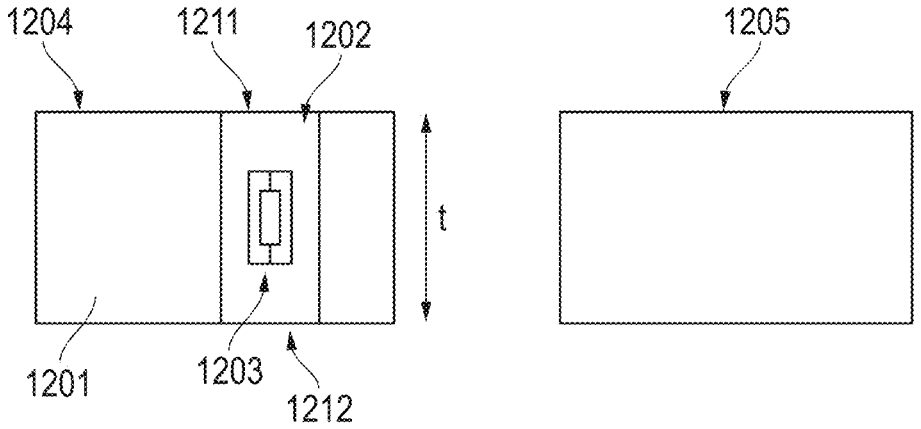
FIG. 12 includes a cross-sectional illustration of a portion of an abrasive article including a window according to an embodiment.

FIG. 12 includes a cross-sectional illustration of a portion of an abrasive article according to an embodiment. As illustrated, the abrasive article includes a body 1201. The body 1201 may be an abrasive or a non-abrasive portion. The body 1201 can include a window 1202 containing an electronic assembly 1203. The window 1202 may define a region of greater RF transmittance as compared to the body 1201. The RF electromagnetic radiation can have a frequency within a range including any of those frequencies noted in the embodiments herein. It may be desirable to secure the electronic assembly 1203 in a window. It may also be desirable to have one or more releasable connections between the window 1202 and the body 1201. The window 1202 may facilitate enhanced transmission and direction of transmission of signals of one or more wireless electromagnetic radiation signals from the electronic assembly 1203.

In accordance with an embodiment, the window can extend for a significant portion of the body 1201. For example, the window 1202 can extend through at least a portion of the body, more particularly through the entire thickness T of the body 1201.

In certain instances, the window 1202 may be selectively removable from the body 1201. For example, the window may be releasably coupled to the body 1201 by a coupling mechanism such as a keyed assembly, a complementary engagement structure, a threaded connection, a fastener, a snap-fit element, a clip, an adhesive, a tapered-fit connection, or any combination thereof. In certain instances, the window 1202 and electronic assembly 1203 may be a monolithic construction. In such instances, the electronic assembly 1203 can be permanently secured in the body of the window 1202 such that the electronic assembly 1203 may not be removed from the window 1202 without permanently damaging the electronic assembly 1203 and the window 1202. Still, in another non-limiting embodiment, the window 1202 and electronic assembly 1203 may be a modular construction. For example, the electronic assembly 1203 can be releasably coupled within the body of the window 1202. For example, the window 1202 may be made of two or more components that can be separated from each other to facilitate the removal of the electronic assembly 1203 from the interior of the body of the window 1202.

The window 1202 may include one or more elements that facilitate the control of the direction of electromagnetic radiation emitted from the electronic assembly 1203. For example, the window may include one or more devices contained within its body to facilitate the direction of electromagnetic radiation from the terminal ends 1211 and 1212 of the window 1202. It will be appreciated that devices utilized to control the direction of electromagnetic radiation will control the direction based upon the orientation of the window 1202 relative to the body 1201. It will be appreciated that various possible orientations may be utilized. Furthermore, some suitable examples of elements that may facilitate control electromagnetic radiation may include a coating on an exterior surface of the window 1202. The coating may act as a grating. In another embodiment, the window 1202 may have one or more surface features that may facilitate the direction of electromagnetic radiation within the window 1202. For example, in one embodiment, the surface features on the window 1202 may act as a grating to control the direction of electromagnetic radiation through the body of the window 1202.

In certain instances, the window 1202 may include one or more particular types and arrangements of materials that may facilitate directional controlled RF electromagnetic radiation through the body of window 1202. For example, the body may include two or more concentrically arranged layers of different materials to control the transmission of RF frequency electromagnetic radiation within the window 1202.

In certain instances, the window 1202 may be made of an organic material. For example, the window 1202 may include at least one of a biopolymer, a conductive polymer, a copolymer, a fluoropolymer, a polyterpene, a phenolic resin, a polyanhydrides, a polyketone, a polyester, a polyolefin, a rubber, a silicone, a silicone rubber, a vinyl polymer or any combination thereof.

FIG. 13 includes an illustration of an abrasive system according to an embodiment. The abrasive system 1300 can include a housing 1301, a body 1303 contained within the housing 1301, and an electronic assembly 1304 coupled to the body 1303. In particular instances, the housing 1301 may include metal, more particularly, may be a metal or metal alloy. In certain instances, the housing 1301 may include a transition metal element. The metal of the housing 1301 may include iron, copper, nickel, silver, aluminum, cobalt, or any combination thereof.

As illustrated in FIG. 13, the housing 1301 may partially surround at least a portion of the body 1303. Certain material removal operations rely upon enclosing at least a portion of the body 1303 in a housing 1301 to improve the grinding operation and provide a safe environment. In certain instances, the housing 1301 may limit proper communication between devices configured to communicate with each other via wireless RF frequencies.

The housing 1301 can define a receiving space where at least a portion of the body 1303 and the electronic assembly 1304 may be disposed during a material removal operation. The degree to which the housing surrounds the body 1303 and the electronic assembly 1304 may vary from system-to-system, however it has been observed that housings of a relatively small degree can significantly interrupt wireless communication.

In accordance with one aspect, the housing 1301 may include an electronic device 1305. The electronic device 1305 can include any electronic device as defined in other embodiments herein. For example, the electronic device 1305 may include from the group of an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof. In at least one embodiment, the electronic device can be configured to communicate with the electronic assembly 1304 and or the electronic device 1307 via wireless communication 1306 using known RF communication protocols. For example, the electronic device 1305 may include an antenna. More particularly, the electronic device 1305 may include a booster antenna configured to transmit one or more signals from the electronic assembly 1304 to the electronic device 1307. The electronic device 1305 may be securely connected to the housing, such as integrated within the housing 1305. Alternatively, the electronic device 1305 can be releasably coupled to the housing 1305, which may include any one or a combination of securing assemblies described in embodiments herein to couple the electronic device 1305 to the housing 1301.

The use of one or more electronic devices 1305 on or within the housing 1301 may facilitate and improve communication range of the system 1300. For example, the system 1300 may have a minimum effective communication range of at least 0.01 meters or at least 0.02 meters or at least 0.04 meters or at least 0.06 meters or at least 0.08 meters or at least 0.1 meters or at least 0.2 meters or at least 0.3 meters or at least 0.4 meters or at least 0.5 meters or at least 0.6 meters or at least 0.7 meters or at least 0.8 meters or at least 0.9 meters or at least 1 meter or at least 1.2 meters or at least 1.4 meters or at least 1.6 meters or at least 1.8 meters or at least 2 meters or at least 2.2 meters or at least 2.4 meters or at least 2.6 meters or at least 2.8 meters or at least 3 meters or at least 3.2 meters or at least 3.4 meters or at least 3.6 meters or at least 3.8 meters or at least 4 meters or at least 5 meters or at least 6 meters or at least 7 meters or at least 8 meters or at least 9 meters or at least 10 meters. In another aspect, the system 1300 may have a minimum data transmission rate of at 4 kbps or at least 8 kbps or at least 10 kbps or at least 15 kbps or at least 20 kbps or at least 40 kbps or at least 60 kbps or at least 80 kbps or at least 100 kbps or at least 150 kbps or at least 200 kbps or at least 250 kbps or at least 300 kbps or at least 400 kbps or at least 500 kbps or at least 600 kbps. In still other instances, the system may have a maximum loss of not more than 50 dB [absolute value] over a range of frequencies of at least 3 kHz to not greater than 300 GHz.

In certain instances, one or more electronic devices such as the electronic device 1307, 1305 or 1304 may include a vertically polarized antenna, 3D polarized antenna, booster atenna, or any combination. For example, one particular embodiment the electronic device 1305 may include a booster antenna which may not necessarily include any on-chip or off chip logic components, and configured simply to relay transmissions from the electronic assembly 1304 to the electronic device 1307.

Figure 13A:
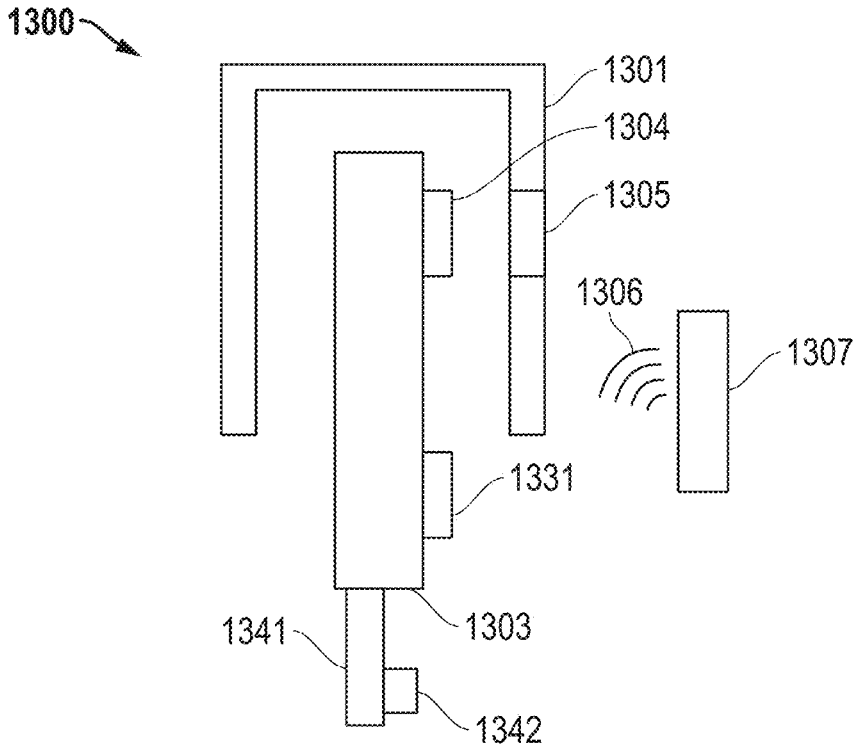
FIGS. 13A and 13B include abrasive systems according to an embodiment.

As further illustrated in FIG. 13A, the system 1300 may include a plurality of electronic assemblies, including a first electronic assembly 1304 and a second electronic assembly 1331. Each of the electronic assemblies 1304 and 1331 may contain one or more electronic devices. The electronic assemblies 1304 and 1331 may be spaced apart and distributed around the body 1303 relative to each other. As with any of the embodiments herein, the electronic assemblies 1304 and 1331 may be on an abrasive portion or non-abrasive portion, and furthermore, may be coupled to a surface, partially embedded or fully embedded in any portion of the body 1303. The electronic assembly 1331 may communicate wirelessly with the electronic assembly 1304, electronic devices 1305 and/or 1307 directly or indirectly.

A workpiece may be moved relative to the body 1303 to conduct a material removal operation. It will be appreciated that alternative orientations between the workpiece 1341 and the body 1303 can be used depending upon the type and nature of the material removal operation. In one particular embodiment, the workpiece 1341 can include an electronic device 1342 that can be coupled to the body of the workpiece 1341. The electronic device 1342 on a workpiece can be used with any of the other embodiments herein. The electronic device 1342 may be configured to communicate with any communication devices of the abrasive system 1300, including for example, the electronic assembly 1304, the electronic device 1305, and/or the electronic device 1307.

The electronic device 1307 may include one or more logic components (e.g., processor) and/or data storage components (e.g., RAM and/or ROM) configured to store data from the electronic assemblies 1304 and 1331 and the electronic devices 1305 and 1342. In certain instances, it may be suitable that the electronic device 1307 compare the data to or more of the electronic devices, analyze such data, and make or suggested changes to the material removal operation. Such changes may be automated or may be presented to a controller, such as an individual, for confirmation of any suggested changes.

Figure 13B:
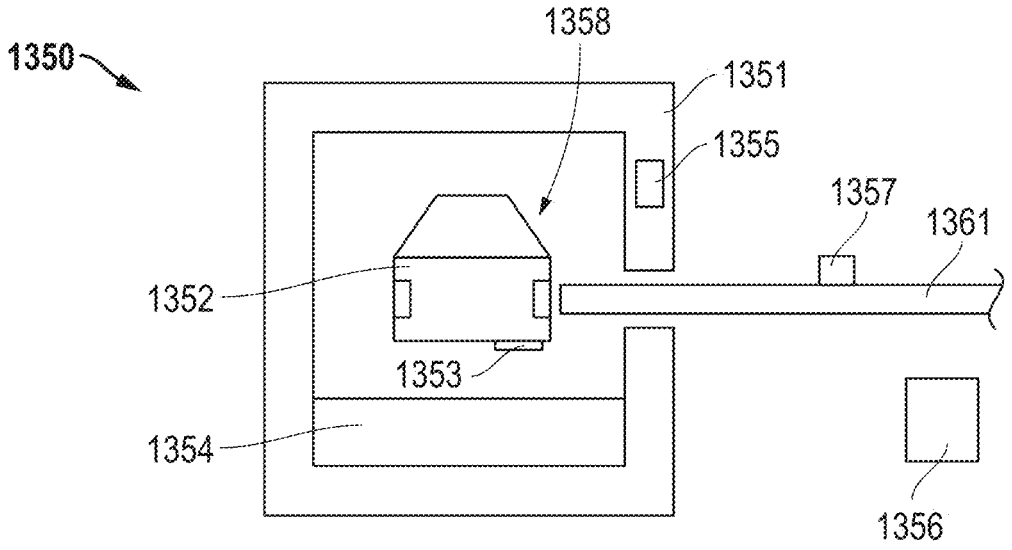

FIG. 13B includes an abrasive system including a housing 1351 and a body 1352 contained within the housing 1351. The body 1352 may include an electronic assembly 1353 coupled to the body 1352. The body 1352, as illustrated, may be a particular type of edge grinding tool, wherein the workpiece 1361 may be a piece of glass. The housing 1351 may further include coolant 1354 that is applied to the grinding interface during a material removal operation. In one embodiment the housing 1351 may include at least one electronic device 1355. The at least one electronic device 1355 can be coupled to a surface or embedded in the material of the housing 1351. The electronic assembly 1353 includes one or more electronic devices configured to communicate with the one or more electronic devices 1355 in the housing 1351. Information received by the electronic device 1355 may be related to a remote electronic device 1356 which is positioned outside of the housing 1351.

As further illustrated, the workpiece 1361 may include one or more electronic devices 1357 coupled to the workpiece 1361 and configured to transmit and/or receive information from one of the other electronic devices, such as the electronic assembly 1353, the electronic device 1355, and/or the electronic device 1356. In particular instances, it may be suitable that the electronic assembly 1353 include a protective layer configured to protect against corrosive effects of the coolant 1354.

In an alternative embodiment, the electronic assembly 1353 may also be coupled to, partially embedded, or fully embedded, in a surface 1358 of the body 1352. The placement and position of the electronic assembly may facilitate improved communication with the electronic devices 1355, 1356, and/or 1361. Moreover, in certain instances, of the electronic devices 1355, 1356, 1361 and/or electronic assembly 1353 may utilize a vertically polarized antenna, booster antenna, 3D polarized antenna, or any combination thereof. It will also be appreciated that in certain instances, it may be suitable to use a plurality of electronic assemblies located at different positions and orientations on the body 1352.

Figure 14A:
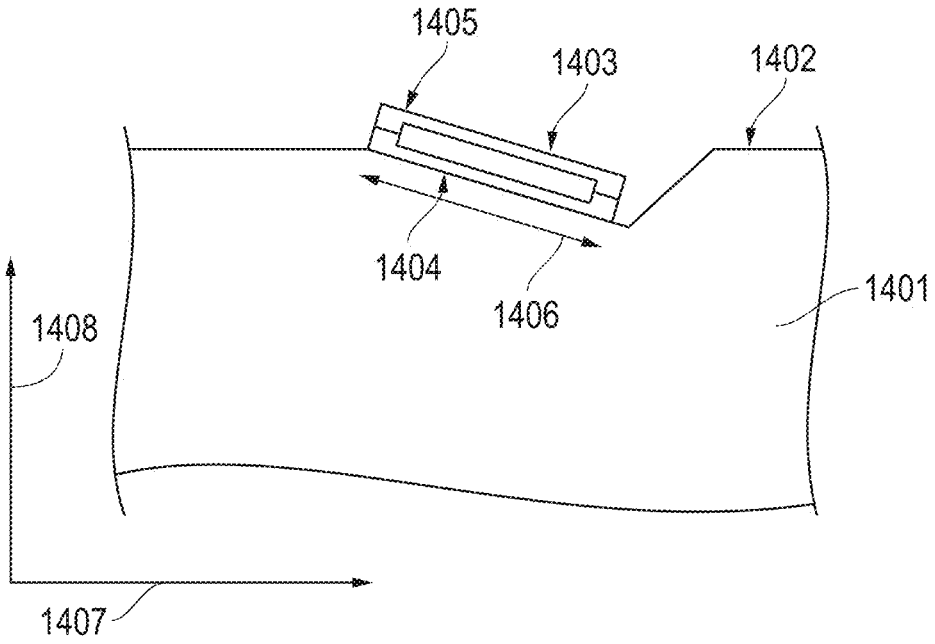
FIGS. 14A and 14B include cross-sectional illustrations of portions of abrasive articles according to embodiments.
Figure 14B:
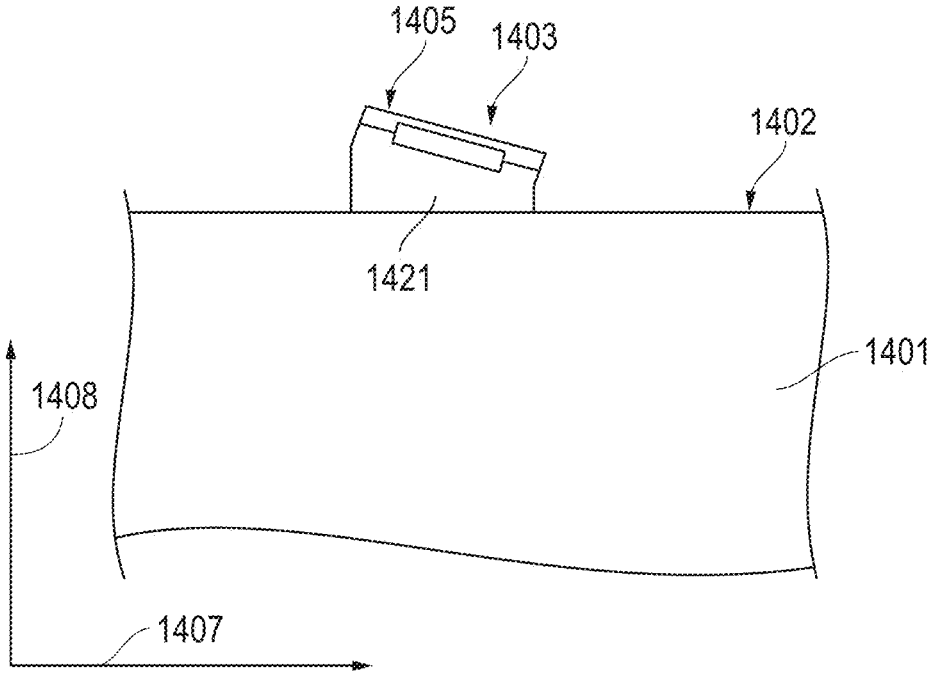

FIGS. 14A and 14B include cross-sectional illustrations of a portion of an abrasive article according to an embodiment. The electronic assembly 1403 can be coupled to an exterior surface 1402 in a non-parallel configuration relative to the exterior surface of the body 1401. In certain instances, the electronic assembly 1403 may have a longitudinal axis 1406 that is not parallel to either the radial axis 1407 and/or the axial axis 1408 of the body 1401. As illustrated in FIG. 14A, the electronic assembly 1403 can be contained in a cavity 1405 of the body 1401. The cavity 1405 can have a lower surface oriented in a non-parallel configuration relative to another portion of the exterior surface 1402 of the body 1401. The lower surface may be oriented in a non-parallel configuration relative to the radial axis 1407 and/or the longitudinal axis 1408 of the body 1401.

The lower surface 1404 may be a mounting surface configured to receive at least a portion of the electronic assembly 1403 thereon. The mounting surface can be angled to facilitate tilting of the electronic assembly 1403 in a preferred orientation to improve transmission of data from the one or more electronic devices in the electronic assembly. In FIG. 14B, the electronic assembly 1403 includes a first portion having a particular shape that facilitates tilting of the electronic assembly 1403 relative to the radial axis 1407 and/or the longitudinal axis 1408 of the body 1401.

Figure 15:
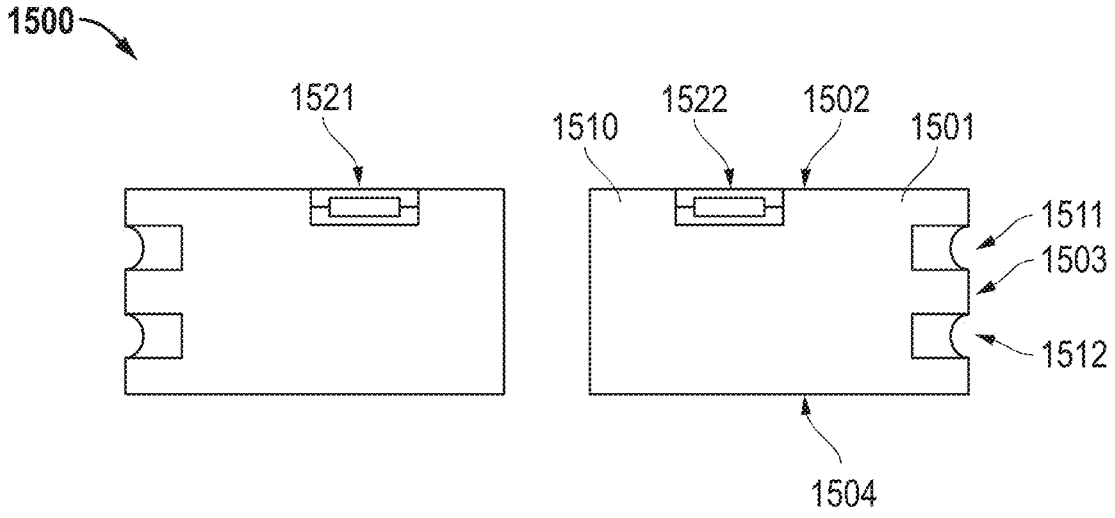
FIG. 15 includes a cross-sectional illustration of a portion of an abrasive article according to an embodiment.

FIG. 15A includes a cross-sectional illustration of a portion of an abrasive article according to an embodiment. The abrasive article 1500 includes a body 1501, which is primarily a core (i.e., non-abrasive portion) of the body 1501. In the peripheral side 1503 of the body 1501, between surfaces 1502 and 1504, are grooves containing abrasive portions 1511 and 1512 including abrasive particles and bond material. During use, the abrasive portions 1511 and 1512 become warm and need to be dressed, replenished, and/or re-profiled many times throughout the life of the abrasive article 1500. In particular instances, data related to the number of dressing operations, replenishing operations, and/or re-profiling operations may be stored on one or more of the electronic assemblies 1521 and 1522. Such information may be made available to only the manufacturer. Alternatively, such information may be accessible by the customer or the manufacturer.

Notably, investigation into utilization of certain electronic assemblies in the context of real-world material removal operations has shown that certain types of conventionally available electronic devices may not be satisfactory. Accordingly, the embodiments herein address certain issues identified in the use of conventional technologies to make notable strides in the application and deployment of electronic assemblies and electronic devices in real-world grinding operations.

Figure 16:
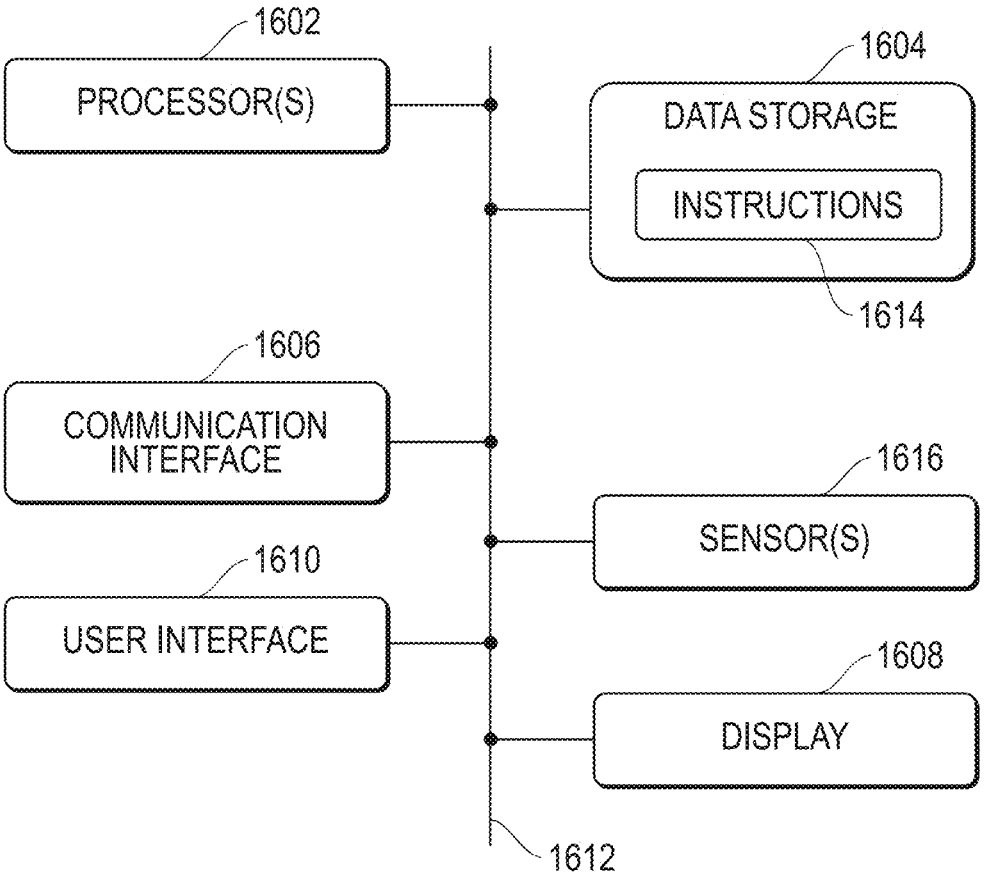
FIG. 16 illustrates a block diagram of an electronic assembly according to an example embodiment.

FIG. 16 illustrates a block diagram of an electronic assembly according to one embodiment. The electronic assembly may include one or more sensors 1616 for collecting data, a data storage 1604, which may store the collected data and may include instructions 1614, one or more processor(s) 1602, a communication interface 1606 for communicating with a remote source (e.g., a server or another device/sensor), and a display 1606. Additionally, the electronic assembly may include one or more electronic devices, such as, but not limited to, an audio output device (e.g., a speaker) and a haptic feedback device (e.g., an eccentric rotating mass (ERM) actuator, linear resonant actuator (LRA), or piezoelectric actuators, among other examples).

The one or more sensors 1616 may be configured to collect data in real-time from or associated with an environment of the electronic assembly. Real-time collection of data may involve the sensors periodically or continuously collecting data. For example, the one or more sensors 1616 may include a sound detection device (e.g., a microphone) that is configured to detect sound in the environment of the sensor (e.g., from an abrasive tool operating in proximity of the sensor). Additionally, and/or alternatively, the sensors 1616 may be configured to collect data from or associated with an operator of the electronic assembly. For example, the one or more sensors 1616 may include an accelerometer (e.g., a tri-axis accelerometer) that is configured to measure acceleration of the operator (e.g., acceleration of a hand of the operator on which the electronic assembly is mounted). As described herein, the data collected by the one or more sensors 1616 may be used to determine abrasive operational data, which could then be used for obtaining real-time data about grinding/abrasive operations, capturing a user experience of a user that is using the tool, and/or determining operational and/or or enterprise improvements (e.g., based on data collected over a period of time).

The one or more sensors 1616 may also include other sensors for detecting movement, such IMUs and gyroscopes. Further, the one or more sensors 1616 may include other types of sensors such as location-tracking sensors (e.g., a GPS or other positioning device), light intensity sensors, thermometers, clocks, force sensors, pressure sensors, photo-sensors, Hall sensors, vibration sensors, sound-pressure sensors, a magnetometer, an infrared sensor, cameras, and piezo sensors, among other examples. These sensors and their components may be miniaturized so that the electronic assembly may be worn on the body without significantly interfering with the wearer's usual activities.

The processor 1602 may be configured to control the one or more sensors 1616 based, at least in part, on the instructions 1614. As will be explained below, the instructions 1614 may be for collecting real-time data. Further, the processor 1602 may be configured to process the real-time data collected by the one or more sensors 1616. Yet further, the processor 1602 may be configured to convert the data into information indicative of the behavior of an abrasive tool or the user experience of the user using the tool.

The data storage 1604 is a non-transitory computer-readable medium that can include, without limitation, magnetic disks, optical disks, organic memory, and/or any other volatile (e.g. RAM) or non-volatile (e.g. ROM) storage system readable by the processor 1602. The data storage 1604 can include a data storage to store indications of data, such as sensor readings, program settings (e.g., to adjust behavior of the electronic assembly), user inputs (e.g., from a user interface on the device 1600 or communicated from a remote device), etc. The data storage 1604 can also include program instructions 1614 for execution by the processor 1602 to cause the device 1600 to perform operations specified by the instructions. The operations could include any of the methods described herein. As illustrated, all devices can be electrically connected by at least one bus 1612.

The communication interface 1606 can include hardware to enable communication within the electronic assembly and/or between the electronic assembly and one or more other devices. The hardware can include transmitters, receivers, and antennas, for example. The communication interface 1606 can be configured to facilitate communication with one or more other devices, in accordance with one or more wired or wireless communication protocols. For example, the communication interface 1606 can be configured to facilitate wireless data communication for the electronic assembly according to one or more wireless communication standards, such as one or more IEEE 801.11 standards, ZigBee standards, Bluetooth standards, etc. For instance, the communication interface 1606 could include WiFi connectivity and access to cloud computing and/or cloud storage capabilities. As another example, the communication interface 1606 can be configured to facilitate wired data communication with one or more other devices.

The display 1608 can be any type of display component configured to display data. As one example, the display 1608 can include a touchscreen display. As another example, the display 1608 can include a flat-panel display, such as a liquid-crystal display (LCD) or a light-emitting diode (LED) display.

The user interface 1610 can include one or more pieces of hardware used to provide data and control signals to the electronic assembly. For instance, the user interface 1610 can include a mouse or a pointing device, a keyboard or a keypad, a microphone, a touchpad, or a touchscreen, among other possible types of user input devices. Generally, the user interface 1610 can enable an operator to interact with a graphical user interface (GUI) provided by the electronic assembly (e.g., displayed by the display 1608). As an example, the user interface 1610 may allow an operator to provide an input indicative of a task to be performed by the operator. As another example, the operator may provide an input indicative of a tool to be used to perform the operation and/or an input indicative of a workpiece on which the operator may perform the abrasive operation.

Figure 17:
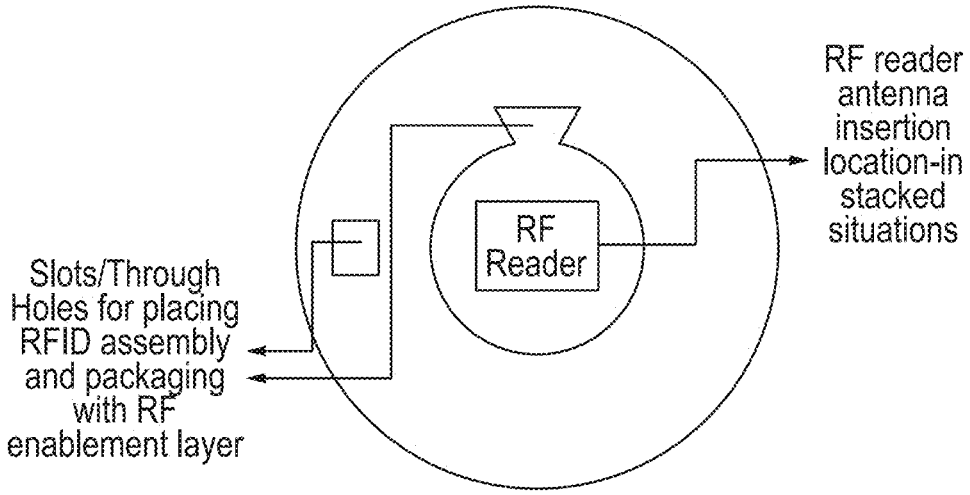
FIG. 17 includes a top-down illustration of an abrasive article according to an embodiment.

FIG. 17 includes a top-down illustration of an abrasive article according to an embodiment. In some instances, a plurality of abrasive articles, such as grinding wheels may be stacked on top of one another, particularly in storage. Applicants of the present disclosure have found that the position of one or more electronic assemblies on the body of the abrasive article may impact the ability to identify and distinguish one or more abrasive articles from a plurality of abrasive articles. This may be particularly true when a plurality of abrasive articles are stored, such as a stack configuration, as illustrated in FIG. 17. Each abrasive article in the stack may have one or more electronic assemblies including electronic devices, such as a RFID device. Such devices may be contained in particular locations on the bodies of the abrasive articles. In one embodiment, one may utilize an elongated RF reader that may extend through the central annular openings of the plurality of cylindrical shaped abrasive articles stacked on one another, which may facilitate reading and identification of each of the abrasive articles in the stack.

In at least one embodiment, the RF reader may include other electronic devices that may be continuously gathering data from one or more sensors in the electronic assemblies of the plurality of electronic devices. As such, the RF reader may include logic that is configured to transmit one or more data signals to one or more remote devices (e.g., cloud-based server, mobile device, etc.). Such data may include status indications of the one or more abrasive articles. For example, the RF reader may have logic configured to relay an alert signal if one or more unfavorable conditions are sensed by any of the sensors in any of the electronic assemblies of the plurality of abrasive articles.

Figure 18:
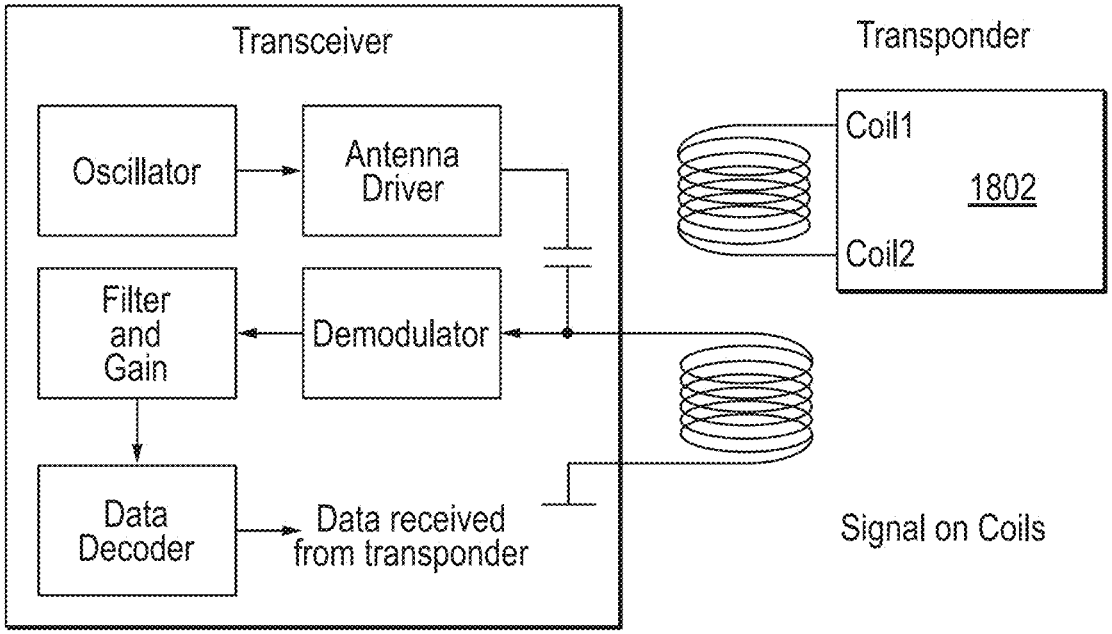
FIG. 18 includes a schematic illustration of a transceiver and transponder that may be used in an abrasive system or abrasive article of the embodiments herein.

FIG. 18 includes a schematic illustration of a transceiver and transponder that may be used in an abrasive system or abrasive article of the embodiments herein. As illustrated, the transceiver can include a data decoder, filter and gain element, demodulator, antenna driver, and oscillator. The transceiver can be any electronic device of the embodiments herein, including part of an electronic assembly attached to an abrasive article. The transceiver can further include an antenna 1801 coupled to the antenna driver and the demodulator. It will be appreciated that other arrangements of similarly functioning elements may be utilized without departing from the scope of embodiments herein. The transponder 1802 may be a booster antenna that can be configured to communicate with the transceiver, such by relaying information via antenna 1803 and 1801.

Figure 19A:
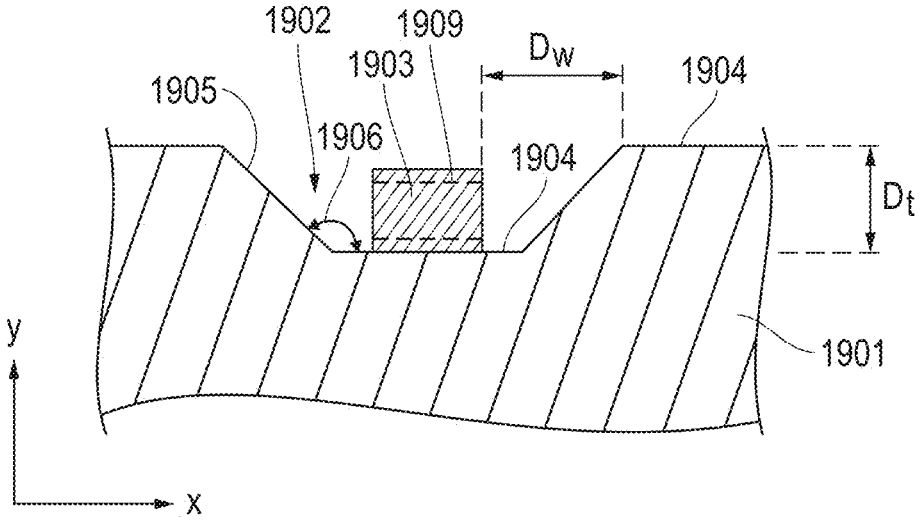
FIG. 19A includes a cross-sectional illustration of a portion of an abrasive article including a cavity according to one embodiment.

FIG. 19A illustrates an embodiment of an abrasive article wherein the abrasive article can comprise a body 1901 including a cavity 1902. The cavity may be designed that it can provide a suitable space for coupling an electronic assembly 1903 to the body 1901. In one aspect, the electronic assembly 1903 is positioned in the center of the bottom surface cavity of the body. The cavity can extend from an exterior surface 1904 of the body 1901 in an orthogonal direction (y-direction) within the body relative to the exterior surface (x-direction). In a particular aspect, the abrasive article can be an abrasive wheel containing the cavity at a non-abrasive section.

It has been observed that for an enhanced performance of the electronic device, the ratio of Dw/Dt can be a parameter that influences the read distance of the electronic device, with Dw being the distance between the electronic assembly and the wall and Dt being the distance of the of the depth of the cavity, from an exterior surface of the cavity to the bottom surface of the cavity. As used herein, the ratio of Dw/Dt is also called "spacing factor." In one aspect, the spacing factor can be at least 0.65, or at least 0.7, or at least 0.8 or at least 0.9 or at least 1 or at least 1.1 at least 1.2 or at least 1.5 or at least 1.7 or at least 2 or at least 3 or at least 5. In another aspect, the spacing factor may be not greater than 20, or not greater than 15, or not greater than 10, or not greater than 5. The spacing factor can be a value within any of the minimum and maximum values noted above.

Figure 19B:
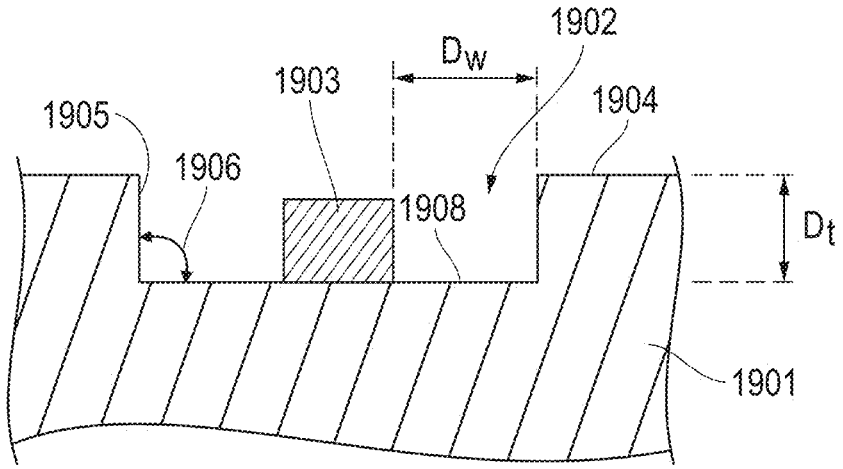
FIG. 19B includes a cross-sectional illustration of a portion of an abrasive article including a cavity according to one embodiment.

In a particular aspect, the wall 1905 of the cavity can have an angle 1906 of at least 100 degrees relative to the bottom surface of the cavity 1908, such as at least 110 degrees, at least 115 degrees, or at least 120 degrees. In another aspect, the angle 1906 of the wall 1905 can be not greater than 170 degrees or not greater than 160, or not greater than 150 degrees, or not greater than 145 degrees, or not greater than 140 degrees, or not greater than 130 degrees, or not greater than 120 degrees. The angle of the wall can be a value between any of the minimum and maximum values noted above. In another particular aspect, the wall 1905 of the cavity 1902 can have an angle of 90 degrees, the angle 1905 being orthogonal to the bottom surface 1908 of the cavity, as illustrated in FIG. 19B.

In a further embodiment, the electronic device contained within the electronic assembly can be positioned in the cavity such that an outer surface of the device 1909 may be at least 1 mm below a level of the exterior surface of the body 1904, such as at least 2 mm, at least 3 mm, at least 3.5 mm, at least 4 mm, at least 5 mm. In another aspect, an the electronic assembly 1903 may be positioned within the cavity that the complete electronic assembly is at least 1 mm below a level of the exterior surface of the body, such as at least 2 mm, at least 3 mm, at least 3.5 mm, at least 4 mm, at least 5 mm.

In a particular embodiment, the bottom surface of the cavity can have a round shape having a diameter of at least 5 mm, or at least 7 mm, or at least 10 mm, or at least 12 mm, or at least 15 mm. In other aspects, the shape of the bottom surface of the cavity can be also a square or rectangular or polygonal.

The cavity of the body including an electronic assembly can be contained in a non-abrasive portion or an abrasive portion of the body. In a particular aspect, the cavity can be contained in a non-abrasive portion of the body. In another particular aspect, the cavity may be contained in an abrasive portion of the body. As further shown in the examples, the cavity can be contained in a non-abrasive portion of an abrasive wheel. In a particular aspect, the wheel can comprise metal or a metal alloy.

The electronic assembly suitable for being placed in the cavity can be any electronic assembly as described in embodiments herein. In a particular embodiment, the electronic assembly can be an RFID tag. The minimum effective communication range of the electronic device contained in the electronic assembly may be at least 0.02 meters or at least 0.03 meters or at least 0.05 meters.

Figure 21A:
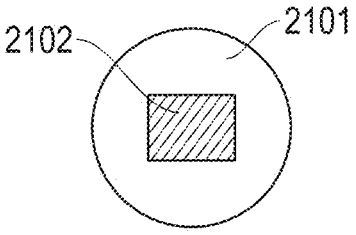
FIG. 21A includes a top view of an adapter containing an electronic assembly according to one embodiment.
Figure 21B:
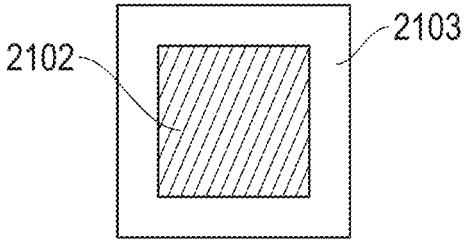
FIG. 21B includes a top view of an adapter containing an electronic assembly according to one embodiment.
Figure 21C:
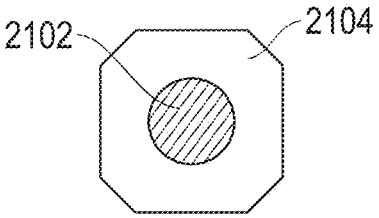
FIG. 21C includes a top view of an adapter containing an electronic assembly according to one embodiment.
Figure 21D:
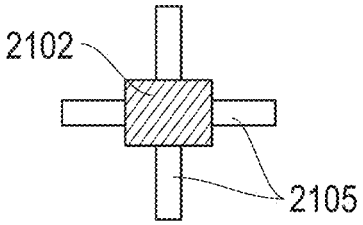
FIG. 21D includes a top view of an adapter containing an electronic assembly according to one embodiment.

In a certain embodiment, an adapter can be used to provide a support structure for the electronic assembly or electronic device. The adapter, herein also called a carrier or a support, can include a coupling structure for fastening the electronic assembly within a cavity of the body or to another structure element of the body. The adapter can have a flat plate-like structure, and may not be limited to a specific shape. FIGS. 21A-21D illustrate some examples of adapter shapes with an attached electronic assemblies. In FIG. 21A, the adapter 2101 has a circular shape and contains a square shaped electronic assembly (2102) positioned in the center of the adapter. In FIG. 2B, both the adapter 2103 and the electronic assembly 2102 have a square shape, while FIG. 21C shows an octagonal shaped adapter 2104 having in the center a round shaped electronic assembly 2102. In FIG. 21D, the adapter 2105 has a cross-like shape, wherein the electronic assembly 2102 may be placed in the center of the crossing.

The electronic assembly or just the electronic device can be attached to the adapter with an adhesive, or may be completely embedded by a material of the adapter. A material of the adapter can be the same as described in embodiments herein for the first and/or second portion of the electronic assembly.

Figure 21E:
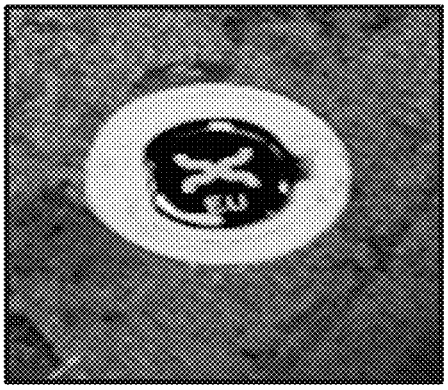
FIG. 21E includes an image of an adaptor containing an RFID tag attached to a wheel cavity according to one embodiment.
Figure 21F:
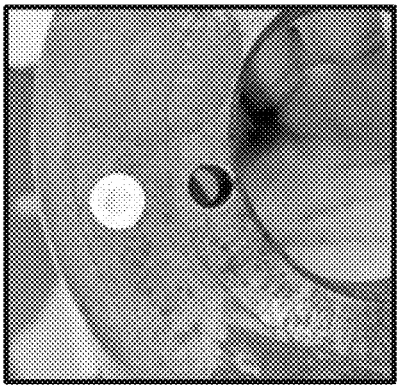
FIG. 21F includes an image of an adaptor containing an RFID tag attached to a wheel cavity according to one embodiment.
Figure 21G:
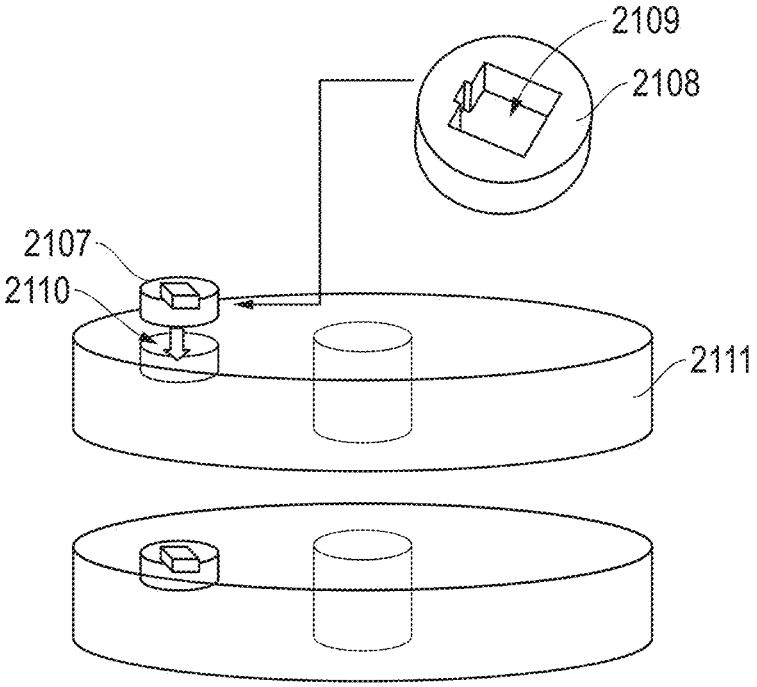
FIG. 21G includes a scheme placing an electronic assembly on an adapter and a wheel cavity according to one embodiment.

The adapter can be designed as being an attachment which matches the inner dimension of a cavity and an outer dimension of an electronic assembly for fastening to a cavity, for example, a metal mount RFID tag. In a certain aspects, the adapter can be designed to provide a tolerance fit, a press fit, a threaded joint, or a knurled surface for being coupled to a cavity of a body. FIG. 21E and FIG. 21F show images of adapters containing an electronic tag placed as a tight fit structure on a cavity of a metal wheel. FIG. 21G illustrates a perspective view of placing an RF tag 2107 unto an adapter having an exact spacing 2109 for the RF tag and setting the composite of adapter and tag within a cavity of a wheel 2111. The concept of using an adapter for supporting and protecting an electronic assembly or a plain electronic device may not be limited to cavities of the body, but can be applied to any structure element of the abrasive article that may benefit from such a feature.

Figure 22:
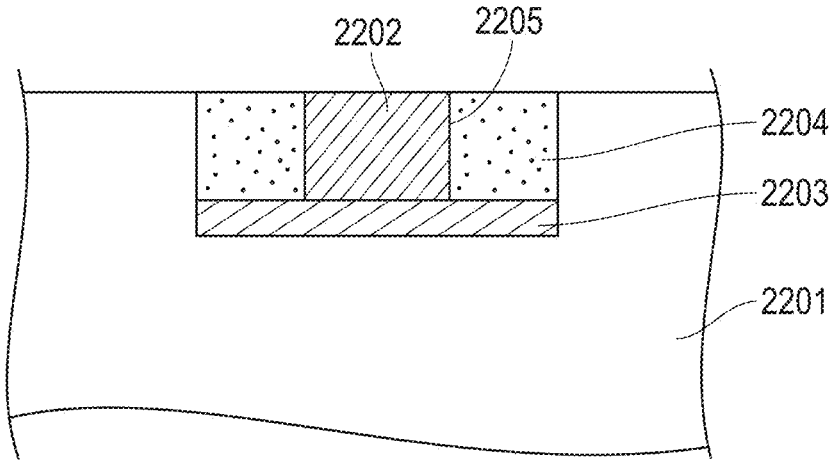
FIG. 22 includes a cross-sectional illustration of a multilayer adapter and an electronic assembly contained in a cavity of a body according to one embodiment.

In a particular embodiment, the adapter can have a multi-layer structure. An embodiment of a multi-layer structure is shown in FIG. 22. In FIG. 22, the adapter can comprise a metal layer 2203 and a non-conductive RF transparent layer 2204. The metal layer 2203 can be positioned underneath the electronic assembly (2202), and the RF transparent layer 2204 may be on both side surfaces (2205) of the electronic assembly (2202). Such multi-layer adapter can be suitable to compensate an uneven surface structure of the bottom surface of the cavity, for example, if the bottom surface of the cavity is curved or otherwise not flat, as further demonstrated in the examples.

In one embodiment, an abrasive article can comprise a body, a cavity extending within the body from an exterior surface of the body, and an electronic assembly contained within the cavity of the body, the electronic assembly including and electronic device, wherein a bottom surface of the cavity can be substantially flat. As further shown in the examples, it has been observed that the effective communication of the electronic device contained within the cavity can be influenced by the surface geometry of the bottom surface of the cavity, wherein best results can be obtained with a substantially flat surface.

In one aspect, the bottom surface of the cavity can have a normalized average flatness between 0.00001 $mm^{-1}$ to 0.0001 $mm^{-1}$. In one aspect, the normalized average flatness can be at least 0.00002 $mm^{-1}$, or at least 0.00005 $mm^{-1}$, or at least 0.00007 $mm^{-1}$. In another aspect, the normalized average flatness may be not greater than 0.0001 $mm^{-1}$, or not greater than 0.00009 $mm^{-1}$, or not greater than 0.00008 $mm^{-1}$, or not greater than 0.00005 $mm^{-1}$. The normalized average flatness can be a value within any of the minimum and maximum values note above. As used herein, the normalized average flatness is calculated by using as flatness for milled or drilled surfaces a value 0.01-0.06 mm elevation, and dividing the flatness by the surface area of the cavity bottom surface, which can be in embodiments between about 75 $mm^2$ and 150 $mm^2$. In a further aspect, the bottom surface of the cavity can have a surface which is substantially parallel to a bottom surface of the electronic assembly.

The present disclosure is further directed to a process for coupling an electronic device to an abrasive article. The process can include providing an abrasive article having a body, identifying a position on the body; and using a robot for placing the electronic device at the position. As used herein the term position refers to the location of the body of the abrasive article where an electronic device should be coupled to.

In one aspect, providing the abrasive article can include identifying the abrasive article from a plurality of abrasive articles. In a particular aspect, identifying the abrasive body can comprise using a vision system. In one aspect, the vision system may identify a desired abrasive article by detecting a unique indicia which encodes information related to the abrasive article. A vision system can be further used for identifying the desired position for placing the electronic device.

The process can further comprise selecting the electronic device using a robot and coupling the electronic device to the identified position of the body. In one aspect, the robot may contain an end effector which can grab and place the electronic device to the aimed position. The end effector can comprise an in built force/torque sensor capable of detecting the maximum force to be exerted to press the electronic device into the cavity.

In another aspect, the electronic device can be contained in a packaging as described in embodiments herein.

In a particular aspect, the position for coupling the electronic device to the body can be a cavity extending within the body from an exterior surface of the body. In another aspect, the electronic device can be coupled to an exterior surface of the body.

Non-limiting examples of an electronic device can include an electronic tag, an electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1

An abrasive article comprising: a body; an electronic assembly coupled to the body, wherein the electronic assembly comprises: an electronic device; and a first portion disposed between the body and the communication device, wherein the first portion comprises a material having an average relative magnetic permeability of not greater than 15.

Embodiment 2

An abrasive article comprising: a body; an electronic assembly coupled to the body, wherein the electronic assembly comprises: an electronic device; and a package containing the electronic device, wherein the package comprises a first portion and a second portion, wherein the first portion comprises a material having a first average relative magnetic permeability and the second portion comprises a material having a second average relative magnetic permeability, and wherein the first average relative magnetic permeability is different than the second average relative magnetic permeability.

Embodiment 3

An abrasive article comprising: a body; an electronic assembly coupled to the body, wherein the electronic assembly comprises: an electronic device; and a package containing the electronic device, wherein the package comprises a first portion and a second portion, wherein the first portion comprises a material having a first average dielectric value and the second portion comprises a material having a second average dielectric value, and wherein the first average dielectric value is different than the second average dielectric value.

Embodiment 4

An abrasive article comprising: a body; an electronic assembly coupled to the body, wherein at least one of the body and the electronic assembly comprise metal, the electronic assembly comprising: an electronic device configured for wireless communication and having a minimum effective communication range of at least 0.1 meters.

Embodiment 5

The abrasive article of any one of Embodiments 1 and 4, wherein the electronic assembly comprises a first portion and a second portion.

Embodiment 6

The abrasive article of any one of Embodiments 2, 3, and 5, wherein the first portion comprises a material having an average relative magnetic permeability of not greater than 15.

Embodiment 7

The abrasive article of any one of Embodiments 1 and 6, wherein the first portion comprises a material having an average relative magnetic permeability of not greater than 14.5 or not greater than 14 or not greater than 13.5 or not greater than 13 or not greater than 12.5 or not greater than 12 or not greater than 11.5 or not greater than 11 or not greater than 10.5 or not greater than 10 or not greater than 9.5 or not greater than 9 or not greater than 8.5 or not greater than 8 or not greater than 7.5 or not greater than 7 or not greater than 6.5 or not greater than 6 or not greater than 5.5 or not greater than 5 or not greater than 4.5 or not greater than 4 or not greater than 3.5 or not greater than 3 or not greater than 2.5 or not greater than 2 or not greater than 1.5 or not greater than 1.25.

Embodiment 8

The abrasive article of Embodiment 7, wherein the relative magnetic permeability is at least 1 or at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10.

Embodiment 9

The abrasive article of any one of Embodiments 1, 6, and 7, wherein the relative magnetic permeability is for a frequency of electromagnetic radiation of at least 3 kHz or at least 5 kHz or at least 10 kHz or at least 20 kHz or at least 30 kHz or at least 40 kHz or at least 50 kHz or at least 60 kHz or at least 70 kHz or at least 80 kHz or at least 90 kHz or at least 100 kHz or at least 200 kHz or at least 300 kHz or at least 400 kHz or at least 500 kHz or at least 600 kHz or at least 700 kHz or at least 800 kHz or at least 900 kHz or at least 1 MHz or at least 2 MHz or at least 3 MHz or at least 4 MHz or at least 5 MHz or at least 6 MHz or at least 7 MHz or at least 8 MHz or at least 9 MHz or at least 10 MHz or at least 12 MHz.

Embodiment 10

The abrasive article of any one of Embodiments 1, 6, 7 and 9, wherein the relative magnetic permeability is for electromagnetic radiation of a frequency of not greater than 3 GHz or not greater than 2 GHz or not greater than 1 GHz or not greater than 900 MHz or not greater than 500 MHz or not greater than 200 MHz or not greater than 150 MHz or not greater than 100 MHz or not greater than 80 MHz or not greater than 60 MHz or not greater than 40 MHz or not greater than 30 MHz or not greater than 20 MHz.

Embodiment 11

The abrasive article of any one of Embodiments 1, 2, 3, and 5, wherein the first portion comprises a material having a first dielectric value of at least 1 or at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10 or at least 10.5 or at least 11 or at least 11.5 or at least 12 or at least 12.5 or at least 13 or at least 13.5 or at least 14.

Embodiment 12

The abrasive article of Embodiment 11, wherein the material comprises a dielectric value of not greater than 100 or not greater than 70 or not greater than 50 or not greater than 40 or not greater than 30 or not greater than 20 or not greater than 19 or not greater than 18 or not greater than 17 or not greater than 16 or not greater than 15 or not greater than 14 or not greater than 13 or not greater than 12 or not greater than 11 or not greater than 10 or not greater than 9 or not greater than 8 or not greater than 7 or not greater than 6 or not greater than 5 or not greater than 4 or not greater than 3.

Embodiment 13

The abrasive article of any one of Embodiments 11 and 12, wherein the material consists essentially of a dielectric material having a dielectric value within a range of at least 1 to not greater than 20.

Embodiment 14

The abrasive article of any one of Embodiments 1, 2, 3, and 5, wherein the first portion comprises a relative magnetic permeability of not greater than 15 or not greater than 14.5 or not greater than 14 or not greater than 13.5 or not greater than 13 or not greater than 12.5 or not greater than 12 or not greater than 11.5 or not greater than 11 or not greater than 10.5 or not greater than 10 or not greater than 9.5 or not greater than 9 or not greater than 8.5 or not greater than 8 or not greater than 7.5 or not greater than 7 or not greater than 6.5 or not greater than 6 or not greater than 5.5 or not greater than 5 or not greater than 4.5 or not greater than 4 or not greater than 3.5 or not greater than 3 or not greater than 2.5 or not greater than 2 or not greater than 1.5 or not greater than 1.25.

Embodiment 15

The abrasive article of Embodiment 14, wherein the relative magnetic permeability is at least 1 or at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10.

Embodiment 16

The abrasive article of Embodiment 14, wherein the relative magnetic permeability is of electromagnetic radiation of a frequency of at least 5 kHz or at least 10 kHz or at least 20 kHz or at least 30 kHz or at least 40 kHz or at least 50 kHz or at least 60 kHz or at least 70 kHz or at least 80 kHz or at least 90 kHz or at least 100 kHz or at least 200 kHz or at least 300 kHz or at least 400 kHz or at least 500 kHz or at least 600 kHz or at least 700 kHz or at least 800 kHz or at least 900 kHz or at least 1 MHz or at least 2 MHz or at least 3 MHz or at least 4 MHz or at least 5 MHz or at least 6 MHz or at least 7 MHz or at least 8 MHz or at least 9 MHz or at least 10 MHz or at least 12 MHz.

Embodiment 17

The abrasive article of Embodiment 16, wherein the relative magnetic permeability is of electromagnetic radiation of a frequency of not greater than 3 GHz or not greater than 2 GHz or not greater than 1 GHz or not greater than 900 MHz or not greater than 500 MHz or not greater than 200 MHz or not greater than 150 MHz or not greater than 100 MHz or not greater than 80 MHz or not greater than 60 MHz or not greater than 40 MHz or not greater than 30 MHz or not greater than 20 MHz.

Embodiment 18

The abrasive article of any one of Embodiments 1, 2, 3, and 5, wherein the first portion comprises a first dielectric value of at least 1 or at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10 or at least 10.5 or at least 11 or at least 11.5 or at least 12 or at least 12.5 or at least 13 or at least 13.5 or at least 14.

Embodiment 19

The abrasive article of Embodiment 18, wherein the first dielectric value is not greater than 100 or not greater than 70 or not greater than 50 or not greater than 40 or not greater than 30 or not greater than 20 or not greater than 19 or not greater than 18 or not greater than 17 or not greater than 16 or not greater than 15 or not greater than 14 or not greater than 13 or not greater than 12 or not greater than 11 or not greater than 10 or not greater than 9 or not greater than 8 or not greater than 7 or not greater than 6 or not greater than 5 or not greater than 4 or not greater than 3.

Embodiment 20

The abrasive article of any one of Embodiments 2, 3, and 5, wherein the second portion comprises a second dielectric value of at least 1 or at least 2 or at least 3 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10 or at least 10.5 or at least 11 or at least 11.5 or at least 12 or at least 12.5 or at least 13 or at least 13.5 or at least 14.

Embodiment 21

The abrasive article of Embodiment 20, wherein the second portion comprises a second dielectric value of not greater than 100 or not greater than 70 or not greater than 50 or not greater than 40 or not greater than 30 or not greater than 20 or not greater than 19 or not greater than 18 or not greater than 17 or not greater than 16 or not greater than 15 or not greater than 14 or not greater than 13 or not greater than 12 or not greater than 11 or not greater than 10 or not greater than 9 or not greater than 8 or not greater than 7 or not greater than 6 or not greater than 5 or not greater than 4 or not greater than 3.

Embodiment 22

The abrasive article of any one of Embodiments 2, 3, and 5, wherein the second portion comprises a second relative magnetic permeability of not greater than 15 or not greater than 14.5 or not greater than 14 or not greater than 13.5 or not greater than 13 or not greater than 12.5 or not greater than 12 or not greater than 11.5 or not greater than 11 or not greater than 10.5 or not greater than 10 or not greater than 9.5 or not greater than 9 or not greater than 8.5 or not greater than 8 or not greater than 7.5 or not greater than 7 or not greater than 6.5 or not greater than 6 or not greater than 5.5 or not greater than 5 or not greater than 4.5 or not greater than 4 or not greater than 3.5 or not greater than 3 or not greater than 2.5 or not greater than 2 or not greater than 1.5 or not greater than 1.25.

Embodiment 23

The abrasive article of Embodiment 22, wherein the second portion comprises a second relative magnetic permeability of at least 1 or at least 1.1 or at least 1.2 or at least 1.4 or at least 1.6 or at least 1.8 or at least 2 or at least 2.2 or at least 2.5 or at least 2.8 or at least 3 or at least 3.2 or at least 3.5 or at least 3.8 or at least 4 or at least 4.2 or at least 4.5 or at least 4.8 or at least 5 or at least 5.2 or at least 5.5 or at least 5.8 or at least 6 or at least 6.2 or at least 6.5 or at least 6.8 or at least 7 or at least 7.5 or at least 8 or at least 8.5 or at least 9 or at least 9.5 or at least 10.

Embodiment 24

The abrasive article of Embodiment 22, wherein the relative magnetic permeability is of electromagnetic radiation of a frequency of at least 5 kHz or at least 10 kHz or at least 20 kHz or at least 30 kHz or at least 40 kHz or at least 50 kHz or at least 60 kHz or at least 70 kHz or at least 80 kHz or at least 90 kHz or at least 100 kHz or at least 200 kHz or at least 300 kHz or at least 400 kHz or at least 500 kHz or at least 600 kHz or at least 700 kHz or at least 800 kHz or at least 900 kHz or at least 1 MHz or at least 2 MHz or at least 3 MHz or at least 4 MHz or at least 5 MHz or at least 6 MHz or at least 7 MHz or at least 8 MHz or at least 9 MHz or at least 10 MHz or at least 12 MHz.

Embodiment 25

The abrasive article of Embodiment 24, wherein the relative magnetic permeability is of electromagnetic radiation of a frequency of not greater than 300 GHz or not greater than 100 GHz or not greater than 50 GHz or not greater than 10 GHz or not greater than 3 GHz or not greater than 2 GHz or not greater than 1 GHz or not greater than 900 MHz or not greater than 500 MHz or not greater than 200 MHz or not greater than 150 MHz or not greater than 100 MHz or not greater than 80 MHz or not greater than 60 MHz or not greater than 40 MHz or not greater than 30 MHz or not greater than 20 MHz.

Embodiment 26

The abrasive article of any one of Embodiments 1, 2, 3, and 5, wherein the first portion consists essentially of a dielectric material having a dielectric value within a range of at least 1 to not greater than 20.

Embodiment 27

The abrasive article of any one of Embodiments 1, 2, 3, and 5, wherein the first portion consists essentially of a dielectric material having a first relative magnetic permeability within a range of at least 1 to not greater than 15.

Embodiment 28

The abrasive article of any one of Embodiments 2, 3, and 5, wherein the second portion is free of a dielectric material.

Embodiment 29

The abrasive article of any one of Embodiments 1, 3, and 5, further comprising a package containing the electronic device, wherein the package comprises the first portion and the second portion, wherein the first portion comprises a material having a first average relative magnetic permeability and the second portion comprises a material having a second average relative magnetic permeability, and wherein the first average relative magnetic permeability is different than the second average relative magnetic permeability.

Embodiment 30

The abrasive article of any one of Embodiments 2 and 29, wherein the first average relative magnetic permeability is greater than the second average relative magnetic permeability.

Embodiment 31

The abrasive article of any one of Embodiments 2 and 29, further comprising a magnetic permeability difference value ($\Delta MP=MP2/MP1$) of at least 1.1, wherein MP1 is the first average relative magnetic permeability and MP2 is the second average relative magnetic permeability, or further wherein the magnetic permeability difference value is at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100 or at least 1000.

Embodiment 32

The abrasive article of any one of Embodiments 1, 2, 3, and 5, further comprising a package containing the electronic device, wherein the package comprises the first portion and the second portion, wherein the first portion comprises a first average relative magnetic permeability and the second portion comprises a second average relative magnetic permeability, and wherein the first average relative magnetic permeability is different than the second average relative magnetic permeability.

Embodiment 33

The abrasive article of Embodiment 32, wherein the first average relative magnetic permeability is greater than the second average relative magnetic permeability.

Embodiment 34

The abrasive article of Embodiment 32, further comprising a magnetic permeability difference value (ΔMP=MP2/MP1) of at least 1.1, wherein MP1 is the first average relative magnetic permeability and MP2 is the second average relative magnetic permeability, or further wherein the magnetic permeability difference value is at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100 or at least 1000.

Embodiment 35

The abrasive article of any one of Embodiments 1, 2, and 5, further comprising a package containing the electronic device, wherein the package comprises the first portion and the second portion, wherein the first portion comprises a material having a first average dielectric value and the second portion comprises a material having a second average dielectric value, and wherein the first average dielectric value is different than the second average dielectric value.

Embodiment 36

The abrasive article of any one of Embodiments 3 and 35, wherein the first average dielectric value is less than the second average dielectric value.

Embodiment 37

The abrasive article of any one of Embodiments 3 and 35, further comprising a dielectric difference value (ΔDV=DV1/DV2) of at least 1.1, wherein DV1 is the first average dielectric value and DV2 is the second average dielectric value, or further wherein the dielectric difference value is at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100 or at least 1000.

Embodiment 38

The abrasive article of any one of Embodiments 1, 2, 3, and 5, further comprising a package containing the electronic device, wherein the package comprises the first portion and the second portion, wherein the first portion comprises a first average dielectric value and the second portion comprises a second average dielectric value, and wherein the first average dielectric value is different than the second average dielectric value.

Embodiment 39

The abrasive article of Embodiment 38, wherein the first average dielectric value is less than the second average dielectric value.

Embodiment 40

The abrasive article of Embodiment 38, further comprising a dielectric difference value (ΔDV=DV1/DV2) of at least 1.1, wherein DV1 is the first average dielectric value and DV2 is the second average dielectric value, or further wherein the dielectric difference value is at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100 or at least 1000.

Embodiment 41

The abrasive article of any one of Embodiments 1, 2, and 3, wherein the electronic device is configured for wireless communication and having a minimum effective communication range of at least 0.05 meters.

Embodiment 42

The abrasive article of any one of Embodiments 4 and 41, wherein the minimum effective communication range is at least at least 0.2 meters or at least 0.25 meters or at least 0.3 meters or at least 0.35 meters or at least 0.4 meters or at least 0.5 meters or at least 0.6 meters or at least 0.8 meters or at least 1 meter or at least 0.1 meters or at least 0.2 meters or at least 0.3 meters or at least 0.4 meters or at least 0.5 meters or at least 0.6 meters or at least 0.7 meters or at least 0.8 meters or at least 0.9 meters or at least 1 meter or at least 1.2 meters or at least 1.4 meters or at least 1.6 meters or at least 1.8 meters or at least 2 meters or at least 2.2 meters or at least 2.4 meters or at least 2.6 meters or at least 2.8 meters or at least 3 meters or at least 3.2 meters or at least 3.4 meters or at least 3.6 meters or at least 3.8 meters or at least 4 meters or at least 5 meters or at least 6 meters or at least 7 meters or at least 8 meters or at least 9 meters or at least 10 meters.

Embodiment 43

The abrasive article of Embodiment 42, wherein the minimum effective communication range is not greater than 100 meters or not greater than 75 meters or not greater than 50 meters or not greater than 25 meters or not greater than 20 meters or not greater than 15 meters or not greater than 12 meters or not greater than 10 meters.

Embodiment 44

The abrasive article of any one of Embodiments 1, 2, and 3, wherein at least one of the body and the electronic assembly comprise metal.

Embodiment 45

The abrasive article of any one of Embodiments 1, 2, 3, and 4 wherein the electronic device comprises a minimum data transmission rate of at least 4 kbps or at least 8 kbps or at least 10 kbps or at least 15 kbps or at least 20 kbps or at least 40 kbps or at least 60 kbps or at least 80 kbps or at least 100 kbps or at least 150 kbps or at least 200 kbps or at least 250 kbps or at least 300 kbps or at least 400 kbps or at least 500 kbps or at least 600 kbps.

Embodiment 46

The abrasive article of Embodiment 45, wherein the maximum data transmission rate is not greater than 800 kbps or not greater than 700 kbps or not greater than 600 kbps or not greater than 500 kbps.

Embodiment 47

The abrasive article of any one of Embodiments 1, 2, 3, and 4 wherein the electronic device comprises a maximum loss of not greater than 50 dB over a range of frequencies of at least 3 kHz to not greater than 300 GHz.

Embodiment 48

The abrasive article of any one of Embodiments 1, 2, 3, and 5, wherein the first portion is in direct contact with at least one logic device.

Embodiment 49

The abrasive article of any one of Embodiments 1, 2, 3, and 5, wherein the first portion is disposed between the body and the electronic assembly and is in direct contact with the body.

Embodiment 50

The abrasive article of any one of Embodiments 1, 2, 3, and 5, wherein the first portion is a multilayered article including a first layer and a second layer, and wherein the first layer comprises a material having an average relative magnetic permeability of not greater than 15.

Embodiment 51

The abrasive article of Embodiment 50, wherein the first layer is disposed between the second layer and the electronic device.

Embodiment 52

The abrasive article of Embodiment 50, wherein the second layer is disposed between the first layer and the electronic device.

Embodiment 53

The abrasive article of any one of Embodiments 1, 2, 3, and 5, wherein the first portion is a monolithic construction.

Embodiment 54

The abrasive article of any one of Embodiments 2, 3, and 5, wherein the second portion is overlying the first portion.

Embodiment 55

The abrasive article of any one of Embodiments 2, 3, and 5, wherein the electronic device is disposed between the first portion and the second portion.

Embodiment 56

The abrasive article of anyone of Embodiments 2, 3, and 5, wherein the electronic device is surrounded by the first portion and the second portion.

Embodiment 57

The abrasive article of any one of Embodiments 2, 3, and 5, wherein the electronic assembly is disposed between the first portion and the second portion.

Embodiment 58

The abrasive article of any one of Embodiments 2, 3, and 5, wherein the electronic assembly is surrounded by the first portion and the second portion.

Embodiment 59

The abrasive article of any one of Embodiments 1, 2, 3, and 4, wherein the electronic device includes a device selected from the group of an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 60

The abrasive article of Embodiment 59, wherein the electronic device includes a wireless communication device including a logic element and an antenna.

Embodiment 61

The abrasive article of Embodiment 59, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

Embodiment 62

The abrasive article of Embodiment 61, wherein the sensor is selected from the group of an acoustic sensor, force sensor, vibration sensor, temperature sensor, moisture sensor, pressure sensor, gas sensor, or any combination thereof.

Embodiment 63

The abrasive article of Embodiment 59, wherein the electronic device is configured to communicate with a mobile device.

Embodiment 64

The abrasive article of Embodiment 59, wherein the electronic device includes at least one of a read-only device, a read-write device, or any combination thereof.

Embodiment 65

The abrasive article of Embodiment 59, wherein the electronic device includes manufacturing information selected from the group of processing information, manufacturing date, shipment information, product identification information or any combination thereof.

Embodiment 66

The abrasive article of Embodiment 59, wherein the electronic devices includes customer information selected from the group of customer registration information, product identification information, product cost information, manufacturing date, shipment date, environmental information, use information, or any combination thereof.

Embodiment 67

The abrasive article of any one of Embodiments 1, 2, 3, and 5, wherein the first portion is underlying at least 10% of a footprint surface area of the electronic device, or at least 20% or at least 30% or at least 40% or at least 50% or at least 60% or at least 70% or at least 80% or at least 90% or at least 100%.

Embodiment 68

The abrasive article of any one of Embodiments 1, 2, 3, and 5, wherein the first portion is partially enveloping at least a portion of the electronic device, such that a bottom surface of the portion of the electronic device is below an upper surface of the first portion as viewed in cross-section.

Embodiment 69

The abrasive article of any one of Embodiments 1, 2, 3, and 5, wherein the first portion defines a cavity and at least a portion of the electronic device is disposed in the cavity.

Embodiment 70

The abrasive article of any one of Embodiments 1, 2, 3, and 5, wherein the first portion is surrounding at least 10% of the total surface area of the electronic device as viewed in cross-section, or at least 20% or at least 30% or at least 40% or at least 50% or at least 60% or at least 70% or at least 80% or at least 90%.

Embodiment 71

The abrasive article of any one of Embodiments 2, 3, and 5, wherein the first portion and second portion are part of a package containing at least a portion of the electronic device, and wherein the second portion defines a RF window in the package.

Embodiment 72

The abrasive article of any one of Embodiments 2, 3, and 5, wherein the first portion comprises a material having an average RF reflectance of at least 50% for electromagnetic radiation having a frequency between 3 kHz and 300 GHz.

Embodiment 73

The abrasive article Embodiment 72, wherein the first average RF reflectance is at least 51% for a range of 3 kHz and 300 GHz or at least 52% or at least 53% or at least 54% or at least 55% or at least 56% or at least 57% or at least 58% or at least 59% or at least 60% or at least 61% or at least 62% or at least 63% or at least 64% or at least 65% or at least 66% or at least 67% or at least 68% or at least 69% or at least 70% or at least 71% or at least 72% or at least 73% or at least 74% or at least 75% or at least 76% or at least 77% or at least 78% or at least 79% or at least 80% or at least 81% or at least 82% or at least 83% or at least 84% or at least 85% or at least 86% or at least 87% or at least 88% or at least 89% or at least 90% or at least 91% or at least 92% or at least 93% or at least 94% or at least 95% or at least 96% or at least 97% or at least 98% or at least 99%.

Embodiment 74

The abrasive article of Embodiment 72, wherein the second portion has a second average RF reflectance that is different than the first average RF reflectance.

Embodiment 75

The abrasive article of Embodiment 74, wherein the second portion has a second average RF reflectance that is less than the first average RF reflectance.

Embodiment 76

The abrasive article Embodiment 72, further comprising a reflection difference value ($\Delta RFR=RFR1/RFR2$) of at least 1.1, wherein RFR1 is the first average RF reflectance and RFR2 is the second average RF reflectance, or further wherein the reflection difference value is at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100.

Embodiment 77

The abrasive article of any one of Embodiments 2, 3, and 5, further comprising a package comprising the first portion and the second portion, wherein the first portion has a first average RF transmittance and the second portion has a second average RF transmittance, and wherein the first average RF transmittance is different than the second average RF transmittance.

Embodiment 78

The abrasive article of Embodiment 77, wherein the first average RF transmittance is less than the second average RF transmittance.

Embodiment 79

The abrasive article of Embodiment 77, further comprising a transmittance difference value ($\Delta RFT=RFT2/RFT1$) of at least 1.1, wherein RFT1 is the first average RF transmittance and RFT2 is the second average RF transmittance, or further wherein the transmittance difference value is at least 1.2 or at least 1.5 or at least 1.8 or at least 2 or at least 2.5 or at least 3 or at least 3.5 or at least 4 or at least 4.5 or at least 5 or at least 5.5 or at least 6 or at least 6.5 or at least 7 or at least 8 or at least 9 or at least 10 or at least 20 or at least 30 or at least 40 or at least 50 or at least 60 or at least 70 or at least 80 or at least 90 or at least 95 or at least 99 or at least 100.

Embodiment 80

The abrasive article of Embodiment 77, wherein the first portion and the second portion envelop at least a portion of the electronic device, and wherein the second portion defines a window in the package having a greater RF transmittance as compared to the RF transmittance of the first portion.

Embodiment 81

The abrasive article of any one of Embodiments 1, 2, 3, and 5, wherein the electronic device includes a communication device, and the first portion is disposed between and electrically insulting the communication device from the body.

Embodiment 82

The abrasive article of any one of Embodiments 1, 2, 3, and 5, wherein the electronic device includes at least one antenna and the first portion is disposed between and electrically insulting the antenna from the body.

Embodiment 83

The abrasive article of any one of Embodiments 1, 2, 3, and 5, wherein the first portion is part of a package of the electronic assembly, and the first portion defines at least 10 vol % of a total volume of the package or at least 20 vol % or at least 30 vol % or at least 40 vol % or at least 50 vol % or at least 60 vol % or at least 70 vol % or at least 80 vol % or at least 90 vol % or at least 100 vol %.

Embodiment 84

The abrasive article of Embodiment 83, wherein the first portion defines not greater than 90% of the total volume of the package or not greater than 80% or not greater than 70% or not greater than 60% or not greater than 50%.

Embodiment 85

The abrasive article of any one of Embodiments 2, 3, and 5, wherein the first portion and second portion are part of a package of the electronic assembly and the first portion defines a greater volume as compared to the second portion.

Embodiment 86

The abrasive article of anyone of Embodiments 2, 3, and 5, wherein the first portion and second portion are part of a package of the electronic assembly and the first portion defines a lesser volume as compared to the second portion.

Embodiment 87

The abrasive article of any one of Embodiments 2, 3, and 5, wherein the first portion comprises a first average thickness and the second portion comprises a second average thickness, and wherein the first average thickness is different than the second average thickness.

Embodiment 88

The abrasive article of Embodiment 87, wherein the first average thickness is greater than the second average thickness.

Embodiment 89

The abrasive article of Embodiment 87, wherein the first average thickness is less than the second average thickness.

Embodiment 90

The abrasive article of any one of Embodiments 2, 3, and 5, wherein the first portion comprises a first average thickness and the second portion comprises a second average thickness, and wherein the first average thickness is the same as the second average thickness.

Embodiment 91

The abrasive article of anyone of Embodiments 2, 3, and 5, wherein the first portion comprise a first average thickness of at least 0.1 mm or at least 0.2 mm or at least 0.3 mm or at least 0.4 mm or at least 0.5 mm or at least 0.6 mm or at least 0.7 mm or at least 0.8 mm or at least 0.9 mm or at least 1 mm or at least 1.2 mm or at least 1.5 mm or at least 1.8 mm or at least 2 mm or at least 2.5 mm or at least 3 mm or at least 3.5 mm or at least 4 mm or at least 4.5 mm or at least 5 mm.

Embodiment 92

The abrasive article of Embodiment 91, wherein the first average thickness is not greater than 10 mm or not greater than 9 mm or not greater than 8 mm or not greater than 7 mm or not greater than 6 mm or not greater than 5 mm or not greater than 4 mm or not greater than 3 mm or not greater than 2 mm.

Embodiment 93

The abrasive article of any one of Embodiments 2, 3, and 5, wherein the second portion comprises an second average thickness of at least 0.1 mm or at least 0.2 mm or at least 0.3 mm or at least 0.4 mm or at least 0.5 mm or at least 0.6 mm or at least 0.7 mm or at least 0.8 mm or at least 0.9 mm or at least 1 mm or at least 1.2 mm or at least 1.5 mm or at least 1.8 mm or at least 2 mm or at least 2.5 mm or at least 3 mm or at least 3.5 mm or at least 4 mm or at least 4.5 mm or at least 5 mm.

Embodiment 94

The abrasive article of Embodiment 93, wherein the second average thickness is not greater than 10 mm or not greater than 9 mm or not greater than 8 mm or not greater than 7 mm or not greater than 6 mm or not greater than 5 mm or not greater than 4 mm or not greater than 3 mm or not greater than 2 mm.

Embodiment 95

The abrasive article of any one of Embodiments 2, 3, and 5, wherein the first portion comprises a material selected from the group of inorganic materials, ceramics, glass, organic materials, or any combination thereof.

Embodiment 96

The abrasive article of Embodiment 95, wherein the material comprises a material selected from the group of fluoropolymers, polyester, polyimide, polyamide thermoplastics, thermosets, rubber, or any combination thereof.

Embodiment 97

The abrasive article of Embodiment 96, wherein the material comprises at least one of polyimide, polyethylene terephthalate, polytetrafluoroethylene.

Embodiment 98

The abrasive article of Embodiment 96, wherein the material consists of one of polyimide, polyethylene terephthalate, and polytetrafluoroethylene.

Embodiment 99

The abrasive article of Embodiment 96, wherein the first portion consists of one of polyimide, polyethylene terephthalate, and polytetrafluoroethylene.

Embodiment 100

The abrasive article of any one of Embodiments 2, 3, and 5, wherein the second portion comprises a material selected from the group of inorganic materials, ceramics, glass, organic materials, or any combination thereof. [

Embodiment 101

The abrasive article of Embodiment 100, wherein the material comprises a material selected from the group of fluoropolymers, polyester, polyimide, thermoplastics, thermosets, or any combination thereof.

Embodiment 102

The abrasive article of Embodiment 100, wherein the material comprises at least one of thermoplastic polymers.

Embodiment 103

The abrasive article of Embodiment 100, wherein the material consists of one of thermoset polymers.

Embodiment 104

The abrasive article of Embodiment 100, wherein the material comprises PDMS, PEN, polyimide, PEEK or any combination thereof.

Embodiment 105

The abrasive article of any one of Embodiments 1, 2, 3, and 5, wherein the body comprises an abrasive portion and a non-abrasive portion, and wherein the first portion is coupled to an abrasive portion.

Embodiment 106

The abrasive article of Embodiment 105, wherein the first portion is in direct contact with the abrasive portion comprising abrasive particles and a bond material.

Embodiment 107

The abrasive article of Embodiment 105, wherein the first portion is directly coupled to an abrasive surface of the abrasive portion, the abrasive surface comprising abrasive particles and a bond material.

Embodiment 108

The abrasive article of Embodiment 105, wherein the abrasive portion comprises a metal.

Embodiment 109

The abrasive article of Embodiment 108, wherein the abrasive portion comprises a metal bond material.

Embodiment 110

The abrasive article of Embodiment 108, wherein the metal is a metal or metal alloy including at least one transition metal element.

Embodiment 111

The abrasive article of Embodiment 108, wherein the metal includes at least one of iron, copper, nickel, silver, aluminum, cobalt, or any combination thereof.

Embodiment 112

The abrasive article of Embodiment 108, wherein the metal comprises a conductivity of at least 10×103 Siemens/meter at 25° C. or at least 12×103 Siemens/meter at 25° C. or at least 15×103 Siemens/meter at 25° C. or at least 20×103 Siemens/meter at 25° C. or at least 30×103 Siemens/meter at 25° C. or at least 50×103 Siemens/meter at 25° C. or at least 100×103 Siemens/meter at 25° C. or at least 500×103 Siemens/meter at 25° C. or at least 1000×103 Siemens/meter at 25° C.

Embodiment 113

The abrasive article of Embodiment 108, wherein the metal comprises a RF attenuation value of at least 40 dB or at least 50 dB or at least 60 dB or at least 70 dB or at least 80 dB or at least 90 dB or at least 100 dB.

Embodiment 114

The abrasive article of Embodiment 105, wherein the first portion is at least partially embedded in the abrasive portion, wherein a bottom surface of the first portion is below an abrasive surface of the abrasive portion.

Embodiment 115

The abrasive article of Embodiment 105, wherein the entirety of the first portion is embedded in the abrasive portion, wherein an upper surface of the first portion is below an abrasive surface of the abrasive portion.

Embodiment 116

The abrasive article of any one of Embodiments 114 and 115, wherein at least a portion of the electronic assembly extends above the abrasive surface.

Embodiment 117

The abrasive article of any one of Embodiments 114 and 115, wherein at least a portion of the second portion extends above the abrasive surface.

Embodiment 118

The abrasive article of Embodiment 105, wherein the electronic assembly is at least partially embedded in the abrasive portion, wherein a bottom surface of the electronic assembly is below an abrasive surface of the abrasive portion.

Embodiment 119

The abrasive article of Embodiment 105, wherein the entirety of the electronic assembly is embedded in the abrasive portion.

Embodiment 120

The abrasive article of Embodiment 105, wherein the first portion and second portion are embedded in the abrasive portion, wherein the upper surface of the second portion is below an abrasive surface of the abrasive portion.

Embodiment 121

The abrasive article of Embodiment 105, wherein the first portion is in direct contact with the non-abrasive portion, the non-abrasive portion being free of abrasive particles.

Embodiment 122

The abrasive article of Embodiment 121, wherein the non-abrasive portion comprises only bond material.

Embodiment 123

The abrasive article of Embodiment 121, wherein the non-abrasive portion is free of abrasive particles and bond material.

Embodiment 124

The abrasive article of Embodiment 121, wherein the non-abrasive portion includes a hub coupled to the abrasive portion, wherein the hub is configured to facilitate mounting of the body to a tool.

Embodiment 125

The abrasive article of Embodiment 121, wherein the non-abrasive portion comprises a metal.

Embodiment 126

The abrasive article of Embodiment 125, wherein the non-abrasive portion consists essentially of metal.

Embodiment 127

The abrasive article of Embodiment 125, wherein the metal is a metal or metal alloy including a transition metal element, aluminum or any combination thereof.

Embodiment 128

The abrasive article of Embodiment 125, wherein the metal is selected from the group consisting of iron, copper, nickel, silver, aluminum, cobalt, or any combination thereof.

Embodiment 129

The abrasive article of Embodiment 125, wherein the metal comprises a conductivity of at least 10×103 Siemens/meter at 25° C. or at least 12×103 Siemens/meter at 25° C. or at least 15×103 Siemens/meter at 25° C. or at least 20×103 Siemens/meter at 25° C. or at least 30×103 Siemens/meter at 25° C. or at least 50×103 Siemens/meter at 25° C. or at least 100×103 Siemens/meter at 25° C. or at least 500×103 Siemens/meter at 25° C. or at least 1000×103 Siemens/meter at 25° C.

Embodiment 130

The abrasive article of Embodiment 125, wherein the metal comprises a RF attenuation value of at least 40 dB or at least 50 dB or at least 60 dB or at least 70 dB or at least 80 dB or at least 90 dB or at least 100 dB.

Embodiment 131

The abrasive article of Embodiment 121, wherein the first portion is directly coupled to the non-abrasive surface of the non-abrasive portion.

Embodiment 132

The abrasive article of Embodiment 121, wherein the first portion is at least partially embedded in the non-abrasive portion, wherein a bottom surface of the first portion is below a non-abrasive surface of the non-abrasive portion.

Embodiment 133

The abrasive article of Embodiment 121, wherein the entirety of the first portion is embedded in the non-abrasive portion, wherein an upper surface of the first portion is at or below a non-abrasive surface of the non-abrasive portion.

Embodiment 134

The abrasive article of any one of Embodiments 132 and 133, wherein at least a portion of the electronic assembly extends above the non-abrasive surface.

Embodiment 135

The abrasive article of any one of Embodiments 132 and 133, wherein at least a portion of the second portion extends above the non-abrasive surface.

Embodiment 136

The abrasive article of Embodiment 121, wherein the electronic assembly is at least partially embedded in the non-abrasive portion, wherein a bottom surface of the electronic assembly is below a non-abrasive surface of the non-abrasive portion.

Embodiment 137

The abrasive article of Embodiment 121, wherein the entirety of the electronic assembly is embedded in the non-abrasive portion.

Embodiment 138

The abrasive article of Embodiment 121, wherein the first portion and second portion are embedded in the non-abrasive portion, wherein the upper surface of the second portion is below a non-abrasive surface of the non-abrasive portion.

Embodiment 139

The abrasive article of any one of Embodiments 1, 2, 3, and 4, wherein the electronic device comprises at least one of a vertically polarized antenna, booster antenna, 3D polarized antenna, or any combination thereof.

Embodiment 140

The abrasive article of any one of Embodiments 1, 2, 3, and 4, further comprising a tool system coupled to the abrasive article, wherein the tool system includes a housing at least partially enclosing the body.

Embodiment 141

The abrasive article of any one of Embodiments 1, 2, 3, and 4, wherein the electronic assembly is releasably secured to the body by one or more securing assemblies configured to facilitate selective removal of the electronic assembly via at least one secure keying element.

Embodiment 142

The abrasive article of any one of Embodiments 1, 2, 3, and 4, wherein the body comprises a window and the electronic assembly is disposed in the window.

Embodiment 143

The abrasive article of any one of Embodiments 1, 2, 3, and 4, further comprising a plurality of electronic devices including a first electronic device and a second electronic device, wherein the first electronic device is disposed at a first position on the body and the second electronic device is disposed at a second position on the body, wherein the first position is different from the second position.

Embodiment 144

An abrasive article comprising: a body; and an electronic assembly coupled to the body, wherein the electronic assembly is releasably secured to the body by one or more securing assemblies configured to facilitate selective removal of the electronic assembly from the body.

Embodiment 145

The abrasive article of Embodiment 144, wherein the securing assembly comprises a complementary engagement structure including at least one engagement element coupled to the electronic assembly and configured for complementary engagement with at least one receiving element.

Embodiment 146

The abrasive article of Embodiment 145, wherein the complementary engagement structure includes an engaged position and a disengaged position, wherein in the engaged position the at least one engagement element is engaged with the at least one receiving element.

Embodiment 147

The abrasive article of Embodiment 146, wherein in the engaged position the electronic assembly is in a secured position in the body.

Embodiment 148

The abrasive article of Embodiment 146, wherein in the disengaged position the at least one engagement element is disengaged from the at least one receiving element.

Embodiment 149

The abrasive article of Embodiment 148, wherein in the disengaged position the electronic assembly is in a non-secured position in the body and is configured for release and separation from the body.

Embodiment 150

The abrasive article of Embodiment 144, wherein the securing assembly includes at least one secure keying element.

Embodiment 151

The abrasive article of Embodiment 144, wherein the securing assembly comprises at least one biometric security system.

Embodiment 152

The abrasive article of Embodiment 144, wherein in an engaged position the electronic assembly is in a secured position in the body.

Embodiment 153

The abrasive article of Embodiment 144, wherein the securing assembly includes at least one coupling connection between at least a portion of the body and at least a portion of the electronic assembly.

Embodiment 154

The abrasive article of Embodiment 153, wherein the coupling connection is between a coupling element of the body and a coupling element on a package of the electronic assembly.

Embodiment 155

The abrasive article of Embodiment 144, wherein the securing assembly comprises at least one fastener extending between at least a portion of the electronic assembly and a portion of the body.

Embodiment 156

The abrasive article of Embodiment 144, wherein the securing assembly includes a press-fit coupling between at least a portion of the body and at least a portion of the electronic assembly.

Embodiment 157

The abrasive article of Embodiment 156, wherein the press-fit coupling includes a cavity in a portion of the body.

Embodiment 158

The abrasive article of Embodiment 157, wherein at least a portion of the electronic assembly is press-fit in the cavity.

Embodiment 159

The abrasive article of Embodiment 157, wherein the cavity is defined by a cavity wall, and wherein the cavity wall includes at least one of: a material having an average relative magnetic permeability of not greater than 15; a material having an average dielectric value of not greater than 20; a material having an average RF reflectance of at least 50% for a range of 3 kHz and 300 GHz; or any combination thereof.

Embodiment 160

The abrasive article of Embodiment 157, wherein the cavity defines a window in the body for containing the electronic assembly, wherein the cavity extends through an entire length, width, or thickness of the body.

Embodiment 161

The abrasive article of Embodiment 144, wherein the securing assembly is on an abrasive portion of the body, wherein the abrasive portion includes abrasive particles.

Embodiment 162

The abrasive article of Embodiment 144, wherein the securing assembly is at least partially embedded in an abrasive portion of the body, wherein the abrasive portion includes abrasive particles.

Embodiment 163

The abrasive article of Embodiment 144, wherein the securing assembly is completely embedded in an abrasive portion of the body, wherein the abrasive portion includes abrasive particles.

Embodiment 164

The abrasive article of Embodiment 144, wherein the securing assembly is contained on a non-abrasive portion of the body, wherein the non-abrasive portion is free of abrasive particles.

Embodiment 165

The abrasive article of Embodiment 144, wherein the securing assembly is at least partially embedded in a non-abrasive portion of the body, wherein the non-abrasive portion is free of abrasive particles.

Embodiment 166

The abrasive article of Embodiment 144, wherein the securing assembly is completely embedded in a non-abrasive portion of the body, wherein the non-abrasive portion is free of abrasive particles.

Embodiment 167

The abrasive article of Embodiment 144, the electronic assembly includes an electronic device from the group of an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 168

The abrasive article of Embodiment 167, wherein the electronic device includes a wireless communication device including a logic element and an antenna.

Embodiment 169

The abrasive article of Embodiment 167, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

Embodiment 170

The abrasive article of Embodiment 169, wherein the sensor is selected from the group of an acoustic sensor, force sensor, vibration sensor, temperature sensor, moisture sensor, pressure sensor, gas sensor, or any combination thereof.

Embodiment 171

An abrasive article comprising: a body; and an electronic assembly coupled to the body in a window of the body, wherein the window extends through at least a portion of the body.

Embodiment 172

The abrasive article of Embodiment 171, wherein the window in disposed in an abrasive portion of the body comprising abrasive particles.

Embodiment 173

The abrasive article of Embodiment 171, wherein the window intersects an abrasive surface of an abrasive portion of the body.

Embodiment 174

The abrasive article of Embodiment 171, wherein the window is disposed in a non-abrasive portion, the non-abrasive portion being free of abrasive particles.

Embodiment 175

The abrasive article of Embodiment 171, wherein the window extends through an entire thickness of the body.

Embodiment 176

The abrasive article of Embodiment 171, wherein the window is selectively removable from the body.

Embodiment 177

The abrasive article of Embodiment 171, wherein the window is releasably coupled to the body via at least one coupling mechanism from the group of a keyed assembly, a complementary engagement structure, a threaded connection, a fastener, a snap-fit element, a clip, an adhesive, a tapered-fit connection, or any combination thereof.

Embodiment 178

The abrasive article of Embodiment 171, wherein the window and the electronic assembly are a monolithic construction, wherein the electronic assembly is permanently secured in the body of the window.

Embodiment 179

The abrasive article of Embodiment 171, wherein the window and the electronic assembly a modular construction, wherein the electronic assembly is releasably coupled within the body of the window.

Embodiment 180

The abrasive article of Embodiment 171, wherein the window comprises one or more elements configured to control the direction of the electromagnetic radiation emitted from the electronic assembly.

Embodiment 181

The abrasive article of Embodiment 180, wherein the window comprises at least one of a grating as a coating, a grating as surface features, or any combination thereof.

Embodiment 182

The abrasive article of Embodiment 171, wherein the window has a greater RF transmittance as compared to the body.

Embodiment 183

The abrasive article of Embodiment 171, wherein the window comprises an organic material.

Embodiment 184

The abrasive article of Embodiment 171, wherein the window comprises at least one of biopolymer, conductive polymer, copolymer, fluoropolymer, polyterpene, phenolic resin, polyanhydrides, polyketone, polyester, polyolefin, rubber, silicone, silicone rubber, vinyl polymer or any combination thereof.

Embodiment 185

The abrasive article of Embodiment 171, wherein the electronic assembly includes an electronic device from the group of an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 186

The abrasive article of Embodiment 171, wherein the electronic device includes a wireless communication device including a logic element and an antenna.

Embodiment 187

The abrasive article of Embodiment 171, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

Embodiment 188

The abrasive article of Embodiment 187, wherein the sensor is selected from the group of an acoustic sensor, force sensor, vibration sensor, temperature sensor, moisture sensor, pressure sensor, gas sensor, or any combination thereof.

Embodiment 189

An abrasive system comprising: a housing comprising metal; a body contained within the housing; and an electronic assembly coupled to the body, the electronic assembly comprising: an electronic device configured for wireless communication and having a minimum effective communication range of at least 0.1 meters.

Embodiment 190

The abrasive system of Embodiment 189, wherein the housing comprises a transition metal element.

Embodiment 191

The abrasive system of Embodiment 190, wherein the metal includes at least one of iron, copper, nickel, silver, aluminum, cobalt, or any combination thereof.

Embodiment 192

The abrasive system of Embodiment 189, wherein the housing is at least partially surrounding a portion of the body.

Embodiment 193

The abrasive system of Embodiment 189, wherein the housing is at least partially surrounding a portion of the body and the electronic assembly.

Embodiment 194

The abrasive system of Embodiment 189, wherein the housing defines a receiving space, and at least a portion of the body is contained in the receiving space.

Embodiment 195

The abrasive system of Embodiment 189, wherein the housing completely surrounds the body and the electronic assembly.

Embodiment 196

The abrasive system of Embodiment 189, wherein the housing comprises an electronic device.

Embodiment 197

The abrasive system of Embodiment 196, wherein the electronic device of the housing is configured to communicate wirelessly with the electronic device of the electronic assembly.

Embodiment 198

The abrasive system of Embodiment 189, wherein the housing comprises a booster antenna configured to receive and transmit one or more signals from the electronic device of the electronic assembly.

Embodiment 199

The abrasive system of Embodiment 189, wherein the housing comprises an electronic device from the group of an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 200

The abrasive system of Embodiment 199, wherein the electronic device includes a wireless communication device including a logic element and an antenna.

Embodiment 201

The abrasive system of Embodiment 199, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

Embodiment 202

The abrasive system of Embodiment 201, wherein the sensor is selected from the group of an acoustic sensor, force sensor, vibration sensor, temperature sensor, moisture sensor, pressure sensor, gas sensor, or any combination thereof.

Embodiment 203

The abrasive system of Embodiment 189, wherein the system comprises a minimum effective communication range of at least at least 0.2 meters or at least 0.25 meters or at least 0.3 meters or at least 0.35 meters or at least 0.4 meters or at least 0.5 meters or at least 0.6 meters or at least 0.8 meters or or at least 1 meter or at least 1.2 meters or at least 1.4 meters or at least 1.6 meters or at least 1.8 meters or at least 2 meters or at least 2.2 meters or at least 2.4 meters or at least 2.6 meters or at least 2.8 meters or at least 3 meters or at least 3.2 meters or at least 3.4 meters or at least 3.6 meters or at least 3.8 meters or at least 4 meters or at least 5 meters or at least 6 meters or at least 7 meters or at least 8 meters or at least 9 meters or at least 10 meters.

Embodiment 204

The abrasive system of Embodiment 189, wherein the system comprises a minimum data transmission rate of at least 4 kbps or at least 8 kbps or at least 10 kbps or at least 15 kbps or at least 20 kbps or at least 40 kbps or at least 60 kbps or at least 80 kbps or at least 100 kbps or at least 150 kbps or at least 200 kbps or at least 250 kbps or at least 300 kbps or at least 400 kbps or at least 500 kbps or at least 600 kbps.

Embodiment 205

The abrasive system of Embodiment 189, wherein the system comprises a maximum loss of not more than 50 dB over a range of frequencies of at least 3 kHz to not greater than 300 GHz.

Embodiment 206

The abrasive system of any one of Embodiments 203, 204, and 205, wherein: the electronic device of the electronic assembly includes a wireless communication data transponder; and a wireless communication data transponder on or within at least a portion of the housing and configured to communicate with the electronic device of the electronic assembly.

Embodiment 207

The abrasive system of Embodiment 189, wherein the electronic device is configured for wireless communication and having a minimum effective communication range of at least 0.2 meters or at least 0.25 meters or at least 0.3 meters or at least 0.35 meters or at least 0.4 meters or at least 0.5 meters or at least 0.6 meters or at least 0.8 meters or or at least 1 meter or at least 1.2 meters or at least 1.4 meters or at least 1.6 meters or at least 1.8 meters or at least 2 meters or at least 2.2 meters or at least 2.4 meters or at least 2.6 meters or at least 2.8 meters or at least 3 meters or at least 3.2 meters or at least 3.4 meters or at least 3.6 meters or at least 3.8 meters or at least 4 meters or at least 5 meters or at least 6 meters or at least 7 meters or at least 8 meters or at least 9 meters or at least 10 meters.

Embodiment 208

The abrasive system of Embodiment 207, wherein the minimum effective communication range is not greater than 100 meters or not greater than 75 meters or not greater than 50 meters or not greater than 25 meters or not greater than 20 meters or not greater than 15 meters or not greater than 12 meters or not greater than 10 meters.

Embodiment 209

The abrasive system of Embodiment 189, wherein the electronic device comprises a minimum data transmission rate of at least 4 kbps or at least 8 kbps or at least 10 kbps or at least 15 kbps or at least 20 kbps or at least 40 kbps or at least 60 kbps or at least 80 kbps or at least 100 kbps or at least 150 kbps or at least 200 kbps or at least 250 kbps or at least 300 kbps or at least 400 kbps or at least 500 kbps or at least 600 kbps.

Embodiment 210

The abrasive system of Embodiment 189, wherein the electronic device comprises a maximum loss of not less than −50 dB over a range of frequencies of at least 3 kHz to not greater than 300 GHz.

Embodiment 211

The abrasive system of Embodiment 189, wherein the electronic device comprises at least one of a vertically polarized antenna, booster antenna, 3D polarized antenna, or any combination thereof.

Embodiment 212

The abrasive system of Embodiment 189, wherein the electronic assembly is releasably secured to the body by one or more securing assemblies configured to facilitate selective removal of the electronic assembly via at least one secure keying element.

Embodiment 213

The abrasive system of Embodiment 189, wherein the body comprises a window and the electronic assembly is disposed in the window.

Embodiment 214

The abrasive system of Embodiment 189, wherein comprising a plurality of electronic devices including a first electronic device and a second electronic device, wherein the first electronic device is disposed at a first position on the body and the second electronic device is disposed at a second position on the body, wherein the first position is different from the second position.

Embodiment 215

The abrasive system of Embodiment 189, wherein the electronic assembly is on an abrasive portion of the body, wherein the abrasive portion includes abrasive particles.

Embodiment 216

The abrasive system of Embodiment 189, wherein the electronic assembly is at least partially embedded in an abrasive portion of the body, wherein the abrasive portion includes abrasive particles.

Embodiment 217

The abrasive system of Embodiment 189, wherein the electronic assembly is completely embedded in an abrasive portion of the body, wherein the abrasive portion includes abrasive particles.

Embodiment 218

The abrasive system of Embodiment 189, wherein the electronic assembly is contained on a non-abrasive portion of the body, wherein the non-abrasive portion is free of abrasive particles.

Embodiment 219

The abrasive system of Embodiment 189, wherein the electronic assembly is at least partially embedded in a non-abrasive portion of the body, wherein the non-abrasive portion is free of abrasive particles.

Embodiment 220

The abrasive system of Embodiment 189, wherein the electronic assembly is completely embedded in a non-abrasive portion of the body, wherein the non-abrasive portion is free of abrasive particles.

Embodiment 221

The abrasive system of Embodiment 189, further comprising a workpiece configured to access an abrasive portion of the body, wherein the workpiece comprises at least one electronic assembly.

Embodiment 222

The abrasive system of Embodiment 221, wherein the electronic assembly of the workpiece is configured to receive or transmit data to the electronic assembly coupled to the body.

Embodiment 223

The abrasive system of Embodiment 221, wherein the electronic assembly of the workpiece is configured to communicate with at least one of: the electronic device of the electronic assembly including a wireless communication data transponder; a wireless communication data transponder on or within at least a portion of the housing; or a combination thereof.

Embodiment 224

The abrasive system of Embodiment 221, wherein the electronic assembly of the workpiece includes an electronic device selected from the group of an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 225

The abrasive system of Embodiment 224, wherein the electronic device of the workpiece includes a wireless communication device including a logic element and an antenna.

Embodiment 226

The abrasive system of Embodiment 224, wherein the electronic device of the workpiece at least one of a passive radio frequency identification (RFID) tag, an active radio frequency identification (RFID) tag, a sensor, a passive near-field communication device (passive NFC), an active near-field communication device (active NFC), or any combination thereof.

Embodiment 227

The abrasive system of Embodiment 226, wherein the sensor is selected from the group of an acoustic sensor, force sensor, vibration sensor, temperature sensor, moisture sensor, pressure sensor, gas sensor, or any combination thereof.

Embodiment 228

An abrasive article comprising: a body; and an electronic assembly coupled to the body, the electronic assembly oriented in a non-parallel configuration relative to a major exterior surface of the body.

Embodiment 229

The abrasive article of Embodiment 228, wherein the body comprises a radial axis and an axial axis, wherein the electronic assembly comprises a longitudinal axis that is not parallel to either the radial axis or the axial axis.

Embodiment 230

The abrasive article of Embodiment 228, wherein the electronic assembly is contained in a cavity of the body, and wherein the cavity has a lower surface oriented in a non-parallel configuration relative to a major exterior surface of the body.

Embodiment 231

The abrasive article of Embodiment 228, wherein the electronic assembly is contained in a cavity of the body, and wherein the cavity has a lower surface oriented in a non-parallel configuration relative to a radial axis or a longitudinal axis of the body.

Embodiment 232

The abrasive article of Embodiment 228, wherein the electronic assembly is contained in a cavity of the body, and wherein the cavity has a lower surface oriented in a non-parallel configuration relative to a radial axis or a longitudinal axis of the body.

Embodiment 233

The abrasive article of Embodiment 228, wherein the body comprises at least one mounting surface configured to receive at least a portion of the electronic assembly, wherein the mounting surface is angled relative to a radial axis or a longitudinal axis of the body.

Embodiment 234

The abrasive article of Embodiment 228, wherein electronic assembly is coupled to a surface of the body and the electronic assembly is angled in a non-planar configuration relative to a plane defined by the surface of the body.

Embodiment 235

The abrasive article of Embodiment 228, wherein electronic assembly is coupled to a major surface of the body and the electronic assembly is angled in a non-planar configuration relative to a plane defined by the major surface of the body.

Embodiment 236

The abrasive article of Embodiment 228, wherein the electronic assembly comprises an electronic device from the group of an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 237

The abrasive article of Embodiment 228, wherein the electronic device includes a wireless communication device including a logic element and an antenna.

Embodiment 238

The abrasive article of Embodiment 228, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

Embodiment 239

The abrasive article of Embodiment 238, wherein the sensor is selected from the group of an acoustic sensor, force sensor, vibration sensor, temperature sensor, moisture sensor, pressure sensor, gas sensor, or any combination thereof.

Embodiment 240

The abrasive article of Embodiment 228, wherein the electronic device comprises at least one of a vertically polarized antenna, booster antenna, 3D polarized antenna, or any combination thereof.

Embodiment 241

An abrasive article comprising: a body, the body including a cavity; and an electronic assembly coupled to the body, the electronic assembly including an electronic device, wherein the electronic assembly is positioned in the cavity of the body, the cavity extends within the body from an exterior surface of the cavity, and a spacing factor of the electronic assembly is at least 0.65, the spacing factor being a ratio of Dw/Dt, with Dw being a distance from an outer edge of the electronic assembly to an outer edge of the cavity at the exterior surface of the body, and Dt being a depth of the cavity, the depth Dt being orthogonal to the distance Dw.

Embodiment 244

The abrasive article of Embodiment 241, wherein a wall of the cavity is orthogonal to the exterior surface of the body.

Embodiment 245

The abrasive article of Embodiment 241, wherein a wall of the cavity has an angle of at least 100 degrees relative to a plane bottom surface of the cavity, such as at least 110 degrees, at least 115 degrees, or at least 120 degrees.

Embodiment 246

The abrasive article of Embodiment 241, wherein a wall of the cavity has an angle of not greater than 170 degrees or not greater than 160, or not greater than 150 degrees, or not greater than 145 degrees, or not greater than 140 degrees, or not greater than 130 degrees, or not greater than 120 degrees.

Embodiment 247

The abrasive article of Embodiment 241, wherein the electronic device is positioned within the cavity at least 1 mm below a level of the exterior surface of the body, such as at least 2 mm, at least 3 mm, at least 3.5 mm, at least 4 mm, at least 5 mm.

Embodiment 248

The abrasive article of Embodiment 241, wherein the electronic assembly is positioned within the cavity at least 1 mm below a level of the exterior surface of the body, such as at least 2 mm, at least 3 mm, at least 3.5 mm, at least 4 mm, at least 5 mm.

Embodiment 249

The abrasive article of Embodiment 241, wherein a diameter of the cavity is at least 5 mm, or at least 7 mm, or at least 10 mm, or at least 12 mm.

Embodiment 250

The abrasive article of Embodiment 241, wherein the electronic assembly comprises a first portion which is RF transparent.

Embodiment 251

The abrasive article of Embodiment 241, wherein the electronic assembly comprises a second portion which is not RF transparent.

Embodiment 252

The abrasive article of Embodiment 241, wherein the electronic assembly comprises a first portion which is RF transparent, and a second portion which is not RF transparent.

Embodiment 253

The abrasive article of Embodiment 241, further comprising an adapter, wherein the adapter provides a support structure for the electronic assembly.

Embodiment 254

The abrasive article of Embodiment 253, wherein the electronic assembly is positioned in a central region of the adapter.

Embodiment 255

The abrasive article of Embodiment 253, wherein the adapter comprises a multi-layer structure.

Embodiment 256

The abrasive article of Embodiment 255, wherein the multi-layer structure is positioned underneath the electronic assembly and comprises a metal layer and a non-metallic layer.

Embodiment 257

The abrasive article of Embodiment 256, wherein the non-metallic layer comprises an organic polymer.

Embodiment 258

The abrasive article of Embodiment 253, wherein the adapter comprises a coupling structure for fastening the electronic assembly within the cavity.

Embodiment 259

The abrasive article of Embodiment 254, wherein the adapter comprises a tolerance fit, a press fit, a threaded joint, or a knurled surface for coupling to the cavity.

Embodiment 260

The abrasive article of Embodiment 241, wherein the spacing factor is at least 0.7 or a least 0.8 or at least 0.9 or at least 1.0 or at least 1.1 or at least 1.2 or at least 1.5 or at least 1.7 or at least 2 or at least 3 or at least 5.

Embodiment 261

The abrasive article of Embodiment 241, wherein a distance of minimum communication of the electronic device is at least 0.01 meters.

Embodiment 262

The abrasive article of Embodiment 241, wherein the body comprises a metal wheel.

Embodiment 263

The abrasive article of Embodiment 241, wherein the electronic assembly includes an electronic device selected from an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 264

The abrasive article of Embodiment 263, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

Embodiment 265

The abrasive article of Embodiment 241, wherein the cavity is contained in an abrasive portion of the body.

Embodiment 266

The abrasive article of Embodiment 241, wherein the cavity is contained in a non-abrasive portion of the body.

Embodiment 267

The abrasive article of Embodiment 241, wherein the cavity further comprises a filling material.

Embodiment 268

The abrasive article of Embodiment 241, wherein the filling material includes an organic polymer.

Embodiment 269

An abrasive article comprising: a body; a cavity extending within the body from an exterior surface from the body; and an electronic assembly contained within the cavity of the body, the electronic assembly including an electronic device, wherein a bottom surface of the cavity is substantially flat.

Embodiment 270

The abrasive article of Embodiment 269, wherein the bottom surface of the cavity has a normalized average flatness between 0.00001 mm-1 to 0.0001 mm-1.

Embodiment 271

The abrasive article of Embodiment 269, wherein the bottom surface of the cavity has a surface which is substantially parallel to a bottom surface of the electronic assembly.

Embodiment 272

The abrasive article of Embodiment 269, wherein the electronic device is completely contained within the cavity.

Embodiment 273

The abrasive article of Embodiment 269, wherein the electronic assembly is completely contained within the cavity.

Embodiment 274

The abrasive article of Embodiment 269, wherein the electronic assembly includes an electronic device selected from an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 275

The abrasive article of Embodiment 274, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

Embodiment 276

The abrasive article of Embodiment 269, wherein a minimum effective communication range of the electronic device is at least 0.2 meters.

Embodiment 277

A process for attaching an electronic device to an abrasive article, comprising: providing the abrasive article having a body, identifying a position on the body; using a robot for placing the electronic device at the position.

Embodiment 278

The process of Embodiment 277, wherein providing the abrasive article includes identifying the abrasive article from a plurality of abrasive articles.

Embodiment 279

The process of Embodiment 278, wherein identifying the abrasive body comprises using a vision system.

Embodiment 280

The process of Embodiment 279, wherein the vision system detects a unique indicia encoding information related to the abrasive article.

Embodiment 281

The process of any one of Embodiments 278-280, wherein identifying a position on the body comprises using a vision system.

Embodiment 282

The process of any one of Embodiments 278-281, further comprising selecting the electronic device by the robot and coupling the electronic device to the identified position of the body.

Embodiment 283

The process of any one of Embodiments 277-282, wherein the position is a cavity extending within the body from an exterior surface of the body.

Embodiment 284

The process of any one of Embodiments 277-282, wherein the body includes a wheel.

Embodiment 285

The process of any one of Embodiments 277-284, wherein the electronic device is contained in an electronic assembly.

Embodiment 286

The process of any one of Embodiments 277-285, wherein the robot comprises an in built force/torque sensor capable of detecting the maximum force to be exerted to press the electronic device into the cavity.

Embodiment 287

The process of any one of Embodiments 277-286 wherein the electronic device includes an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

Embodiment 288

The process of any one of Embodiments 277-287, wherein the electronic device is contained in a packaging.

Embodiment 289

An abrasive article comprising: a body; an electronic assembly including an electronic device coupled to the body; and an adapter coupled to the electronic assembly.

Embodiment 290

The abrasive article of Embodiment 289, wherein the adapter comprises a coupling structure for fastening the electronic assembly within a cavity of the body.

Embodiment 291

The abrasive article of Embodiment 290, wherein the adapter comprises a tolerance fit, a press fit, a threaded joint, or a knurled surface for coupling to the cavity.

Embodiment 292

The abrasive article of any one of Embodiments 289-291, wherein the electronic device includes an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

EXAMPLES

Example 1

RFID Tags Integrated within Abrasive Wheel.

Figure 23A:
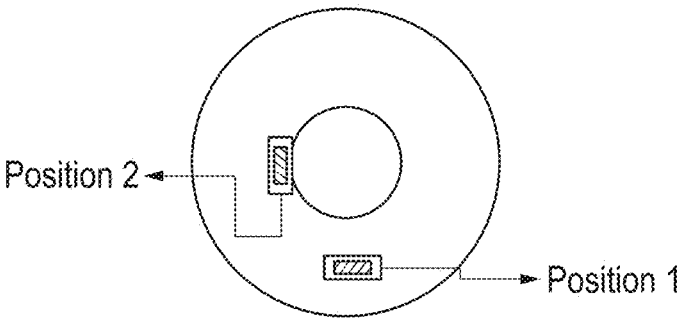
FIG. 23A includes a top view of a line drawing illustrating positions for coupling an electronic assembly on a wheel surface according to one embodiment.

Abrasive wheels designed for edge grinding were used for drilling cavities (also called slots herein) in the wheel body for inserting and testing different types RFID tags. The slots were drilled at two different positions in the non-abrasive portion of the wheel (position 1 and position 2) to investigate alternative slot possibilities for placing the tags, see also FIG. 23A. Position 1 was more in the center of an exterior surface of the wheel, while Position 2 was close to the inner diameter of the wheel. Three different types of RFID tags were tested: Omni ID Fit 220, Omni ID Fit 400 P and HID Ceramic Brick. As adhesive for attaching and covering the tags were used Araldite Klear and Technovit 3040.

After placing the tags in the slots of the wheel and curing the adhesive, each wheel was submitted to an electrical discharge machining (EDM) process to re-profile the abrasive layer. EDM included soaking the wheel in EDM oil for about two hours. Thereafter, the wheel was subjected to dynamic balancing to check for imbalance. Furthermore, a spin test was conducted to check the adhesive integrity at a speed 1.5 time of the wheel rated speed. Finally, the wheel was used for grinding ten panels of glass.

Figure 23B:
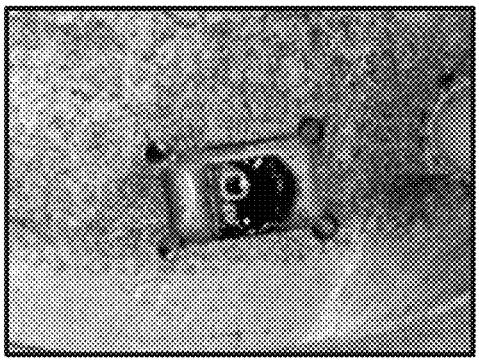
FIG. 23B includes an image of a section of an abrasive wheel comprising a cavity including an electronic assembly according to one embodiment.
Figure 23C:
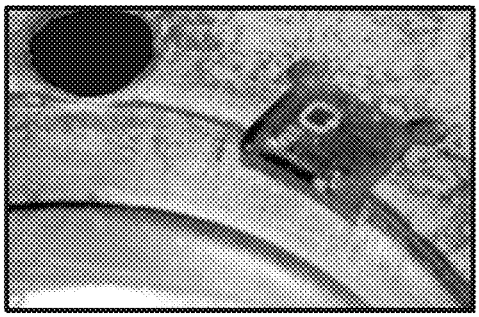
FIG. 23C includes an image of a section of an abrasive wheel comprising a cavity including an electronic assembly according to one embodiment.

Before and after the conducted tests and glass grinding, the information contained on the RFID tags was measured with a wire less read device (Zebra RFD 8500 handheld reader). It could be assured that all tested RFID tags at both positions of the wheel maintained their readability during the test and grinding operations, such that all the stored information was always accessible. Furthermore, the tags maintained their structural integrity and adhesion within the slots. Images of sections of the wheels shown the slot with the adhesive covered tag can be seen in FIGS. 23 B and 23 C.

Example 2

Investigation of Influence of Spacing Factor on Communication Range.

A variety of holes (cavities) having different diameter size and depths were drilled at a side surface of a steel wheel. The steel wheel was a wheel designed for glass edge grinding. The wheel had a diameter size of 150 mm and a thickness of 15 mm.

In each of the test cavities, an RFID tag (UHF ceramic tag) was placed in the center of the bottom surface using the same adhesive as in Example 1. A Zebra RFD 8500 hand-held reader was used to test at which distance from the RFID tag the information contained on the tag was readable. The information on the RFID tag contained an electronic product code (EPC) and user data related to the wheel type.

Figure 20:
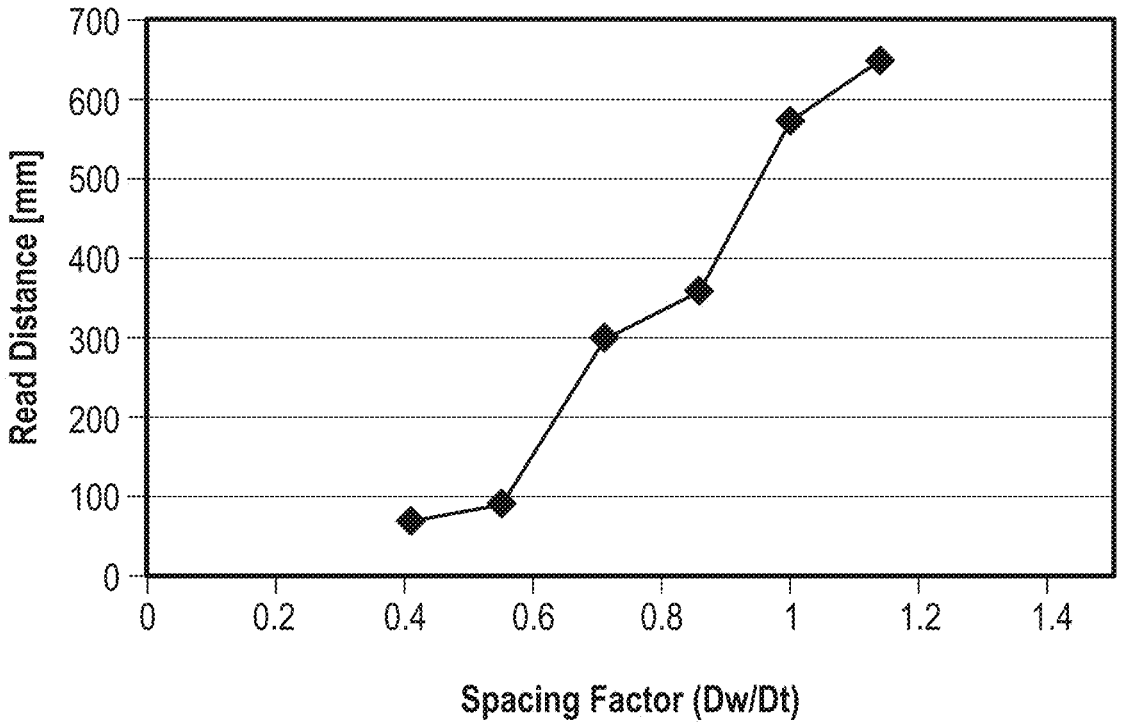
FIG. 20 includes a graph showing a relationship between the spacing factor and communication distance according to one embodiment.

A summary of the measured maximum communication distance in dependency to the space between tag and the wall of the cavity (Dw) and the depth of the cavity (Dt) is shown in Table 1 and FIG. 20.

TABLE 1

| Sample | Dw [mm] | Dt [mm] | Dw/Dt (Spacing Factor) | Communication Distance [mm] |
|---|---|---|---|---|
| 1 | 2.5 | 6.0 | 0.41 | 70 |
| 2 | 2.5 | 4.5 | 0.55 | 90 |
| 3 | 2.5 | 3.5 | 0.71 | 300 |
| 4 | 3.0 | 3.5 | 0.86 | 360 |
| 5 | 3.5 | 3.5 | 1.0 | 575 |
| 6 | 4.0 | 3.5 | 1.14 | 650 |

Example 3

Influence of Flatness of Cavity Bottom on Communication Distance.

Figure 24A:
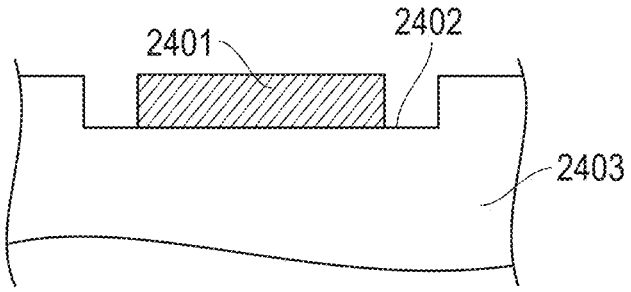
FIG. 24A includes a cross-section of a body illustrating an electronic assembly contained in a cavity according to one embodiment.
Figure 24B:
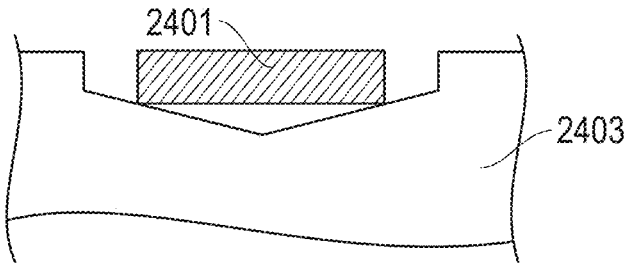
FIG. 24B includes a cross-section of a body illustrating an electronic assembly contained in a cavity.
Figure 24C:
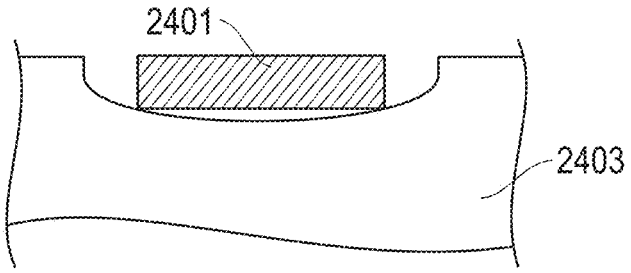
FIG. 24C includes a cross-section of a body illustrating an electronic assembly contained in a cavity.

The same wheel, RFID tags and measuring device was used as in Example 1, except that cavities were formed having a different shape of the bottom. As illustrated in FIGS. 24A, B, and C, in Sample 6 (FIG. 24A) the RFID tag 2401 was attached to a flat bottom cavity surface of the wheel body 2403, while Sample 7 (FIG. 24B) was placed in the middle of two inclining surfaces, and Sample 8 (FIG. 24C) was attached to a curved surface. Next to the change of the surface geometry, no other changed were made, Dw and Dt was for all samples the same.

A summary of the results can be seen in Table 2. It can be seen that the best communication distance was obtained when the RFID tag was place on a flat surface. It should be noted that safety standards in industry require a certain minimum distance of an operator to the abrasive article, e.g., an abrasive wheel. Accordingly, in certain situations, the read or communication distance of the electronic device should by at least 0.01 meters or at least 0.02 meters.

TABLE 2

| Sample | Cavity bottom Surface shape | Communication Distance [mm] |
|---|---|---|
| 6 | flat (180 degrees) | 300 |
| 7 | Inclined (118 degrees) | 110 |
| 8 | curved | 170 |

Example 4

Use of RFID Tags in Wheel for Tracing Wheels Subjected to Different Grinding Time Exposure/Wear.

The same wheel type, RFID tags and measuring device was used as in Example 1, except that RFID data was included and used to set machining parameters before operation starts. The RFID identification data was also utilized to map for each wheel a power usage pattern with regard to the number of glasses that were ground. The power was measured using additional sensors (current, voltage, frequency) connected to the grinding machine and monitored throughout the life of the wheel. The power variation due to smoothening or damage of the grinding surface was detected and alerted to the user to stop the operation when needed.

The alerts were also suitable to be generated via. sms or indicators. This process can reduce defects in glasses and also may improve the life of a wheel. One-to-one mapping/traceability was conducted by encoding the information (re-profile number, number of glasses, machine parameters etc.) in the user memory of the tag.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of the invention.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of the invention.

What is claimed is:

1. An abrasive article comprising:

a body comprising a portion comprising a metal or metal alloy; and an electronic assembly coupled to the body, wherein the electronic assembly comprises:

an electronic device;

a first portion underlying at least a portion of the electronic device, wherein the first portion is disposed between the body and the electronic device, and wherein the first portion comprises a material having a first average relative magnetic permeability;

a second portion overlying at least a portion of the electronic device and comprising a material having a second average relative magnetic permeability;

a dielectric difference value (ΔDV=DV1/DV2) of at least 1.1 and not greater than 1000, wherein DV1 is a first average dielectric value of the first portion and DV2 is a second average dielectric value of the second portion; and a magnetic permeability difference value (ΔMP=MP2/MP1) within a range of at least 1.1 and not greater than 100, wherein MP1 is the first average relative magnetic permeability and MP2 is the second average relative magnetic permeability, wherein the first portion comprises the first average relative magnetic permeability within a range of at least 1 and not greater than 15 for electromagnetic radiation of at least 3 kHz and not greater than 300 GHz; or the first average dielectric value of at least 1 and not greater than 20;

wherein second portion comprises the second average relative magnetic permeability within a range of at least 1 and not greater than 15 for electromagnetic radiation of at least 3 kHz and not greater than 300 GHz; or the second average dielectric value of at least 1 and not greater than 20.

2. The abrasive article of claim 1, wherein the metal or metal alloy comprises a conductivity of at least $10\times10^3$ Siemens/meter at 25° C., wherein the first portion is configured to electrically insulate the electronic device from the body.

3. The abrasive article of claim 2, where the metal or metal alloy comprises a radio frequency attenuation value of at least 40 dB.

4. The abrasive article of claim 1, wherein:

the first average relative magnetic permeability is within the range of at least 1 and not greater than 15 for electromagnetic radiation of at least 3 kHz and not greater than 300 GHz, and the second average relative magnetic permeability of the second portion is within the range of at least 1 and not greater than 15 for electromagnetic radiation of at least 3 kHz and not greater than 300 GHz; and the first average dielectric value is at least 1 and not greater than 20, and the second average dielectric value is at least 1 and not greater than 20.

5. The abrasive article of claim 1, wherein the electronic device is configured for wireless communication and has a minimum effective communication range of at least 0.3 meters and a minimum data transmission rate of at least 4 kbps.

6. The abrasive article of claim 1, wherein a first RF reflectance of the first portion is at least 50% and not greater than 90% for electromagnetic radiation of at least 3 kHz and not greater than 3 GHz, and a second RF reflectance of the second portion is not greater than 40% for electromagnetic radiation of at least 3 kHz and not greater than 300 GHz.

7. The abrasive article of claim 1, wherein the second portion is overlying at least a portion of the first portion.

8. The abrasive article of claim 1, further comprising a reflection difference value ($\Delta RFR=RFR1/RFR2$) of at least 1.1 and not greater than 100, wherein RFR1 is a RF reflectance of the first portion and RFR2 is a RF reflectance of the second portion.

9. The abrasive article of claim 1, wherein the electronic assembly is surrounded by the first portion and the second portion.

10. The abrasive article of claim 2, wherein the electronic device includes a device including an electronic tag, electronic memory, a sensor, an analog-to-digital converter, a transmitter, a receiver, a transceiver, a modulator circuit, a multiplexer, an antenna, a near-field communication device, a power source a display, an optical device, a global positioning system, a data transponder, a secure data storage device, a secure logic device, or any combination thereof.

11. The abrasive article of claim 3, wherein the electronic device comprises at least one of a passive radio frequency identification (RFID) tag, an active radio frequency identification (RFID) tag, a sensor, a passive near-field communication device (passive NFC), an active near-field communication device (active NFC), or any combination thereof.

12. The abrasive article of claim 2, wherein the second portion comprises a protective layer including a hydrophobic layer, an autoclavable material, a thermal barrier, a pressure barrier, or any combination thereof.

13. The abrasive article of claim 1, wherein the first portion is at least partially embedded in the portion of the body comprising the metal or metal alloy.

14. The abrasive article of claim 1, wherein the first portion is coupled to the portion of the body comprising the metal or metal alloy.

15. The abrasive article of claim 1, wherein the first portion comprises polyimide, polyethylene terephthalate, polytetrafluoroethylene, or any combination thereof; and further wherein the second portion comprises PDMS, PEN, polyimide, PEEK or any combination thereof.

16. The abrasive article of claim 1, wherein the electronic assembly is releasably secured to the body by one or more securing assemblies configured to facilitate selective removal of the electronic assembly from the body.

17. The abrasive article of claim 1, wherein the electronic assembly is placed in a cavity extending into the body; and wherein a spacing factor of the electronic assembly, defined by Dw/Dt, is at least 0.65, wherein Dw is the distance from an outer edge of the electronic assembly to an outer edge of the cavity at an exterior surface of the body, and Dt is a depth of the cavity.

18. The abrasive article of claim 17, wherein the electronic device is positioned within the cavity at least 1 mm below a level of the exterior surface of the body.

19. The abrasive article of claim 17, wherein the metal or metal alloy comprises a RF attenuation value of at least 40 dB.

20. The abrasive article of claim 17, further comprising at least one of 1) A wall of the cavity having an angle of at least 100 degrees and not greater than 170 degrees relative to the exterior surface;
2) An adapter configured to at least partially contain the electronic assembly and be disposed within the cavity to center the electronic assembly within the cavity;
3) A spacing factor of at least 0.9;
4) A bottom surface of the cavity having a normalized average flatness between 0.00001 $mm^{-1}$ to 0.0001 $mm^{-1}$; or
5) Any combination thereof.

* * * * *